US007034801B2

(12) United States Patent
Sato et al.

(10) Patent No.: US 7,034,801 B2
(45) Date of Patent: Apr. 25, 2006

(54) COLOR IMAGE DISPLAY

(75) Inventors: Tsuneo Sato, Tokyo (JP); Ichiro Furuki, Tokyo (JP); Hiroshi Ito, Tokyo (JP); Keiki Yamada, Tokyo (JP); Masatoshi Takahashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 336 days.

(21) Appl. No.: 10/399,705

(22) PCT Filed: Dec. 28, 2001

(86) PCT No.: PCT/JP01/11655

§ 371 (c)(1),
(2), (4) Date: Apr. 21, 2003

(87) PCT Pub. No.: WO02/056288

PCT Pub. Date: Jul. 18, 2002

(65) Prior Publication Data

US 2004/0041781 A1 Mar. 4, 2004

(30) Foreign Application Priority Data

Jan. 10, 2001 (JP) ..... 2001-002887
Jan. 10, 2001 (JP) ..... 2001-002893
Jan. 10, 2001 (JP) ..... 2001-002896

(51) Int. Cl.
*G09G 3/36* (2006.01)

(52) U.S. Cl. ..... 345/102; 345/88; 345/99; 348/742

(58) Field of Classification Search ..... 345/102, 345/105, 109, 87, 88, 99, 7, 8, 98; 349/79, 349/80; 359/292, 299, 22; 348/742, 740
See application file for complete search history.

(56) References Cited

U.S. PATENT DOCUMENTS 5,153,569 A * 10/1992 Kawamura et al. ..... 345/8

(Continued)

FOREIGN PATENT DOCUMENTS

EP 0709823 A2 5/1996

(Continued)

*Primary Examiner*—Xiao Wu
*Assistant Examiner*—Abbas I. Abdulselam
(74) *Attorney, Agent, or Firm*—Birch, Stewart, Kolasch & Birch, LLP

(57) ABSTRACT

An object of the present invention is to provide a color image display apparatus which can easily display a full-color animation of VGA class and attains reduction in size and lowering of price and which facilitates full-color gradation control. In order to achieve the object, a color image display apparatus includes a shutter control circuit that slices color component data subjected to color separation in accordance with a slice level, a light source control circuit that controls a light source corresponding to the color component data, one or plural light sources a converting device that converts light from the light source to surface light source light, a shutter which makes light of a corresponding pixel pass therethrough and cuts off the light and which is made of liquid crystal as a main material, and a timing circuit that generates operation timings for the shutter control circuit and the light source control circuit, in which the shutter control circuit transfers one line of slice data to the shutter sequentially on a slice level basis, the light source control circuit turns on the light source corresponding to the source data, and the shutter makes the light from the light source, which corresponds to the slice data representing gradation of the pixel, pass therethrough and cuts off the light to display an image.

33 Claims, 34 Drawing Sheets

U.S. PATENT DOCUMENTS

| | | | | |
|---|---|---|---|---|
| 6,115,016 | A * | 9/2000 | Yoshihara et al. | 345/88 |
| 6,414,669 | B1 * | 7/2002 | Masazumi | 345/98 |
| 6,507,326 | B1 * | 1/2003 | Manabe et al. | 345/32 |
| 6,690,346 | B1 * | 2/2004 | Hanano | 345/98 |

FOREIGN PATENT DOCUMENTS

| | | | |
|---|---|---|---|
| EP | 0889458 | A2 | 1/1999 |
| EP | 0997868 | A1 | 5/2000 |
| JP | 62-194234 | A | 8/1987 |
| JP | 63-113426 | A | 5/1988 |
| JP | 08-234159 | A | 9/1996 |
| JP | 09-274471 | A | 10/1997 |
| JP | 11-85110 | A | 3/1999 |
| JP | 11-239359 | A | 8/1999 |
| JP | 11-259020 | A | 9/1999 |
| JP | 2000-227782 | A | 8/2000 |

* cited by examiner

COLOR IMAGE DISPLAY

This application is the national phase under 35 U.S.C. § 371 of PCT International Application No. PCT/JP01/11655 which has an International filing date of Dec. 28, 2001, which designated the United States of America.

TECHNICAL FIELD

The present invention relates to a field sequential color image display apparatus, and particularly to a field sequential color image display apparatus which can easily display a full-color animation of VGA class and attains reduction in size of a liquid crystal driver circuit and a light source driver circuit for achievement of a low price and which facilitates full-color gradation control even in the case of using a small number of light sources.

BACKGROUND ART

Conventional Example 1

FIG. 32 is a block diagram of a conventional field sequential color display apparatus disclosed in, for example, JP 09-274471 A. A light source portion P1 is constituted by a red light source R, a green light source G, and a blue light source B, and is turned on by a red lighting signal Lr, a green lighting signal Lg, and a blue lighting signal Lb which are supplied from a light source driver circuit P8. A shutter portion P2 is driven by a data signal D and a common signal C which are supplied from a shutter control circuit P9.

Next, an operation will be described. FIG. 33 shows a waveform of each signal in the field sequential color display apparatus. Two fields F1 and F2 are used to make a liquid crystal shutter driven with an alternating current, and each field is composed of three subfields FR, FG, and FB.

The red light source lighting signal Lr turns the red light source R on only in the subfield FR, and presents non-lighting in the other subfields FG and FB. Similarly, the green light source lighting signal Lg turns the green light source G on only in the subfield FG, and presents non-lighting in the other subfields FR and FB. The blue light source lighting signal Lb turns the blue light source B on only in the subfield FB, and presents non-lighting in the other subfields FR and FG. The common signal C supplied to the liquid crystal shutter is in a state of c1 in the field F1 and in a state of c2 in the field F2.

In Conventional Example 1, normally white STN liquid crystal is used. Thus, a white-display data signal Dw is an in-phase signal of the common signal C, and a black-display data signal Dbk has an opposite phase to that of the common signal C.

A data signal in the case of displaying a monochrome primary color has a potential such that the shutter is brought into a transmission state (white) only in the subfield corresponding to the color. For example, a data signal Dr in the case of red display has a potential such that the shutter is brought into the transmission state only in the subfield FR corresponding to red. A data signal Dg in the case of green display has a potential such that the shutter is brought into the transmission state only in the subfield FG corresponding to green. The data signal Db in the case of blue display has a potential such that the shutter is brought into the transmission state only in the subfield FB corresponding to blue.

A data signal in the case of displaying plural primary colors has a potential such that the shutter is brought into the transmission state (white) only in the subfields corresponding to the respective colors. For example, a data signal Dc in the case of blue-green display has a potential such that the shutter is brought into the transmission state in the subfields FG and FB respectively corresponding to green and blue. A data signal Dm in the case of purple display has a potential such that the shutter is brought into the transmission state in the subfields FB and FR respectively corresponding to blue and red. A data signal Dy in the case of yellow display has a potential such that the shutter is brought into the transmission state in the subfields FR and FG respectively corresponding to red and green.

In Conventional Example 1, the time widths of the subfields FR, FG, and FB and the respective numbers of R light sources, G light sources, and B light sources, which constitute the light source portion P1, are changed for each color, thereby striking a color balance of white.

Conventional Example 2

FIG. 34 is a block diagram showing a structure of a conventional liquid crystal multi-color display apparatus disclosed in, for example, JP 08-234159 A. In FIG. 34, reference symbol Q1 denotes a liquid crystal display, reference symbol Q2 denotes a controller, and reference symbols Q3 to Q5 each denote a light source composed of light emitting diodes (hereinafter referred to as LED).

The liquid crystal display Q1 has plural segments. A common terminal (hereinafter referred to as COM terminal) of the respective segments is denoted by Q1*g*, and drive terminals (hereinafter referred to as SEG terminal) of the respective segments are denoted by Q1*h* to Q1*j*. The controller Q2 is comprised of a microcomputer, which applies a bias to the COM terminal and the SEG terminals and weighs the timing in driving each of the LEDs Q3 to Q5.

Next, an operation will be described. FIG. 35 shows lighting timing of the LEDs at the time of multi-color display of the liquid crystal multi-color display apparatus shown in FIG. 34. A pulse width modulation drive with the controller Q2 can vary a light amount of each LED. This enables light emission of yellow, pink, purple, and the like, which are not originally provided to the LED itself. Thus, full-color display becomes possible.

Conventional Example 3

FIG. 36 is a circuit block diagram of a conventional time-division color liquid crystal display apparatus and a driving method thereof disclosed in, for example, JP 07-121138 A. In FIG. 36, a timing controller Q21 controls all the timing of the time-division color liquid crystal display apparatus. First, an image signal is subjected to sampling in a sampling circuit Q22, and the resultant image signals of RGB are respectively accumulated in field memories Q23. Subsequently, the accumulated image signals are sent to a signal selection circuit Q24 one after another. Since the image signals of three colors are sent one after another in a period of one field, about a threefold speed to a sampling speed is required. The sent image signal is amplified by an image amplifier circuit Q25 in accordance with optical characteristics of the liquid crystal display apparatus. The amplified signal is sent to a data driver Q26 to drive the liquid crystal display apparatus.

In an active matrix liquid crystal display device Q28, lines are sequentially selected by a scanning driver Q27 for each line, and in synchronization with the selection pulse, the image signal is written into by the data driver Q26. On the other hand, a time-division three primary colors light emitting device Q29 is also controlled by the timing controller Q21, and sequentially changes a light emitting color in synchronization with the data driver Q26 or the scanning driver Q27. Here, a constant time-lag is caused to scanning timing of the active matrix liquid crystal display device Q28. Also, as shown in FIG. 37, the period from the start to the end of an optical response of liquid crystal is made to represent non-light emission. In FIG. 37, a non-light emitting region Q45 is provided between a green light emitting region Q41 and a red light emitting region Q42 of a time-division three primary colors light emitting device Q49. Note that reference symbol Q43 denotes a green image signal holding region; Q44 denotes a red image signal holding region; and Q48 denotes a liquid crystal display region.

By the way, the above-described field sequential color display apparatus in Conventional Example 1 has a characteristic that a white balance is sufficiently obtained by changing the time width of the subfield and the number of sub-light sources. However, there has been a problem in that the color display apparatus can perform only multi-color display with combination of LEDs, and thus is not adequate to full-color animation display.

Further, since color reproduction is performed with three separate color components of R, G and B, reproduction of RGB colors is limited to monochromatic reproduction that is adjusted to strike a white balance in order to obtain a sufficient white balance. Thus, there has been a problem in that the reproduction is inferior to that with monochromatic light.

Further, since the three light sources for R, G, and B are used, the characteristics of the light sources directly correspond to the characteristics of the image display apparatus. Thus, there has been a problem in that color management without the light sources is difficult to be conducted.

On the other hand, the liquid crystal multi-color display apparatus in Conventional Example 2 has a characteristic that light emitting colors of LEDs are made to correspond to full color with a pulse width modulation drive. However, since at least three LEDs are required for each segment, LEDs in number three times or more the number of pixels are required in the case of VGA display. Further, segment driver circuits are required for the corresponding segments. Thus, there has been a problem in that a price is relatively high, which is disadvantage from a practical standpoint.

Further, since at least three LEDs are required for each segment, the size corresponding to three LEDs is defined as the lower limit of a pixel size. Thus, there has been a problem in that reduction of a display area is difficult to be attained.

Further, since full-color gradation control depends on the pulse width modulation drive, the control has to be performed to both the colors of LEDs themselves and the colors that are not originally provided to the LEDs themselves. The structure of the controller Q2 is complicated. Thus, there has been a problem in that color management cannot be performed easily.

Moreover, in the time-division color liquid crystal display apparatus and the driving method thereof in Conventional Example 3, the period from the start to the end of an optical response of liquid crystal is made to represent non-light emission, thereby realizing accurate color reproduction at the time of color switching. However, since only the three light sources for R, G, and B are still used, the characteristics of the light sources directly correspond to the characteristics of the image display apparatus similarly to Conventional Example 1. Thus, there has been a problem in that color management without the light sources is difficult to be conducted.

The present invention has been made to solve the above-described problems, and therefore has an object to provide a field sequential color image display apparatus which can easily display a full-color animation of VGA class and attains reduction in size of a liquid crystal driver circuit and a light source driver circuit for achievement of a low price and which facilitates full-color gradation control even in the case of using a small number of light sources.

Further, another object of the present invention is to provide a field sequential color image display apparatus which can easily display a full-color animation of VGA class and which facilitates full-color gradation control.

Furthermore, another object of the present invention is to provide a field sequential color image display apparatus that can realize desired color characteristics independently of light-source characteristics.

DISCLOSURE OF THE INVENTION

In order to achieve the above objects, a color image display apparatus according to an aspect of the present invention includes: a color separation circuit that separates image data for each color component to accumulate the image data; a shutter control circuit that slices the color component data, which has been subjected to color separation with the color separation circuit, in accordance with a slice level; a light source control circuit that controls a light source corresponding to the color component data in synchronization with the shutter control circuit; one or plural light sources that are turned on or off in accordance with an instruction from the light source control circuit; a converting device that converts an optical path of light from the light source; a shutter which makes light from a corresponding pixel pass therethrough and cuts off the light based on an instruction from the shutter control circuit and which is made of liquid crystal as a main material; and a timing circuit that generates operation timings for the color separation circuit, the shutter control circuit, and the light source control circuit, in which: the shutter control circuit transfers one line of slice data to the shutter sequentially on a slice level basis; the light source control circuit turns on the light source corresponding to the slice data; and the shutter makes the light from the light source, which corresponds to the slice data representing gradation of the corresponding pixel, pass therethrough and cuts off the light to display an image.

Also, the light source is comprised of plural point light sources corresponding to the color component data, and the converting device converts the point light sources to a surface light source.

Also, the shutter control circuit generates slice data based on a magnitude relationship between the color component data and the slice level, and the timing circuit varies a display time corresponding to each slice data for each slice data.

Also, the shutter control circuit generates slice data based on a magnitude relationship between the color component data and the slice level, and the timing circuit sequentially switches the color component data for each slice level, and generates a timing in performing color mixture on a slice level basis.

Also, the shutter control circuit varies a change order in one line period of the slice level which judges gradation of each pixel of the shutter, and generates the slice data based on a magnitude relationship between the color component data and the slice level.

Also, the light source control circuit varies a lighting voltage of the light source corresponding to the slice data in accordance with the slice data to turn the light source on.

Also, the shutter control circuit generates the slice data based on a magnitude relationship between the color component data and the slice level, the timing circuit varies a display time corresponding to each slice data for each slice data, and the light source control circuit performs gradation control in accordance with the light source lighting voltage and the display time corresponding to each slice data.

Also, the shutter control circuit: determines the slice data based on whether or not the color component data exists in a section sandwiched by two slice levels; generates a shutter drive voltage in accordance with the slice level; transfers one line of slice data to the shutter sequentially on a slice level basis; and drives the shutter with the shutter drive voltage.

Also, the timing circuit varies a display time corresponding to each slice data for each slice data, and the light source control circuit performs gradation control in accordance with the shutter drive voltage and the display time corresponding to each slice data.

Also, the shutter control circuit transfers one line of slice data on a color component basis to the shutter sequentially on a slice level basis, the light source control circuit turns the light source corresponding to the slice data on, and the shutter makes the light from the light source, which corresponds to the slice data representing gradation of the corresponding pixel, pass therethrough and cuts off the light to display an image.

Also, the timing circuit varies a display time corresponding to each slice data for each slice data.

Also, the shutter control circuit outputs slice data for plural dummy lines other than the line that can be displayed with the shutter, and a common output of the shutter control circuit corresponding to the dummy lines is not connected with a common electrode of the shutter.

Also, the dummy lines appear at a timing of the switch of the line of the image data.

Also, the dummy lines appear at a timing of the change of the color component of the image data.

Further, a color image display apparatus according to another aspect of the present invention includes: a color separation circuit that separates image data for each color component to accumulate the image data; a shutter control circuit that slices the color component data, which has been subjected to color separation with the color separation circuit, in accordance with a slice level; a light source control circuit that controls a light source corresponding to the color component data in synchronization with the shutter control circuit; one or plural light sources that are turned on or off in accordance with an instruction from the light source control circuit; a converting device that converts an optical path of light from the light source; a shutter which makes light of a corresponding pixel pass therethrough and cuts off the light based on an instruction from the shutter control circuit and which is made of liquid crystal as a main material; and a timing circuit that generates operation timings for the color separation circuit, the shutter control circuit, and the light source control circuit, in which: the color separation circuit separates the image data into four color components including achromatic color components and chromatic color components; the light sources are light sources for light emitting colors corresponding to the chromatic color components; the shutter control circuit transfers one line of slice data to the shutter sequentially on a slice level basis; the light source control circuit uses mixed color light that is obtained by lighting the light sources for all the light emitting colors corresponding to the chromatic color components with respect to the slice data corresponding to the achromatic color components, and uses monochromatic lights corresponding to the respective chromatic color components with respect to the slice data corresponding to the chromatic color components; and the shutter makes the light from the light source, which corresponds to the slice data representing gradation of the corresponding pixel, pass therethrough and cuts off the light to display an image.

Also, the light source control circuit varies a light source voltage corresponding to each of the chromatic color components and a light source voltage corresponding to each of the achromatic color components.

Also, the light source corresponding to the achromatic color components is a white light source.

Further, a color image display apparatus according to another aspect of the present invention includes: a color separation circuit that separates image data for each color component to accumulate the image data; a shutter control circuit that slices the color component data, which has been subjected to color separation with the color separation circuit, in accordance with a slice level; a light source control circuit that controls a light source corresponding to the color component data in synchronization with the shutter control circuit; one or plural light sources that are turned on or off in accordance with an instruction from the light source control circuit; a converting device that converts an optical path of light from the light source; a shutter which makes light of a corresponding pixel pass therethrough and cuts off the light based on an instruction from the shutter control circuit and which is made of liquid crystal as a main material; and a timing circuit that generates operation timings for the color separation circuit, the shutter control circuit, and the light source control circuit, in which: the color separation circuit separates the image data into seven color components including achromatic color components, primary color components, and complementary color components; the light sources are light sources for light emitting colors corresponding to the primary color components; the shutter control circuit transfers one line of slice data to the shutter sequentially on a slice level basis; the light source control circuit uses mixed color light that is obtained by lighting the light sources for all the light emitting colors corresponding to the primary color components with respect to the slice data corresponding to the achromatic color components, uses mixed color lights of two primary color lights corresponding to the respective complementary color components with respect to the slice data corresponding to the complementary color components, and uses primary color lights corresponding to the respective primary color components with respect to the slice data corresponding to the primary color components; and the shutter makes the light from the light source, which corresponds to the slice data representing gradation of the corresponding pixel, pass therethrough and cuts off the light to display an image.

Also, the light source control circuit varies a light source voltage corresponding to each of the primary color components, a light source voltage corresponding to each of the complementary color components, and a light source voltage corresponding to each of the achromatic color components.

Further, a color image display apparatus according to another aspect of the present invention includes: a color separation circuit that separates image data for each color component to accumulate the image data; a shutter control circuit that slices the color component data, which has been subjected to color separation with the color separation circuit, in accordance with a slice level; a light source control circuit that controls a light source corresponding to the color component data in synchronization with the shutter control circuit; one or plural light sources that are turned on or off in accordance with an instruction from the light source control circuit; a converting device that converts an optical path of light from the light source; a shutter which makes light of a corresponding pixel pass therethrough and cuts off the light based on an instruction from the shutter control circuit and which is made of liquid crystal as a main material; and a timing circuit that generates operation timings for the color separation circuit, the shutter control circuit, and the light source control circuit, in which: the color separation circuit separates the image data into four color components including specific color components and primary color components not containing the specific color components; the light sources are light sources for light emitting colors corresponding to the primary color components and for light emitting colors corresponding to the specific color components; the shutter control circuit transfers one line of slice data to the shutter sequentially on a slice level basis; the light source control circuit uses lights obtained by lighting the light sources corresponding to the specific color components with respect to the slice data corresponding to the specific color components, and uses primary color lights corresponding to the respective primary color components with respect to the slice data corresponding to the primary color components except the specific color components; and the shutter makes the light from the light source, which corresponds to the slice data representing gradation of the corresponding pixel, pass therethrough and cuts off the light to display an image.

Also, plural specific color components and corresponding plural specific color light sources are used for the light sources.

Further, a color image display apparatus according to another aspect of the present invention includes: a color separation circuit that separates image data for each color component to accumulate the image data; a shutter control circuit that slices the color component data, which has been subjected to color separation with the color separation circuit, in accordance with a slice level; a light source control circuit that controls a light source corresponding to the color component data in synchronization with the shutter control circuit; one or plural light sources that are turned on or off in accordance with an instruction from the light source control circuit; a converting device that converts an optical path of light from the light source; a shutter which makes light of a corresponding pixel pass therethrough and cuts off the light based on an instruction from the shutter control circuit and which is made of liquid crystal as a main material; and a timing circuit that generates operation timings for the color separation circuit, the shutter control circuit, and the light source control circuit, in which: the shutter is divided into at least one sub-shutter; the shutter control circuit transfers slice data corresponding to a sub-shutter region among pixels for one line to the sub-shutter sequentially on a slice level basis; and the sub-shutter makes the light from the light source, which corresponds to the slice data representing gradation of the corresponding pixel, pass therethrough and cuts off the light to display an image.

Also, the sub-shutter is structured in a physically continuous space.

Also, the sub-shutter is structured in a physically discontinuous space.

Also, the shutter control circuit varies an order of scanning an electrode in the sub-shutter for each sub-shutter.

Further, a color image display apparatus according to another aspect of the present invention includes: a color separation circuit that separates image data for each color component to accumulate the image data; a shutter control circuit that slices the color component data, which has been subjected to color separation with the color separation circuit, in accordance with a slice level; a light source control circuit that controls a light source corresponding to the color component data in synchronization with the shutter control circuit; one or plural light sources that are turned on or off in accordance with an instruction from the light source control circuit; a converting device that converts an optical path of light from the light source; a shutter which makes light of a corresponding pixel pass therethrough and cuts off the light based on an instruction from the shutter control circuit and which is made of liquid crystal as a main material; and a timing circuit that generates operation timings for the color separation circuit, the shutter control circuit, and the light source control circuit, in which: the color separation circuit separates the image data into plural color components; and the shutter control circuit performs gradation control for each color component on a slice level basis in a color engineering manner.

Also, the color separation circuit separates the image data into image data for achromatic color components and image data for chromatic color components; and the apparatus further comprises a compensator, which accumulates inverse-characteristics data that compensates for color characteristics with respect to image data of R=G=B measured in advance, and reflects the inverse-characteristics data corresponding to a value of the achromatic color components in the chromatic color components to thereby perform color mixture of the characteristics of the achromatic color components and the inverse characteristics corresponding to the value of the achromatic color components.

Also, the color mixture of the color characteristics with respect to image data of R=G=B measured in advance and the inverse characteristics produces an achromatic color in a color engineering manner.

Also, the color separation circuit separates the image data into image data for achromatic color components and image data for chromatic color components; and the timing circuit always lights the light sources corresponding to the chromatic color components in a slice data period corresponding to the chromatic color components, and varies a lighting period of the light sources such that a reproduction color at each slice level becomes an achromatic color in a color engineering manner in a slice data period corresponding to the achromatic color components.

Also, the color separation circuit separates the image data into image data for achromatic color components and image data for chromatic color components; and the timing circuit equalizes a display time for each slice level in a slice data period corresponding to the chromatic color components, and varies the display time for each slice level such that a reproduction color shows desired characteristics in a slice data period corresponding to the achromatic color components.

Also, the color separation circuit separates the image data into image data for achromatic color components and image data for chromatic color components; and the timing circuit always lights the light sources corresponding to the chromatic color components and equalizes a display time for each slice level in a slice data period corresponding to the chromatic color components, and varies a lighting period of the light sources such that a reproduction color at each slice level becomes an achromatic color in a color engineering manner and varies the display time for each slice level such that the reproduction color shows desired characteristics in a slice data period corresponding to the achromatic color components.

Also, the color separation circuit separates the image data into image data for achromatic color components and image data for chromatic color components; and the timing circuit varies a display time for each slice level such that a reproduction color shows desired characteristics in a slice data period corresponding to the chromatic color components, and equalizes the display time for each slice level in a slice data period corresponding to the achromatic color components.

Also, the color separation circuit separates the image data into image data for achromatic color components and image data for chromatic color components; and the timing circuit always lights the light sources corresponding to the chromatic color components and varies a display time for each slice level such that a reproduction color shows desired characteristics in a slice data period corresponding to the chromatic color components, and varies a lighting period of the light sources such that the reproduction color at each slice level becomes an achromatic color in a color engineering manner and varies the display time for each slice level such that the reproduction color shows desired characteristics in a slice data period corresponding to the achromatic color components.

BEST MODES FOR CARRYING OUT THE INVENTION

First Embodiment

Figure 1:
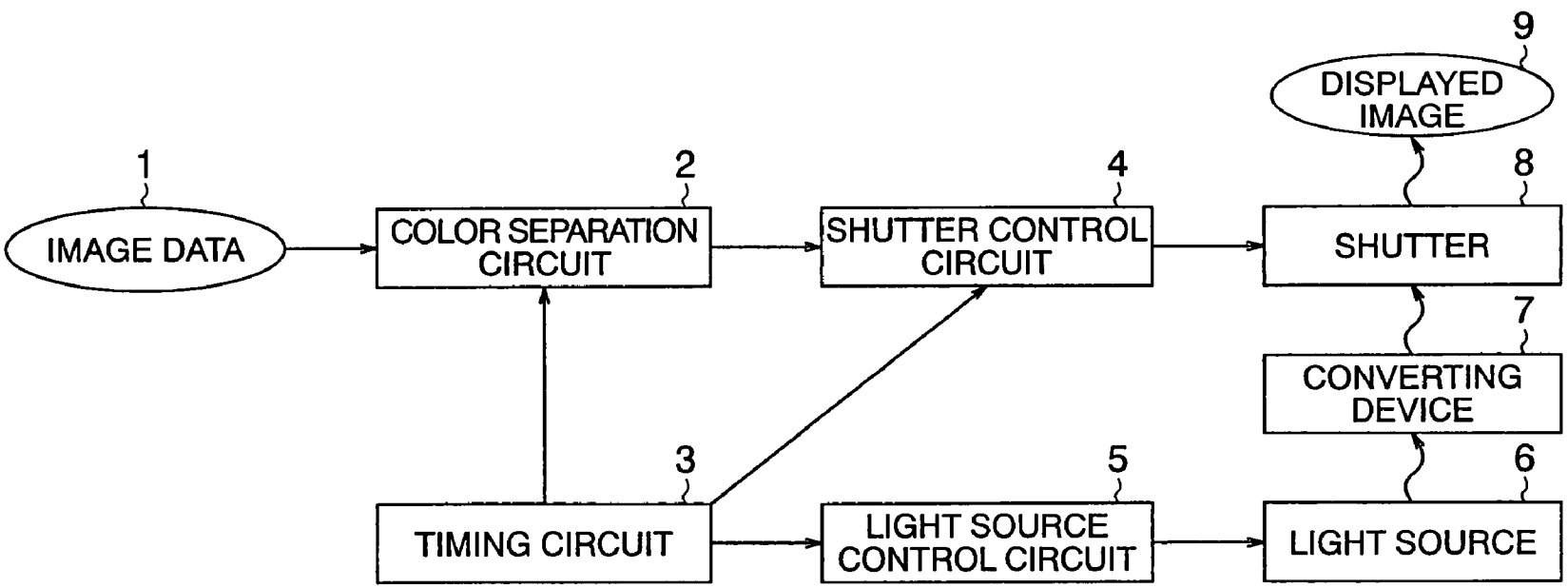
FIG. 1 is a block diagram showing a first embodiment of the present invention.

FIG. 1 is a block diagram showing a first embodiment of the present invention. In FIG. 1, reference numeral 1 denotes digital color image data, reference numeral 2 denotes a color separation circuit for separating/accumulating the digital image data 1 on a subfield basis, reference numeral 3 denotes a timing circuit for generating various timings, reference numeral 4 denotes a shutter control circuit for controlling a shutter 8 described below, reference numeral 5 denotes a light source control circuit for controlling a light source 6 described below, reference numeral 6 denotes the light source for generating lights of plural colors, reference numeral 7 denotes a converting device for changing an optical path of the light from the light source 6, reference numeral 8 denotes a shutter for cutting off the light emitted from the light source 6 and passing through the converting device 7, and reference numeral 9 denotes a displayed display image.

Next, an operation of each block portion will be described. First, regarding the digital color image data 1, three cases are conceivable, which includes a case of inputting the color image data corresponding to RGB in a dot sequential manner as in the order of RGBRGB, a case of inputting it in a line sequential manner as in the order of R1-st line, G1-st line, B1-st line, R2-nd line, G2-nd line, and B2-nd line, and a case of inputting it in a field sequential manner as in the order of R1 field, G1 field, and B1 field. The input order of the digital color image data 1 has a close relationship with a configuration of the color separation circuit 2 described next.

Figure 2:
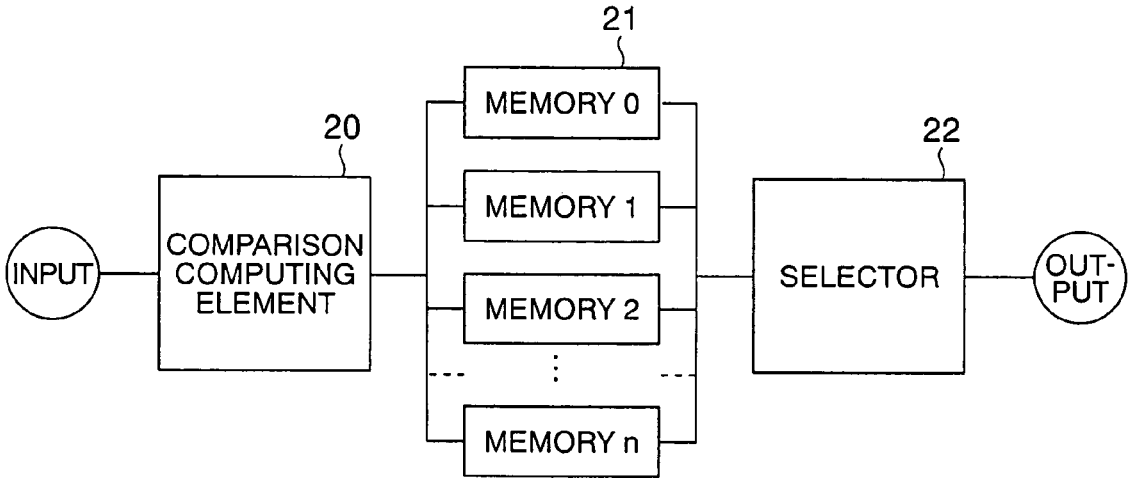
FIG. 2 is a block diagram showing a structure of a general color separation circuit 2.

Subsequently, the color separation circuit 2 will be described. The color separation circuit 2 is a circuit for separating/accumulating the image data 1 on a subfield basis. Thus, the configuration thereof changes depending on the input order of the digital color image data 1. FIG. 2 shows a general configuration of the color separation circuit 2. In FIG. 2, reference numeral 20 denotes a comparison computing element for accumulating in a corresponding memory 21 the data calculated based on a signal specifying which color component of the subfield corresponds to the digital image data 1 at the present time generated from the timing circuit 3.

As an example thereof, here, a case of separation into the three subfields of R, G, and B will be described. In the case of field sequential data, the inputted data corresponding to one field is accumulated in the corresponding memory 21 on a field basis. In the case of line sequential data, the inputted data corresponding to one line is switchingly accumulated in the memory 21 for each line. In the case of dot sequential data, the inputted data corresponding to one pixel is switchingly accumulated in the memory 21 for each pixel.

The memory 21 is a memory capable of accumulating the color component data corresponding to one filed and the number of memories to be prepared conforms to that of color components to be accumulated. In the first embodiment, since the three color components of R, G, and B are provided, there are provided the three memories 21 assuming that n=2. Reference numeral 22 denotes a selector for selecting and outputting the color component data accumulated in the memory 21 in accordance with a processing timing of the shutter control circuit 4. The processing timing of the shutter control circuit 4 can be defined using the signal generated from the timing circuit 3.

Figure 3:
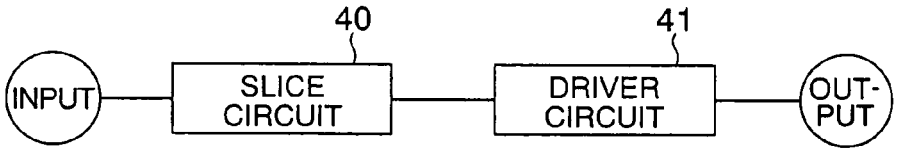
FIG. 3 is a block diagram showing a structure of a shutter control circuit 4 in accordance with the first embodiment of the present invention.

Next, the shutter control circuit 4 will be described. The shutter control circuit 4 separates the (multi-valued) color component data corresponding to one field outputted from the color separation circuit 2 into (binary) slice data, and based on the slice data, the shutter 8 is controlled. That is, FIG. 3 is a block diagram showing the shutter control circuit 4. In FIG. 3, reference numeral 40 denotes a slice circuit. The slice circuit 40 outputs the binary slice data, with which the inputted color component data corresponding to one field is regarded as OFF slice data at a certain slice level Level n or lower and otherwise as ON slice data. The value of the Level n varies depending on the signal from the timing circuit 3. As a result, the color component data corresponding to one field is divided into the plural slice data and outputted.

Figure 4:
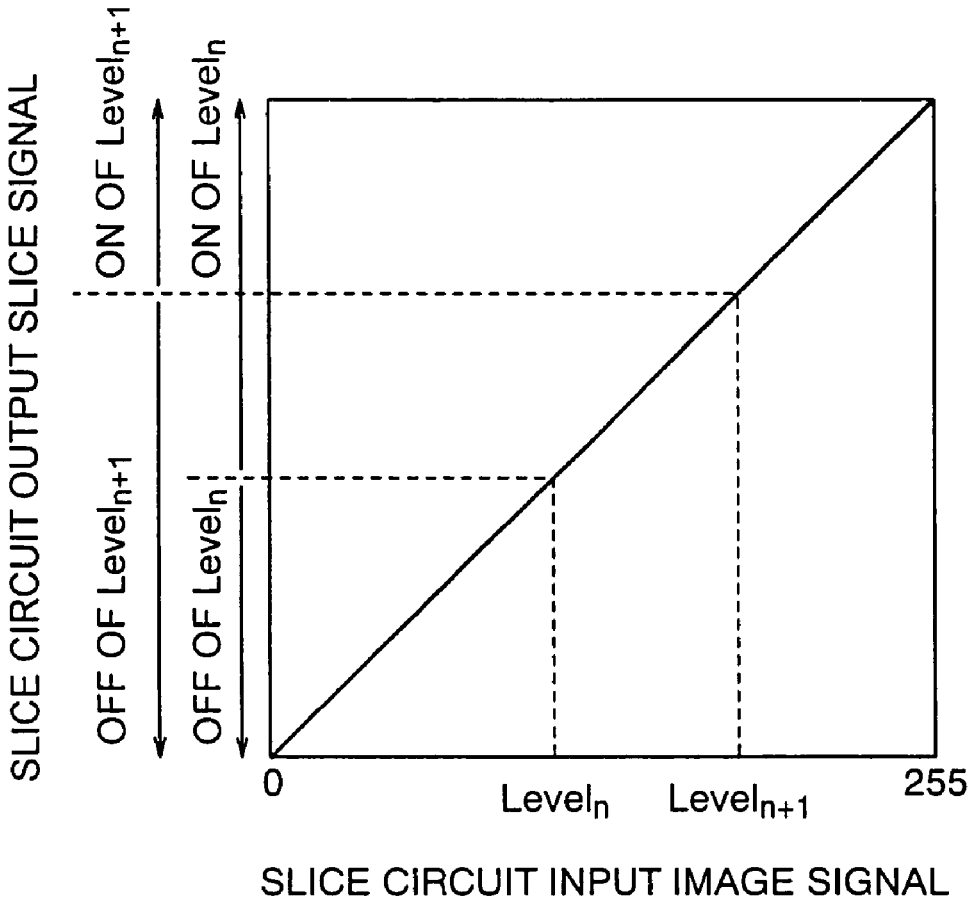
FIG. 4 is a diagram of a relationship between an input image signal and an output slice signal of a slice circuit 40.

A concept thereof is shown in FIG. 4. A signal value inputted into the slice circuit 40 from the color separation circuit 2 supposedly takes a value ranging from 0 to 255 as shown in FIG. 4. When the slice level Level n is set based on the signal from the timing circuit 3, in the case where the signal at a level of 0 to less than the Level n is inputted, the OFF slice data is outputted, whereas in the case where the signal at a level of the Level n or more to 255 is inputted, the ON slice data is outputted. When based on the signal from the timing circuit 3, the above setting is changed to Level n+1, in the case where the signal at a level of 0 to less than Level n+1 is inputted, the OFF slice data is outputted, whereas in the case where the signal at a level of Level n+1 or more to 255 is inputted, the ON slice data is outputted.

Also, in FIG. 3, reference numeral 41 denotes a driver circuit. This circuit is used for ON/OFF control of the shutter 8 based on the ON/OFF state of the slice data. This circuit is used for voltage level conversion required for driving the shutter 8 and AC conversion.

Figure 5:
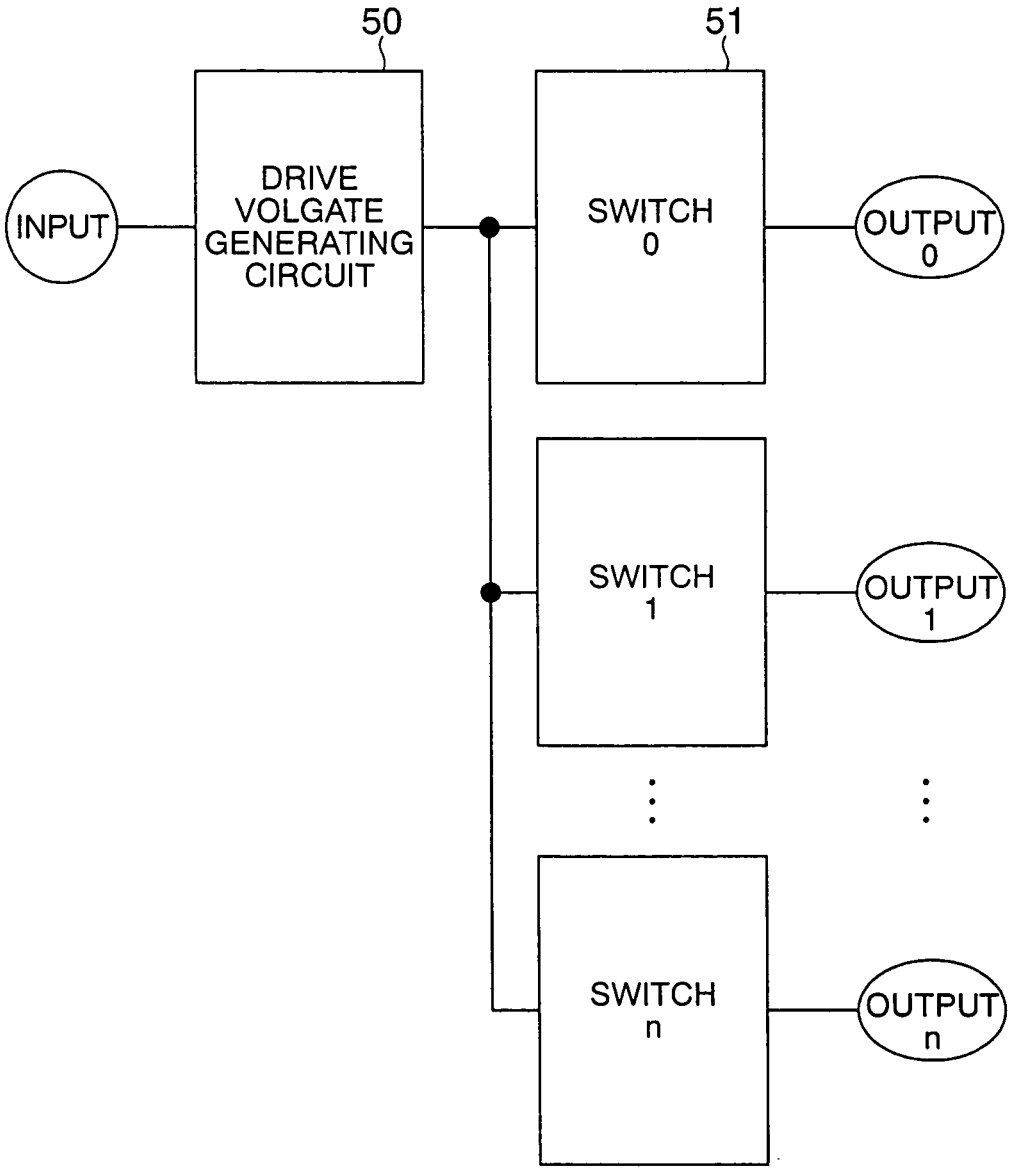
FIG. 5 is a block diagram showing a structure of a light source control circuit 5.

Next, the light source control circuit 5 will be described. The light source control circuit 5 is composed of a drive voltage generating circuit 50 and a switch 51 shown in FIG. 5. The power source used in the drive voltage generating circuit 50 is inputted to an input thereof. The drive voltage generating circuit 50 converts a power source voltage to a light source drive voltage as necessary. Based on the signal from the timing generating circuit 3, the switch 51 is used to turn ON/OFF the drive voltage of the corresponding light source 6. In the first embodiment, the digital image data 1 is separated into the three color component data of R, G, and B, so that the three switches 51 are provided assuming that n=2.

Also, the switch 51 operates as follows. During a section for which the R component data is outputted from the color separation circuit 2 to drive the shutter through the shutter control circuit 4, the switch for driving the R light source is turned ON and the other switches are turned OFF. In the case of the G component data, the switch for driving the G light source is turned ON and the other switches are turned OFF. In the case of the B component data, the switch for driving the B light source is turned ON and the other switches are turned OFF.

Figure 6:
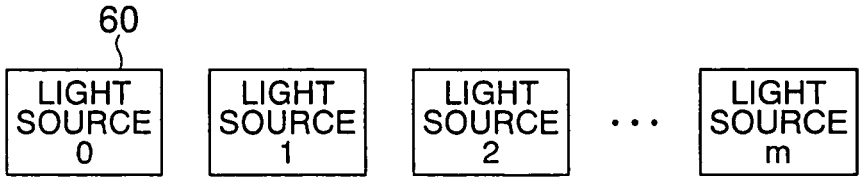
FIG. 6 is an explanatory diagram of light sources 60 for m colors.

As shown in FIG. 6, the light source 6 is composed of light sources 60 in m colors. In the first embodiment, the light source is composed of the light sources 60 in m colors, m conforming to n that defines the number of color component data. That is, the light sources in three colors are used assuming that n=m=2. Also, the light sources 60 are assumed as point light sources. A light emission wavelength of the light source 60 in any range can be adopted as long as the wavelength falls within the wavelength region corresponding to the color component data.

Figure 7:
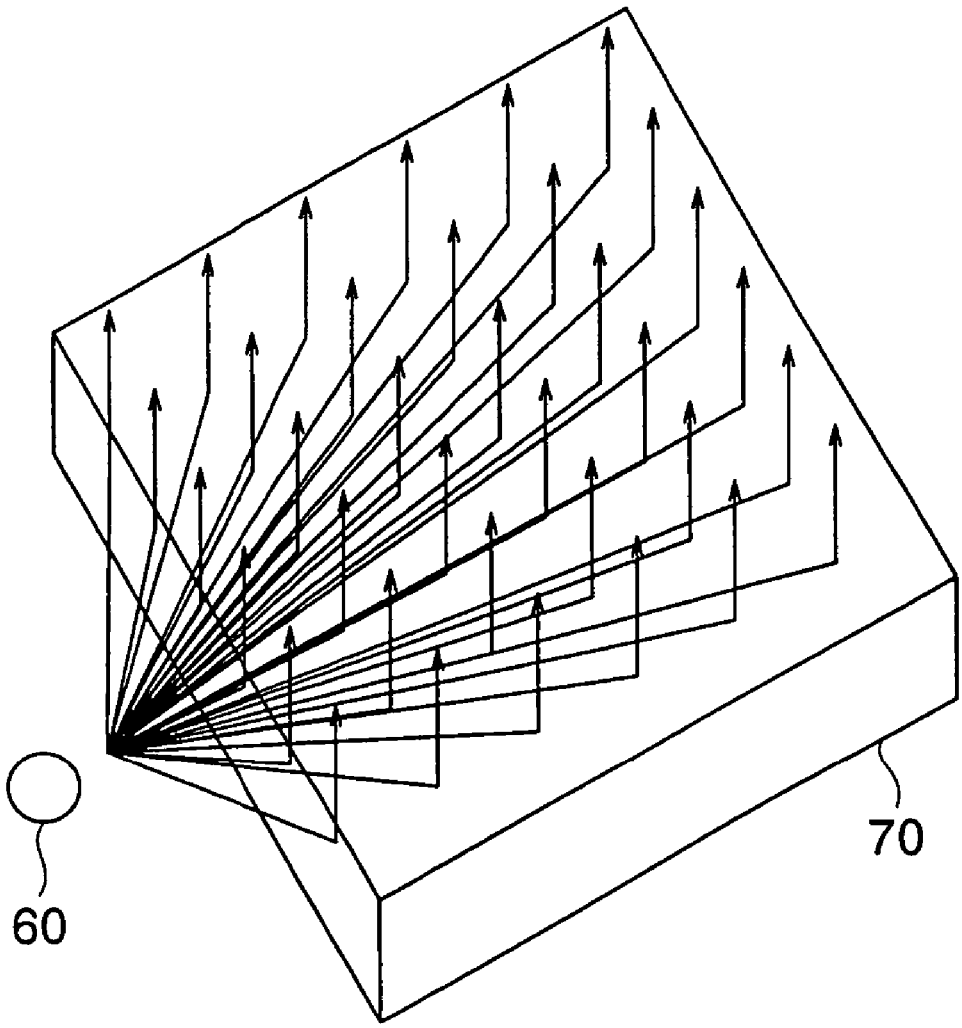
FIG. 7 is an explanatory diagram of a converting device 7.

Next, a description will be given of the converting device 7 with reference to FIG. 7. In FIG. 7, reference numeral 60 denotes the point light source described as the light source 6. Reference numeral 70 denotes a point-surface converting device for converting the point light source to a surface light source. The point-surface converting device 70 is manufactured by using acrylic resin as a material therefor and changing a reflectivity of a plate-like device within the plate or stacking thin plates stepwise.

Figure 8:
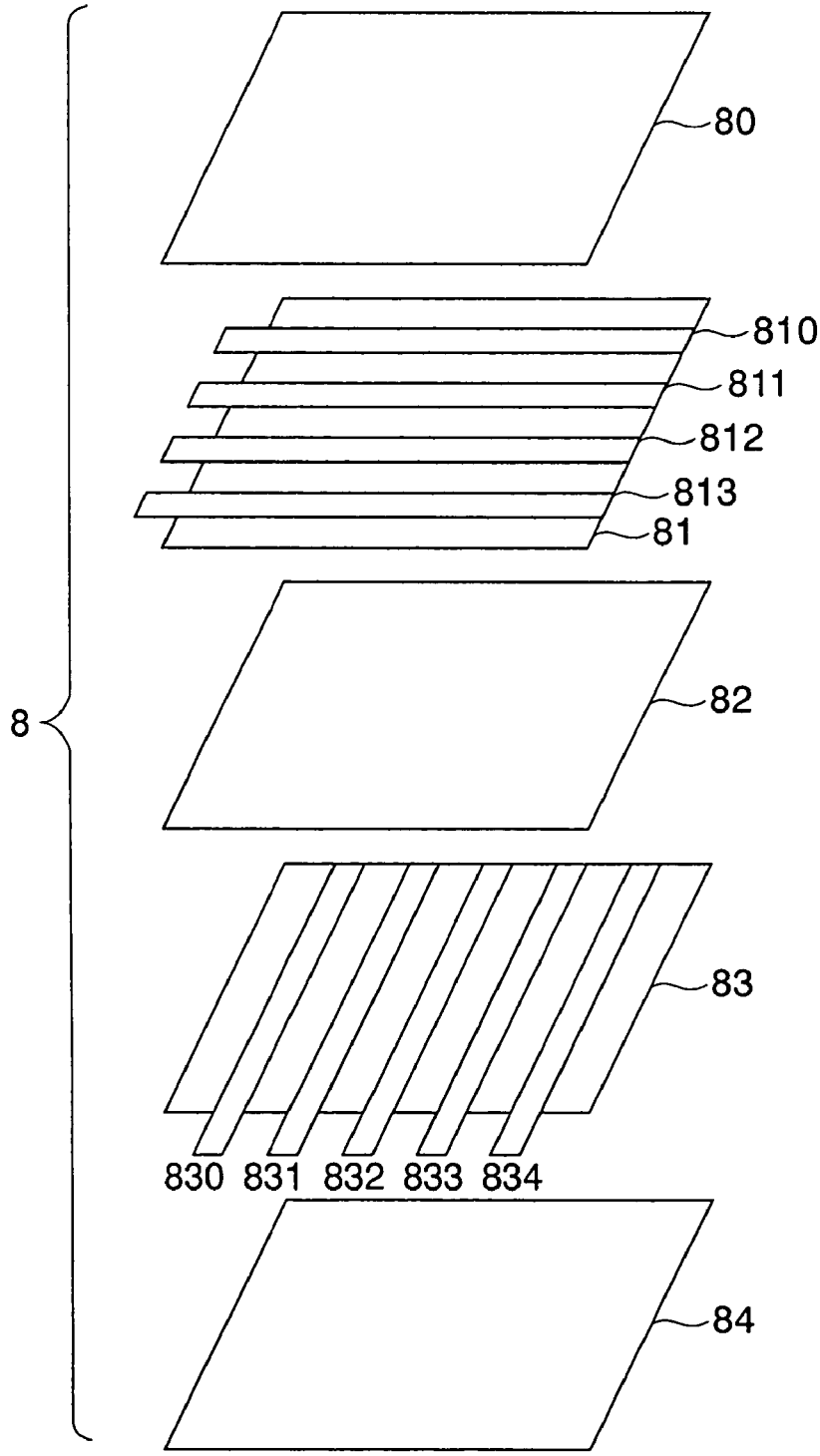
FIG. 8 is an explanatory diagram of a shutter 8.

Subsequently, a description will be given of the shutter 8 with reference to FIG. 8. The shutter 8 takes a laminate structure. In FIG. 8, a polarizing plate A layer 80, a common electrode layer 81, a liquid crystal layer 82, a segment electrode layer 83, and a polarization B layer 84 are laminated in this order from the top. Although not shown in the figure, they are laminated on a hard plate such as glass serving as a substrate.

The polarizing plate A layer 80 and the polarization B layer 84 are laminated so as to be orthogonal or parallel to each other to form the polarization planes. The common electrode layer 81 and the segment electrode layer 83 are transparent electrodes orthogonal to each other and an intersecting point thereof serves as a display pixel. In the figure, twenty pixels of four rows of the common electrodes and five columns of the segment electrodes can be displayed. The segment-common voltage is turned ON/OFF with a phase transition voltage of liquid crystal interposed therebetween, so that the phase transition of the liquid crystal corresponding to the pixel occurs and the light passing through the polarizing plate A layer 80, the liquid crystal layer 82, and the polarization B layer 84 is made to pass therethrough/be cut off.

As described above, information on the image data 1 is sent to the shutter 8 through the color separation circuit 2 and the shutter control circuit 4 as well as the light from the light source 8 is converted to the surface light source light through the converting device 7 and an R light, a G light, and a B light are irradiated to the shutter 8. Thus, the image data 1 is displayed as a color display image 9 in a filterless manner.

Figure 9:
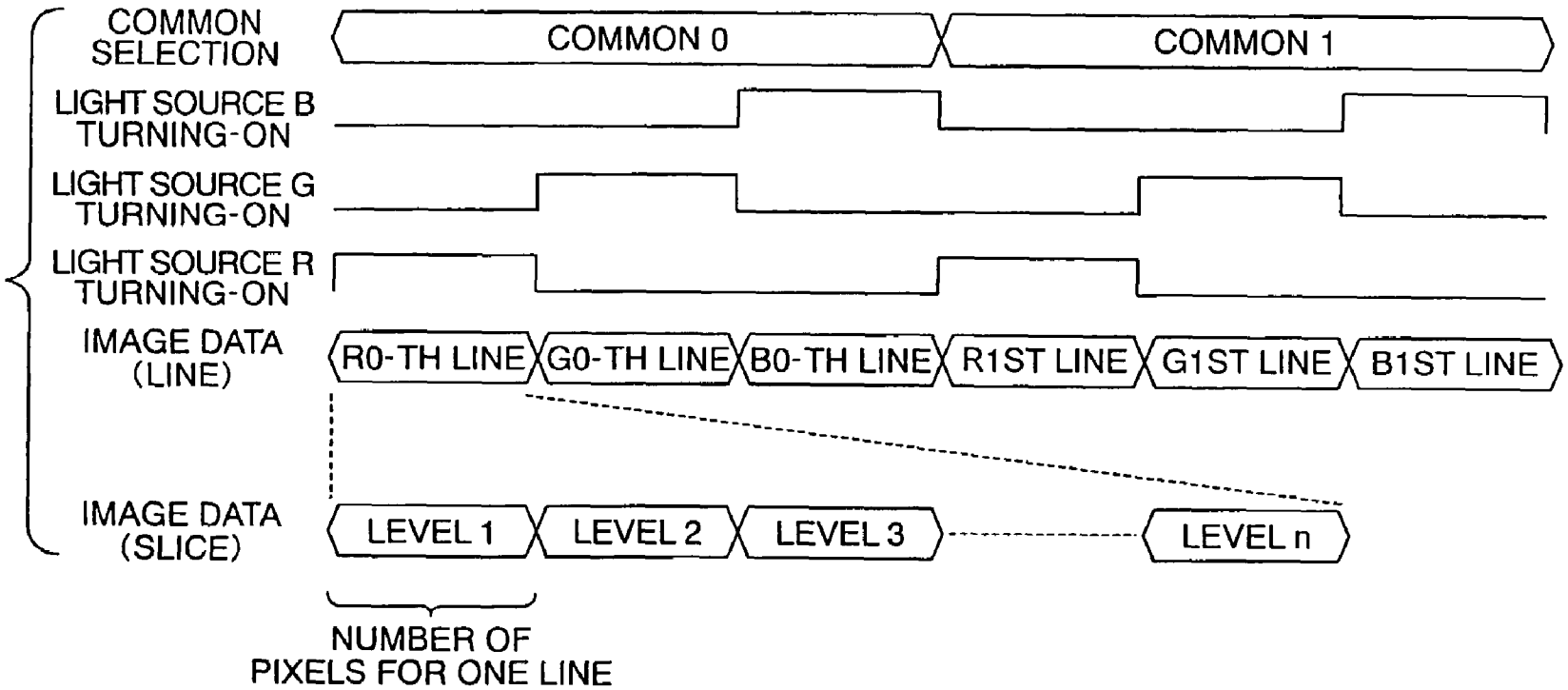
FIG. 9 is an operation timing chart of gradation control in accordance with the first embodiment of the present invention.

Next, gradation control will be described with reference to whole operation timings. FIG. 9 is a general timing chart of the first embodiment. This timing is generated by the timing circuit 3, which corresponds to a timing at which each block is operated. In response to an instruction from the timing circuit 3, while the data in 0th line is outputted from the color separation circuit 2 (in the figure, while the image data in the R0-th line, G0-th line, and B0-th line is used), a common 0 is selected in the common electrode. To explain it using FIG. 8, a common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R0-th line is outputted from the color separation circuit 2, the point light source R is lighted. When the data in the G0-th line is outputted, the point light source G is lighted. When the data in the B0-th line is outputted, the point light source B is lighted.

The image data (line) is separated into the slice data by the shutter control circuit 4 in response to the instruction from the timing circuit 3 and sent to the segment electrode layer 83 of the shutter 8. In FIG. 9, the data of level 1 to the data of level n are sent to the driver circuit 41 from the slice circuit 40 on a line basis. That is, the data in the R0-th line sliced at the level 1 is set as the slice data based on the level 1 and the obtained slice data corresponding to one line is sent. Following this, the data in the R0-th line sliced at level 2 is set as the slice data based on the level 2 and the obtained slice data corresponding to one line is sent. Sequentially, the slice data is sent up to the level n.

Accordingly, regarding the data in the R0-th line, the slice data corresponding to one line is sent n times. Based on ON/OFF information of each level, only the pixel on the common electrode 810 reflects the data of the segment electrode layer 83 and the light is made to pass therethrough/be cut off. The slice data represents the ON/OFF information based on the Level n, so that when the control of the whole operation is performed based on the timings of FIG. 9, the light passes therethrough at the level lower than the image data value and is cut off at the level equal to or higher than the image data value. The light is controlled which reflects the gradation of the color component data of the image data.

After the completion of processing of the data in the R0-th line, the data in the G0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Next, the data in the B0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source B is made to pass therethrough/be cut off.

After the completion of processing of the data in the 0th line, the data in the first line is outputted from the color separation circuit 2 in response to the instruction from the timing circuit 3. A common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

As described above, in the first embodiment, the display time is fixed in each level but may be variable for each level. For example, a display time for the level n may be set as a time n and a display time for the level n+1 may be set as a time n+1 ($n \neq n+1$).

The slice data sent to the driver circuit 41 is assumed to take the same slice level for each pixel in one line. However, provided that, during a time period for which the slice data is sent n times, all the slice levels are covered for each pixel, it is not required to use the same slice level in one line. For example, even pixels may change in slice level from the level 1 to the level n in this order, whereas odd pixels may change in slice level from the level n to the level 1.

Also, the light emission wavelength of the light source 60 is set so as to fall within the wavelength region corresponding to the color component data, but the light source in one color may be achieved by using the plural light sources. For example, the two light sources including the light source with a peak wavelength of 700 nm and the light source with a peak wavelength of 750 nm may be used to achieve the light source in one color corresponding to the R component.

Also, the liquid crystal used in the liquid crystal display panel 2 may be either active type liquid crystal or passive type liquid crystal. As specific examples of the liquid crystal, TFT type liquid crystal, STN type liquid crystal, and TN type liquid crystal can be given.

Also, when the function corresponding to the color separation circuit 2 is provided on a transfer source of the image data 1, it is possible to dispense with the color separation circuit 2.

As described above, in the first embodiment, the slice data according to the Level n is outputted from the shutter control circuit 4 and the shutter 8 makes the light pass therethrough/be cut off on a line basis, so that the full color image with the gradation can be reproduced.

Also, because of the control on a line basis, the number of pixel selection drivers can be reduced and a field sequential color image display apparatus can be provided at low cost.

Further, the slice data display time is made variable according to the slice level, so that the gradation control for each level is possible.

Also, since the light source 6 is converted from the point light source to the surface light source by the converting device 7, the number of light sources to be used can be made small. Further, the display pixel size can be increased irrespective of the number of light sources as well as the field sequential color image display apparatus can be provided at low cost.

Also, the order of changing the slice level is switched for each pixel and thus, a power applied to the shutter 8 can be dispersed, thereby achieving reduction in power consumption.

Second Embodiment

In the first embodiment as described above, as shown in FIG. 9, the ON/OFF state of the slice data is reflected on the slice data display time. Next, however, an embodiment will be described in which the ON/OFF state of the slice data is reflected on a lighting voltage of the light source 6.

The light source control circuit 5 of a second embodiment is one in which a shutter drive voltage varying function which reflects the slice level is added to the drive power source generating circuit 50.

Figure 10:
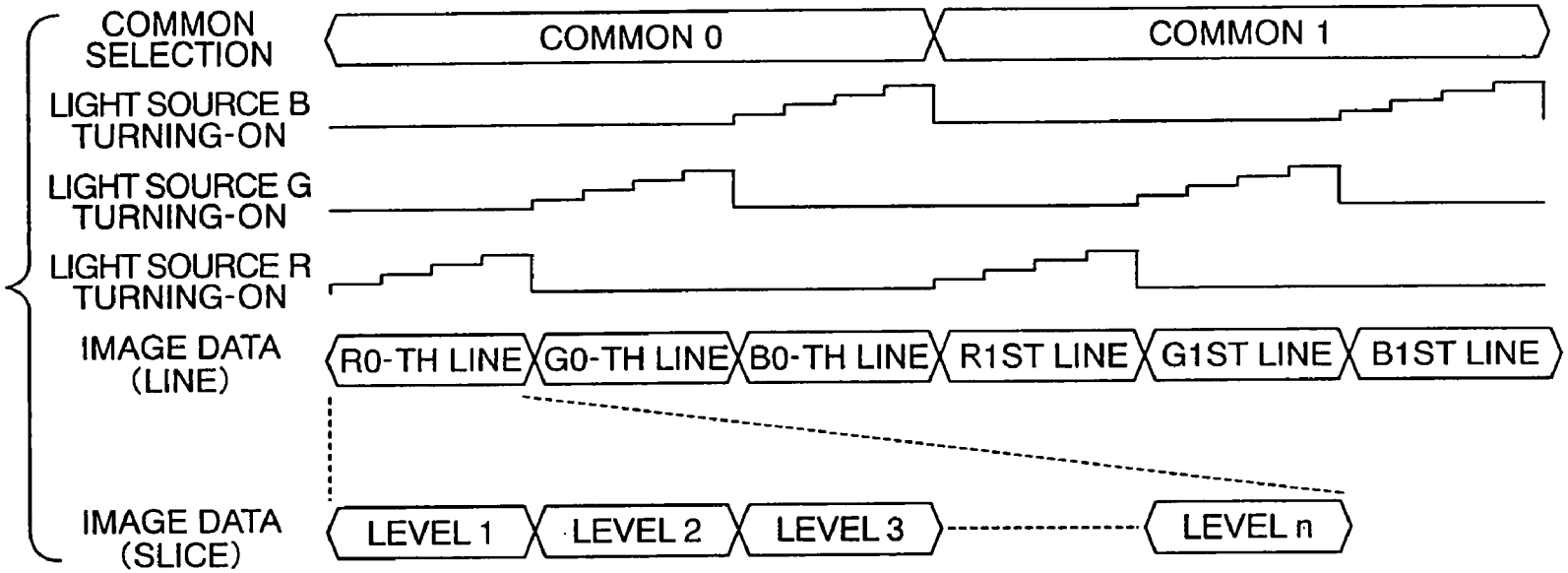
FIG. 10 is an operation timing chart of gradation control in accordance with a second embodiment of the present invention.

FIG. 10 is a general timing chart of the second embodiment. The timing is generated by the timing circuit 3, which corresponds to a timing at which each block is operated. In response to an instruction from the timing circuit 3, while the data in the 0th line is outputted from the color separation circuit 2 (in the figure, while the image data in the R0-th line, G0-th line, and B0-th line is used), the common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R0-th line is outputted from the color separation circuit 2, the point light source R is lighted. When the data in the G0-th line is outputted, the point light source G is lighted. When the data in the B0-th line is outputted, the point light source B is lighted. At this time, a voltage applied to the point light sources is set variable for each slice level value which reflects the level values of the slice data.

The image data (line) is separated into the slice data by the shutter control circuit 4 in response to the instruction from the timing circuit 3 and sent to the segment electrode layer 83 of the shutter 8. In FIG. 10, the data of level 1 to the data of level n are sent to the driver circuit 41 from the slice circuit 40 on a line basis. That is, the data in the R0-th line sliced at the level 1 is set as the slice data based on the level 1 and the obtained slice data corresponding to one line is sent. Following this, the data in the R0-th line sliced at the level 2 is set as the slice data based on the level 2 and the obtained slice data corresponding to one line is sent. Sequentially, the slice data is sent up to the level n. Accordingly, regarding the data in the R0-th line, the slice data corresponding to one line is sent n times. Based on the ON/OFF information of each level, only the pixel on the common electrode 810 reflects the data of the segment electrode layer 83 and the light is made to pass therethrough/be cut off. The slice data represents the ON/OFF information based on the Level n, so that when the control of the whole operation is performed based on the timings of FIG. 10, the light passes therethrough at the level lower than the image data value and is cut off at the level equal to or higher than the image data value. That is, the control of the light which reflects the gradation of the color component data of the image data 1, that is, the gradation control is performed. Further, the lighting voltage of the light source is set variable and the gradation control is performed based on a light quantity change.

In general, a certain amount of time is required to transfer the slice data to the segment electrode. Thus, even if the slice data display time is made variable, the control cannot be performed for the time equal to or shorter than that for transfer to the segment electrode. In such a case, the light source lighting voltage is set variable, so that the much finer gradation control is achieved. Also in the case of the time for transfer to the segment electrode or larger, the light quantity change caused by setting the light source lighting voltage variable makes it possible to perform gradation control in unit smaller than that for the display time control.

After the completion of processing of the data in the R0-th line, the data in the G0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Next, the data in the B0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source B is made to pass therethrough/be cut off.

After the completion of processing of the data in the 0th line, the data in the first line is outputted from the color separation circuit 2 in response to the instruction of the timing circuit 3. The common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where the display of one frame is completed. This operation is performed within a time period where an afterimage of human eyes is available to reproduce the full color image with the gradation. After the completion of the display of one frame, the subsequent frame is displayed and this operation is repeatedly performed to display an animation.

As described above, in the second embodiment, the slice data according to the Level n is outputted from the shutter control circuit 4 and the shutter 8 is used to make the light pass therethrough/be cut off on a line basis and at the same time, the light source lighting voltage is made variable according to the slice data. Thus, the field sequential color image display apparatus capable of finer gradation control can be provided.

Third Embodiment

In the first and second embodiments as described above, the ON/OFF state of the slice data is reflected on the slice data display time and the light source lighting voltage. Next, however, an embodiment will be described in which the ON/OFF state of the slice data is reflected on the drive voltage of the shutter 8.

Figure 11:
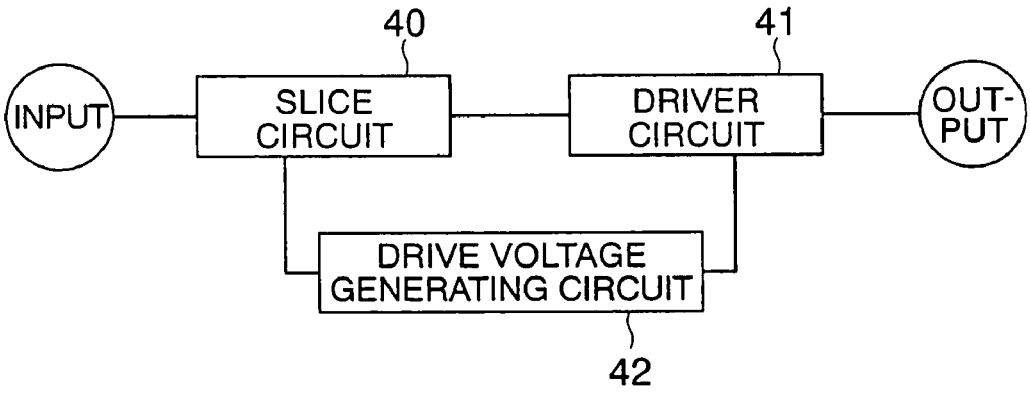
FIG. 11 is a block diagram showing a structure of a shutter control circuit 4 in accordance with a third embodiment of the present invention.

The shutter control circuit 4 in a third embodiment is shown in FIG. 11. Reference numeral 40 denotes the slice circuit. The slice circuit 40 outputs the binary slice data, with which the inputted color component data corresponding to one field is regarded as ON slice data when the data is at a level higher than a certain slice level (Level n) and equal to or lower than another slice level (Level n+1) and otherwise as OFF slice data. The values of the Level n and Level n+1 vary depending on the signal from the timing circuit 3. As a result, the color component data corresponding to one field is divided into the plural slice data and outputted. Reference numeral 41 denotes the driver circuit, which turns ON/OFF the shutter 8 based on the ON/OFF state of the slice data. Performed in this circuit are conversion of the voltage level (output level of the drive voltage generating circuit 42) required for driving the shutter 8 and AC conversion. The drive voltage generating circuit 42 generates the shutter drive voltage corresponding to the slice level and supplies it to the driver circuit 41.

Figure 12:
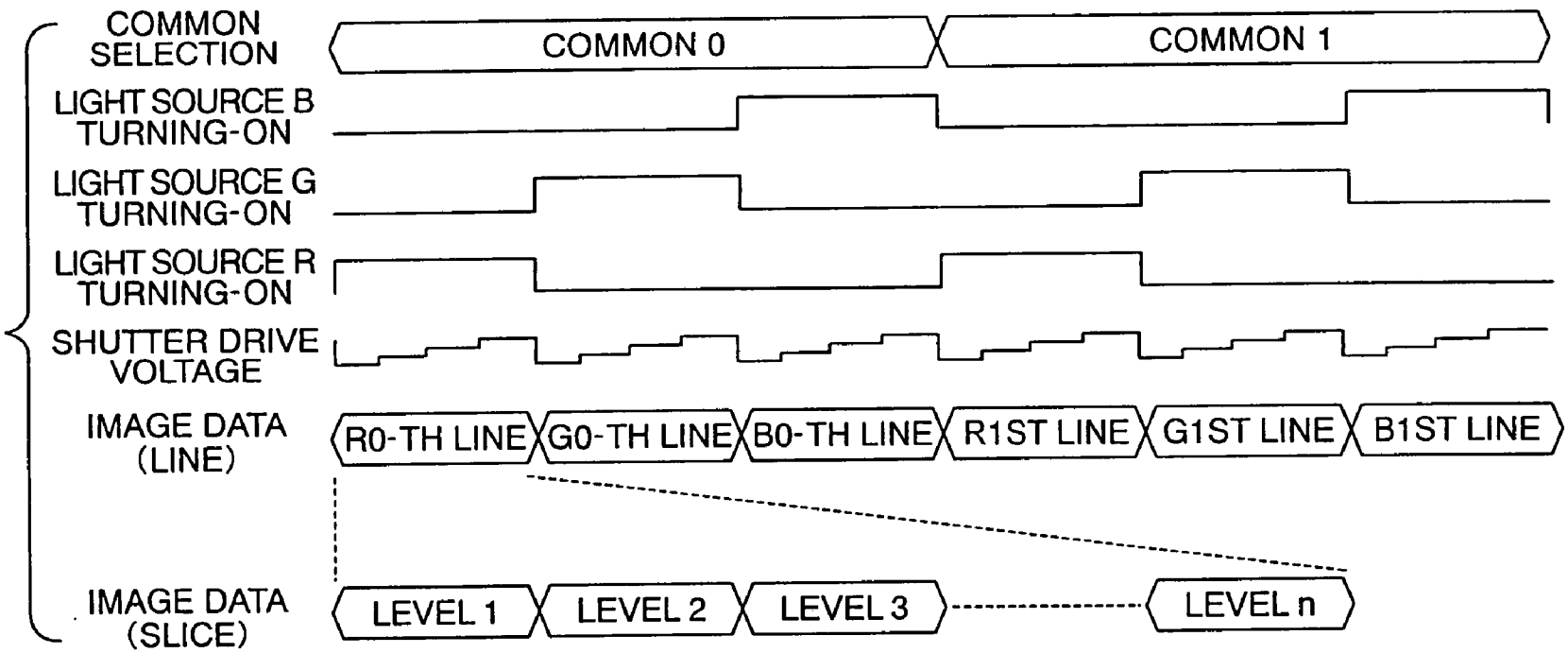
FIG. 12 is an operation timing chart of gradation control in accordance with the third embodiment of the present invention.

Next, the gradation control will be described with reference to whole operation timings. FIG. 12 is a general timing chart of the third embodiment. The timing is generated by the timing circuit 3, which corresponds to a timing at which each block is operated. In response to an instruction from the timing circuit 3, while the data in the 0th line is outputted from the color separation circuit 2 (in the figure, while the image data in the R0-th line, G0-th line, and B0-th line is used), the common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R0-th line is outputted from the color separation circuit 2, the point light source R is lighted. When the data in the G0-th line is outputted, the point light source G is lighted. When the data in the B0-th line is outputted, the point light source B is lighted.

Figure 13:
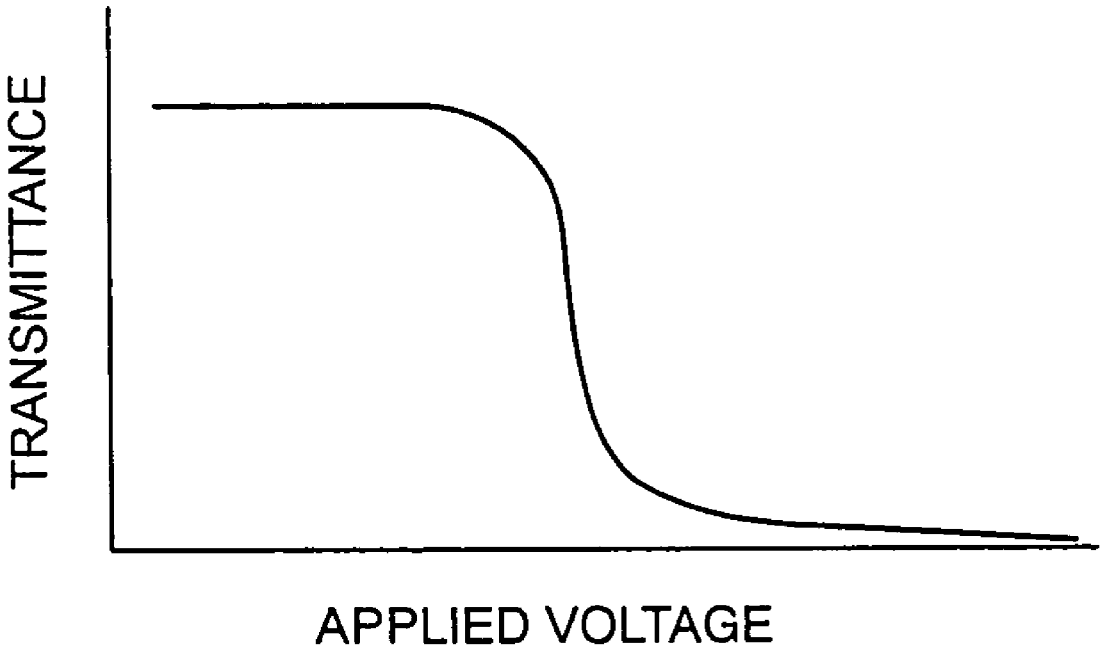
FIG. 13 is a diagram showing a variation characteristic of a transmittance of a shutter 8.

The image data (line) is separated into the slice data by the slice circuit 40 in response to the instruction from the timing circuit 3 and at the same time, the shutter drive voltage corresponding to the slice level is generated in the drive voltage generating circuit 42. The slice data and the shutter drive voltage are sent to the segment electrode layer 83 of the shutter 8. In the figure, the data of level 1 to the data of level n are sent. Based on the ON/OFF information of each level, only the pixel on the common electrode 810 reflects the data of the segment electrode layer 83 and the light is made to pass therethrough/be cut off. Here, the shutter drive voltage differs depending on the slice level and thus, the light transmittance in the shutter 8 varies. In general, the liquid crystal changes in phase transition rate depending on the applied voltage. Accordingly, the transmittance in the shutter 8 combined with the polarizing plate changes, for example, as shown in FIG. 13. By utilizing the above characteristics, the shutter drive voltage is changed to control the light. In this way, the shutter drive voltage change is used in combination with the display time change with respect to the slice data to achieve the gradation control in smaller unit.

The slice data in the third embodiment is regarded as ON slice data when the data is at a level higher than the Level n and equal to or lower than the Level n+1 and otherwise as OFF slice data. Thus, the slice data display time supposedly takes a time length proportional to the slice level. For example, at the slice level 1, the slice data display time length 1 is adopted and at the slice level 10, the slice data display time length 10 is adopted.

After the completion of processing of the data in the R0-th line, the data in the G0-th line is separated into the slice data by the slice circuit 40 in response to the instruction from the timing circuit 3 and at the same time, the shutter drive voltage corresponding to the slice level is generated in the drive voltage generating circuit 42. The slice data and the shutter drive voltage are sent to the segment electrode layer 83 of the shutter 8. Only the pixel on the common electrode 810 reflects the data of the segment electrode layer 83, so that the light from the point light source G is made to pass therethrough/be cut off. Next, the data in the B0-th line is separated into the slice data by the slice circuit 40 in response to the instruction from the timing circuit 3 and at the same time, the shutter drive voltage corresponding to the slice level is generated in the drive voltage generating circuit 42. The slice data and the shutter drive voltage are sent to the segment electrode layer 83 of the shutter 8. Only the pixel on the common electrode 810 reflects the data of the segment electrode layer 83, so that the light from the point light source B is made to pass therethrough/be cut off.

After the completion of processing of the data in the 0th line, the data in the first line is outputted from the color separation circuit 2 in response to the instruction from the timing circuit 3. The common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where the display of one frame is completed. This operation is performed within a time period where an afterimage of human eyes is available to reproduce the full color image with the gradation. After the completion of the display of one frame, the subsequent frame is displayed and this operation is repeatedly performed to display an animation.

As described above, in the third embodiment, the slice data at a level higher than the Level n and equal to or less than the Level n+1 and the shutter drive voltage corresponding to the slice level are sent to the shutter 8 by the shutter control circuit 4. Then, the transmittance is set variable at a finer level and the light is made to pass therethrough/be cut off on a line basis. Therefore, the field sequential color image display apparatus capable of the finer gradation control can be provided.

Fourth Embodiment

In the first, second, and third embodiments as described above, the ON/OFF state of the slice data is reflected on the slice data display time and the light source lighting voltage or the slice level is reflected on the shutter drive voltage. Next, however, an embodiment in which color mixture is performed for each slice level will be described.

Figure 14:
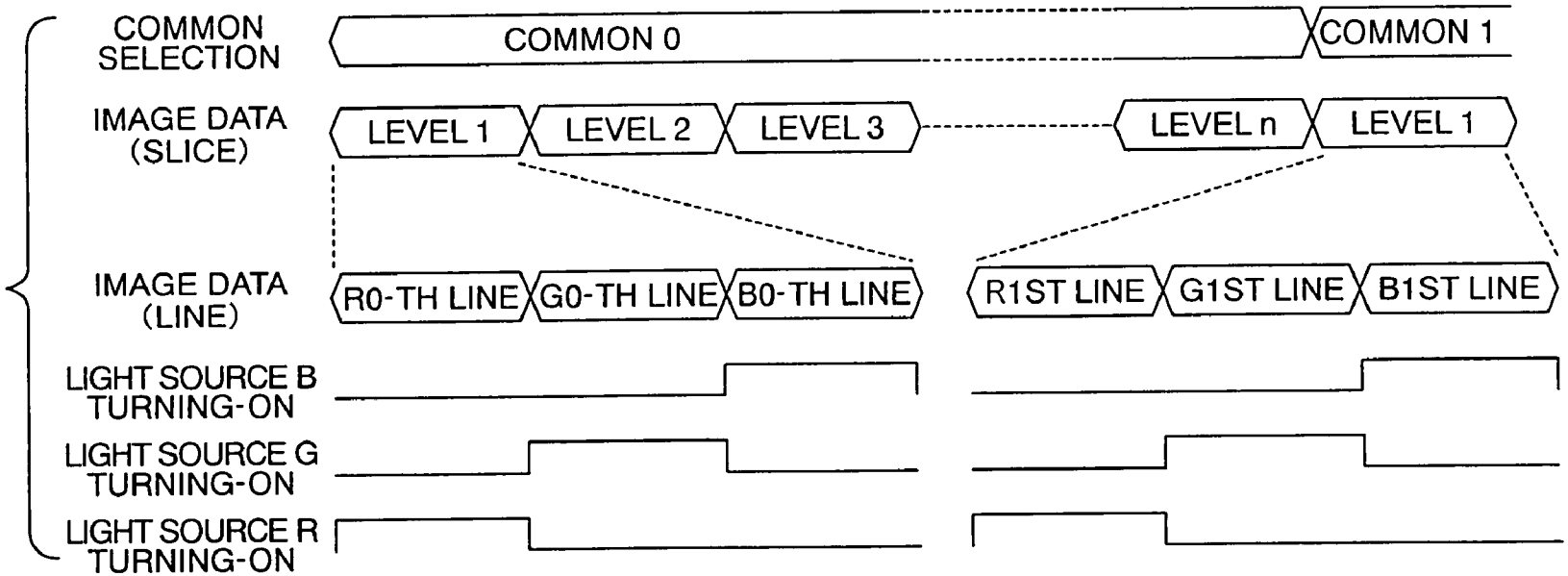
FIG. 14 is an operation timing chart of gradation control in accordance with a fourth embodiment of the present invention.

FIG. 14 is a general timing chart of a fourth embodiment. This timing is generated by the timing circuit 3, which corresponds to a timing at which each block is operated. In response to an instruction from the timing circuit 3, while the data in 0th line is outputted from the color separation circuit 2 (in the figure, while the data in the R0-th line, G0-th line, and B0-th line for the level 1 to the data in the R0-th line, G0-th line, and B0-th line for the level n are used), a common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R0-th line is outputted from the color separation circuit 2, the point light source R is lighted. When the data in the G0-th line is outputted, the point light source G is lighted. When the data in the B0-th line is outputted, the point light source B is lighted.

In the fourth embodiment, the data in the R0-th line, that in the G0-th line, and that in the B0-th line from the color separation circuit 2 are repeatedly sent plural times corresponding to the number of slice levels. First, the slice data in the R0-th line for the slice level 1 is sent to the segment electrode layer 83 of the shutter 8. Based on the ON/OFF information of each level, only the pixel on the common electrode 810 reflects the data of the segment electrode layer 83 and the light is made to pass therethrough/be cut off.

Next, the slice data in the G0-th line for the slice level 1 and the slice data in the B0-th line for the slice level 1 are sequentially sent to the segment electrode layer 83 of the shutter 8. The display of the R0-th line, the G0-th line, and the B0-th line for the level 1 is completed so far.

Subsequently, the display of the R0-th line, the G0-th line, and the B0-th line for the level 2 is similarly performed. In this way, the slice levels are sequentially changed and the display of the R0-th line, the G0-th line, and the B0-th line for all the slice levels is performed.

After the completion of processing of the data in the 0th line, the data in the first line is outputted from the color separation circuit 2 in response to the instruction from the timing circuit 3. The common electrode 811 is selected and the other common electrodes are put in a non-selection state. Then, the display is started with the R1-st line, the G1-st line, and the B1-st line for the slice level 1 in order.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

As described above, in the fourth embodiment, the display of the field corresponding to the level n of R, the field corresponding to the level n of G, and the field corresponding to the level n of B is performed for each slice level by the shutter 8 to make the light pass therethrough/be cut off. Thus, the color mixture of R, G, and B is instantly performed on a level basis, thereby being capable of reproducing the full color image with satisfactory color mixing property of the gradation.

Fifth Embodiment

In the first, second, third, and fourth embodiments as described above, the slice data of R, G, and B is transferred to the shutter 8 for each line. Next, however, an embodiment in which switching of R, G, and B is performed on a subfield basis and the slice data is transferred on a line basis will be described.

Figure 15:
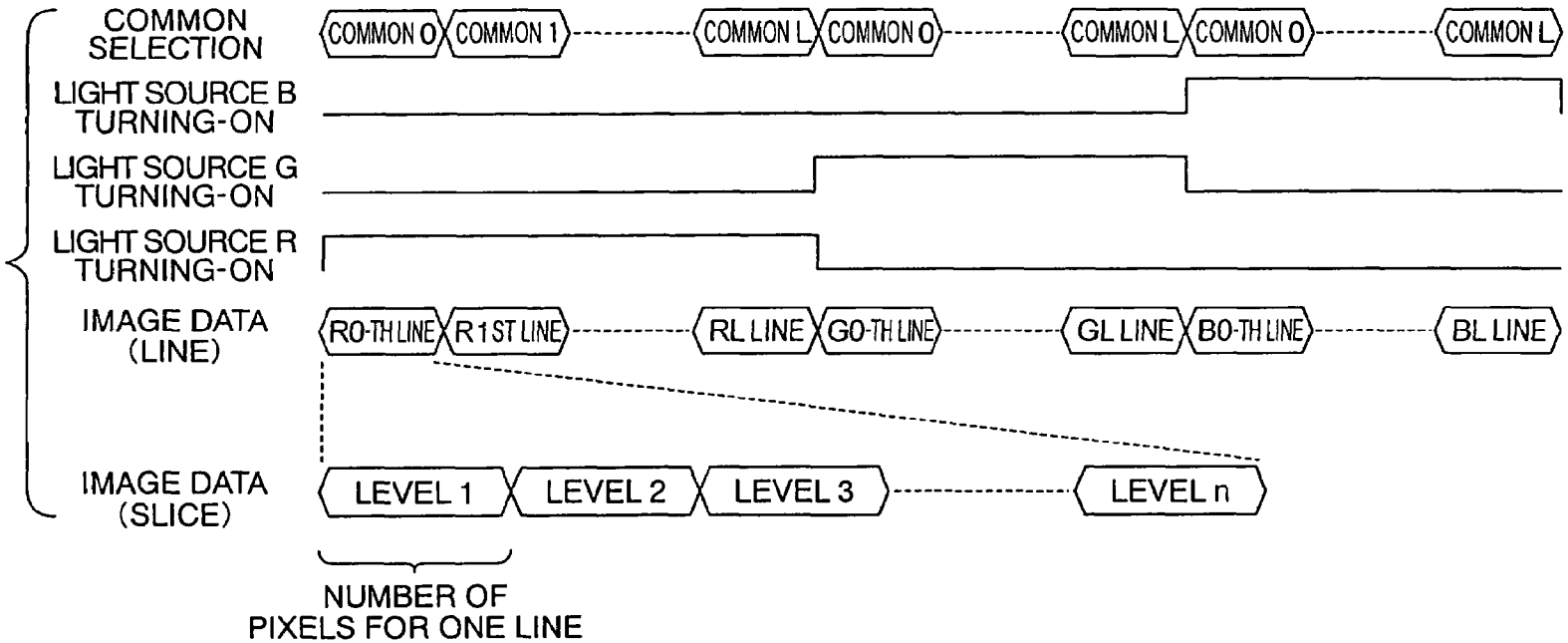
FIG. 15 is an operation timing chart of gradation control in accordance with a fifth embodiment of the present invention.

FIG. 15 is a general timing chart of a fifth embodiment. This timing is generated by the timing circuit 3, which corresponds to a timing at which each block is operated. In response to an instruction from the timing circuit 3, the image data (line) is outputted from the color separation circuit 2 in the order of R0-th line, R1-st line, . . . , RL-th line, G0-th line, . . . , GL-th line, B0-th line, . . . , and BL-th line. The common electrodes in a number corresponding to the number of lines of outputted image data (line) are selected.

For example, in the case of R0, G0, and B0, the common 0 is selected (common electrode 810 in FIG. 8) and in the case of R1, G1, and B1, the common 1 (common electrode 811 in FIG. 8) is selected. Only the pixel on the selected common electrode reflects the data of the segment electrode layer 83 and the pixels on the other common electrodes are brought into a light shielded state irrespective of the data of the segment electrode layer 83.

In response to the instruction from the timing circuit 3, when the data in the R-related line is outputted from the color separation circuit 2, the point light source R is lighted. When the data in the G-related line is outputted, the point light source G is lighted. When the data in the B-related line is outputted, the point light source B is lighted.

The image data (line) is separated into the slice data by the shutter control circuit 4 in response to the instruction from the timing circuit 3 and sent to the segment electrode layer 83 of the shutter 8. In the figure, the data of level 1 to the data of level n are sent to the driver circuit 41 from the slice circuit 40 on a line basis. That is, the data in the R0-th line sliced at the level 1 is set as the slice data based on the level 1 and the obtained slice data corresponding to one line is sent. Following this, the data in the R0-th line sliced at the level 2 is set as the slice data based on the level 2 and the obtained slice data corresponding to one line is sent. Sequentially, the slice data is sent up to the level n.

Accordingly, regarding the data in the R0-th line, the slice data corresponding to one line is sent n times. Based on the ON/OFF information of each level, only the pixel on the common electrode 810 reflects the data of the segment electrode layer 83 and the light is made to pass therethrough/be cut off. The slice data represents the ON/OFF information based on the Level n, so that when the control of the whole operation is performed based on the timings of FIG. 15, the light passes therethrough at the level lower than the image data value and is cut off at the level equal to or higher than the image data value. The light is controlled which reflects the gradation of the color component data of the image data.

After the completion of processing of the data in the R0-th line, the data in the R1-st line is separated into the slice data by the shutter control circuit 4 in response to the instruction from the timing circuit 3 and sent to the segment electrode layer 83 of the shutter 8. Only the pixel on the common electrode 811 reflects the data of the segment electrode layer 83, so that the light from the point light source R is made to pass therethrough/be cut off. Sequentially, the data in the R-related line is outputted and simultaneously, the corresponding common is selected, so that in the corresponding pixel, the light is controlled to pass therethrough/be cut off.

After the completion of processing of the R-related data, the G-related data is transferred. At this time, the common to be selected returns to the common 0. In addition, the lighting light source is switched to the point light source G. It is controlled similarly to the R-related data and in the corresponding pixel, the light is controlled to pass therethrough/be cut off. Next, the B-related data is controlled in a like manner.

By performing the above operation, the display of one frame is completed. This operation is performed within a time period where an afterimage of human eyes is available to reproduce the full color image with the gradation. After the completion of the display of one frame, the subsequent frame is displayed and this operation is repeatedly performed to display an animation.

In the fifth embodiment as described above, as to the output order of the image data (line), R-related data, G-related data, and B-related data are outputted in this order. However, the order is not limited to the above. For example, R-related data, B-related order, and G-related data may be outputted in this order.

In the fifth embodiment as described above, the display time is fixed in each level but may be variable in each level. For example, a display time for the level n may be set as a time n and a display time for the level n+1 may be set as a time n+1 ($n \neq n+1$).

Also, the slice data sent to the driver circuit 41 is assumed to take the same slice level in one line for each pixel. However, provided that, during a time period for which the slice data is sent n times, all the slice levels are covered for each pixel, it is not required to use the same slice level in one line. For example, even pixels may change in slice level from the level 1 to the level n in this order, whereas odd pixels may change in slice level from the level n to the level 1.

As described above, in the fifth embodiment, R, G, and B are switched on a subfield basis and the slice data is transferred to the shutter 8 from the shutter control circuit 4 on a line basis. Then, the shutter 8 makes the light pass therethrough/be cut off on a line basis, so that the full color image with the gradation can be reproduced.

Also, because of the control on a line basis, the number of pixel selection drivers can be reduced and a field sequential color image display apparatus can be provided at low cost.

Further, the slice data display time is made variable according to the slice level, so that the gradation control for each level is possible.

Also, the order of changing the slice level is switched for each pixel and thus, a power applied to the shutter 8 can be dispersed, thereby achieving low power consumption.

Sixth Embodiment

In the first to fifth embodiments as described above, the slice data concerning the image data 1 is transferred to the shutter 8. Next, however, an embodiment in which a dummy line is provided where the data is switched will be described.

Figure 16:
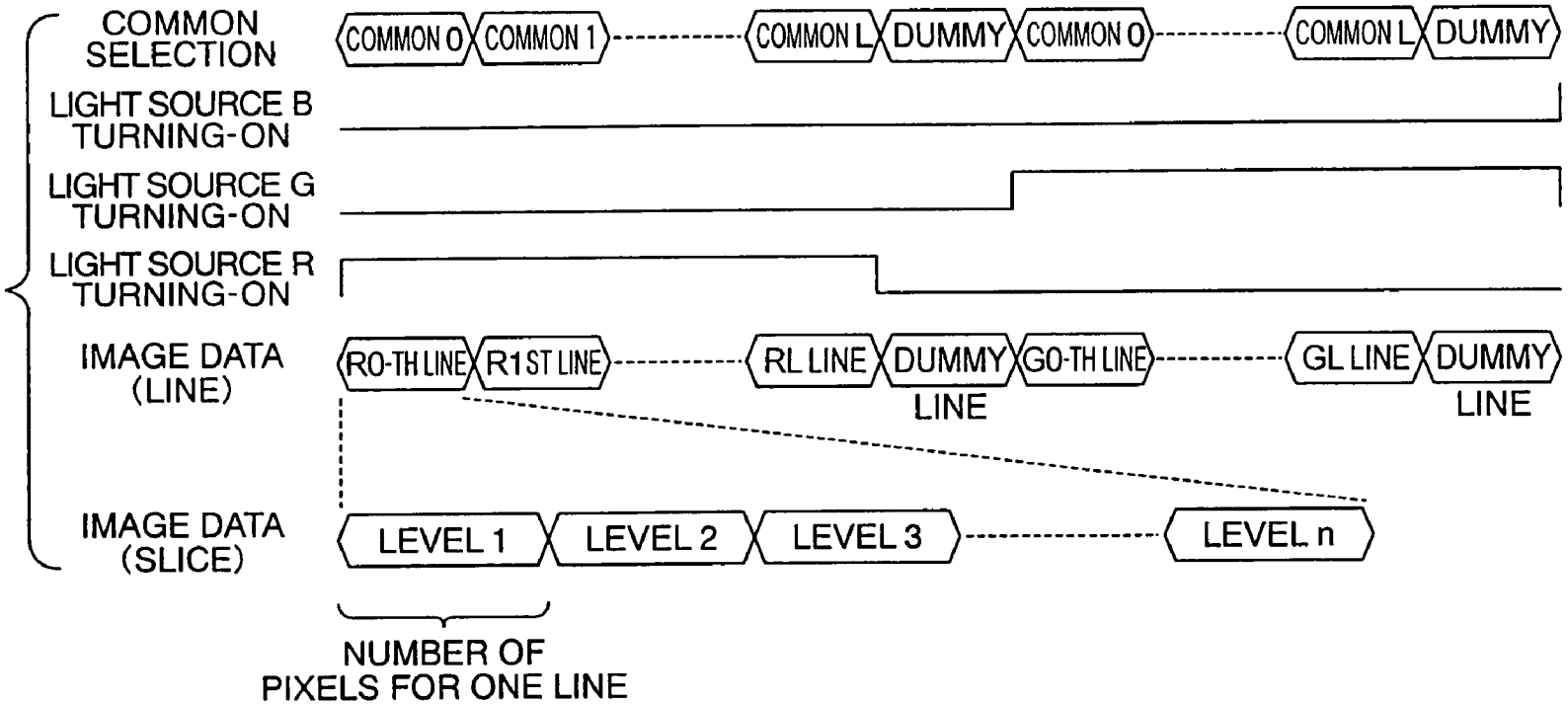
FIG. 16 is an operation timing chart of gradation control in accordance with a sixth embodiment of the present invention.

FIG. 16 is a general timing chart of a sixth embodiment. The timing is generated by the timing circuit 3, which corresponds to a timing at which each block is operated. In response to an instruction from the timing circuit 3, the image data (line) is outputted from the color separation circuit 2 in the order of R0-th line, R1-st line, . . . , RL-th line, dummy line, G0-th line, . . . , GL-th line, dummy line, B0-th line, . . . , BL-th line, and dummy line.

Note that there is imposed no particular limitation on data of the image data (line) in the dummy line. The common electrodes are selected, the number of which conforms to that of lines of the outputted image data (line), but the common electrode corresponding to the dummy line is not provided (the common output relating to the dummy line of the shutter control circuit 4 is not connected with the common electrode layer 81 of the shutter 8).

For example, in the case of R0, G0, and B0, the common 0 (common electrode 810 in FIG. 8) is selected and in the case of R1, G1, and B1, the common 1 (common electrode 811 in FIG. 8) is selected. Only the pixel on the selected common electrode reflects the data of the segment electrode layer 83 and the pixels on the other common electrodes are brought into a light shielded state irrespective of the data of the segment electrode layer 83. In the case of the dummy line, there is selected no common electrode, so that the pixels on all the common electrodes are brought into a light shielded state irrespective of the data of the segment electrode layer 83.

In response to the instruction from the timing circuit 3, when the data in the R-related line is outputted from the color separation circuit 2, the point light source R is lighted. When the data in the G-related line is outputted, the point light source G is lighted. When the data in the B-related line is outputted, the point light source B is lighted. At the time of output in the dummy line, there exists no corresponding light source, so that all the light sources are brought in either a turned-off state or a turned-on state.

The image data (line) is separated into the slice data by the shutter control circuit 4 in response to the instruction from the timing circuit 3 and sent to the segment electrode layer 83 of the shutter 8. In the figure, the data of level 1 to the data of level n are sent to the driver circuit 41 from the slice circuit 40 on a line basis. That is, the data in the R0-th line sliced at the level 1 is set as the slice data based on the level 1 and the obtained slice data corresponding to one line is sent.

Following this, the data in the R0-th line sliced at the level 2 is set as the slice data based on the level 2 and the obtained slice data corresponding to one line is sent. Sequentially, the slice data is sent up to the level n. Accordingly, regarding the data in the R0-th line, the slice data corresponding to one line is sent n times. Based on ON/OFF information of each level, only the pixel on the common electrode 810 reflects the data of the segment electrode layer 83 and the light is made to pass therethrough/be cut off. The slice data represents the ON/OFF information based on the Level n, so that when the control of the whole operation is performed based on the timings of FIG. 16, the light passes therethrough at the level lower than the image data value and is cut off at the level equal to or higher than the image data value. The light is controlled which reflects the gradation of the color component data of the image data.

After the completion of processing of the data in the R0-th line, the data in the R1-st line is separated into the slice data by the shutter control circuit 4 in response to the instruction from the timing circuit 3 and sent to the segment electrode layer 83 of the shutter 8. Only the pixel on the common electrode 811 reflects the data of the segment electrode layer 83, so that the light from the point light source R is made to pass therethrough/be cut off. Sequentially, the data in the R-related line is outputted and simultaneously, the corresponding common is selected, so that in the corresponding pixel, the light is controlled to pass therethrough/be cut off.

After the completion of the R-related data, the data in the dummy line is transferred. In the case of the dummy line, there is selected no common electrode, so that all the pixels are brought into a light shielded state and no light passes through the shutter 8.

Subsequently, the G-related data is transferred. At this time, the selected common returns to common 0. Also, the lighting light source is switched to the point light source G. It is controlled similarly to the R-related data and in the corresponding pixel, the light is controlled to pass therethrough/be cut off. After the completion of the G-related data, the data in the dummy line is transferred. Following this, the B-related data is similarly controlled. After the completion of the B-related data, the data in the dummy line is transferred.

By performing the above operation, the image display of one frame in which the pixel is put in the light shielded state at the time of switching the related data is completed. This operation is performed within a time period where an afterimage of human eyes is available to reproduce the full color image with the gradation. After the completion of the display of one frame, the subsequent frame is displayed and this operation is repeatedly performed to display an animation.

In the sixth embodiment as described above, the display time for the dummy line is set equal to that for the other image data (lines), but may be set variable. For example, the display time for the dummy line may be set equal to the display time for the image data (slice).

Also, as the dummy line, one line is provided, but plural lines may be provided. For example, ten lines may be provided for the dummy line.

Figure 17:
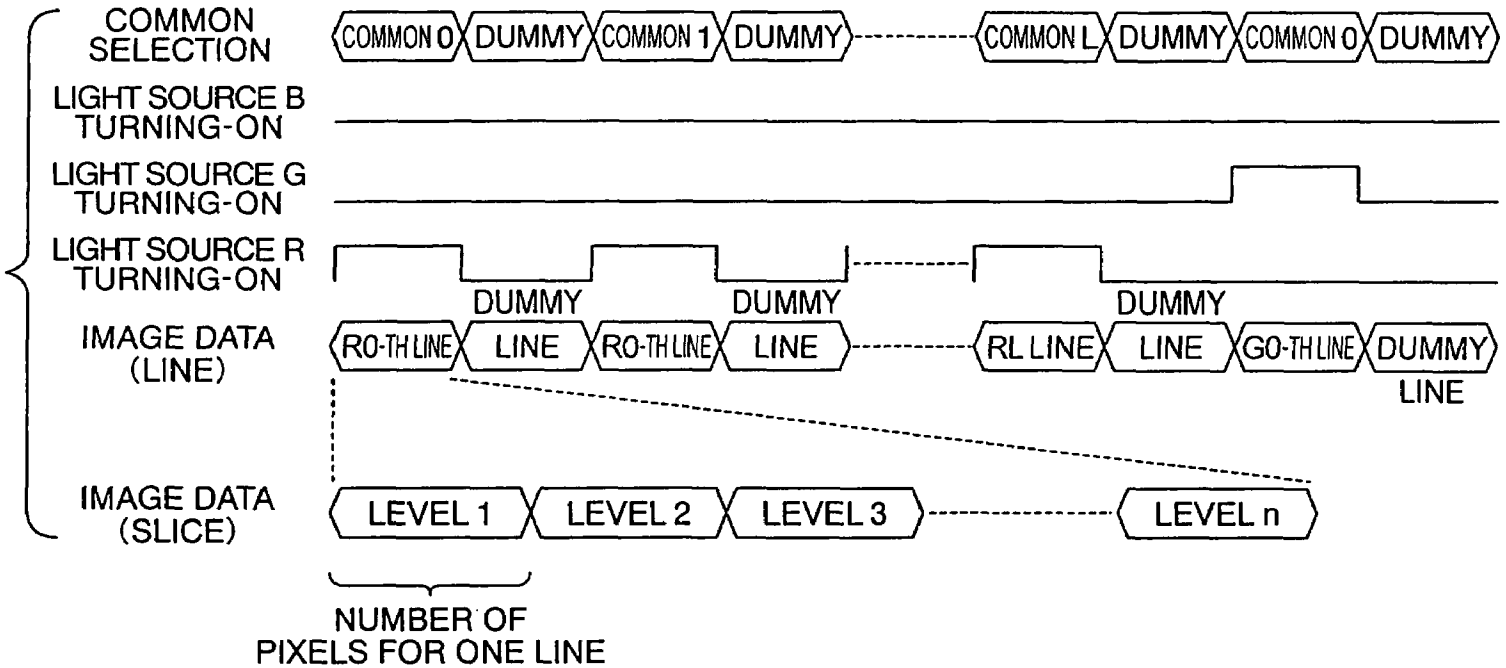
FIG. 17 is an explanatory diagram for the case where dummy lines are put into each of R-related data, G-related data, and B-related data.

Also, the dummy line is provided where the related data is switched, but may be provided in any portion as long as it serves as a position at which the line is switched. For example, as shown in FIG. 17, the dummy line may be provided in each of the R-related data, G-related data, and B-related data.

Further, when there is any difference between the color component data display time in total and the frame time at the time of animation display, the difference may be allocated to the dummy line. For example, when the color component data display time is 15 ms in total and the frame time at the time of animation display is 16.6 ms, the difference of 1.6 ms is allocated to the dummy line and the dummy line is provided in an appropriate position where the line is switched.

As described above, in the sixth embodiment, the dummy line is outputted from the color separation circuit 2 in a position where the line is switched and the common output of the shutter control circuit 4 corresponding to the dummy line is not connected with the common electrode layer 81 of the shutter 8. Thus, all the pixels are put in the light shielded state in a position where the line is switched and no light passes through the shutter 8. As a result, a spatio-temporal display for a black mask of a cathode-ray tube is made possible.

Seventh Embodiment

In the first to sixth embodiments as described above, respective circuits are configured using different circuits. Next, however, an embodiment in which respective circuits are configured using one circuit will be described.

Figure 18:
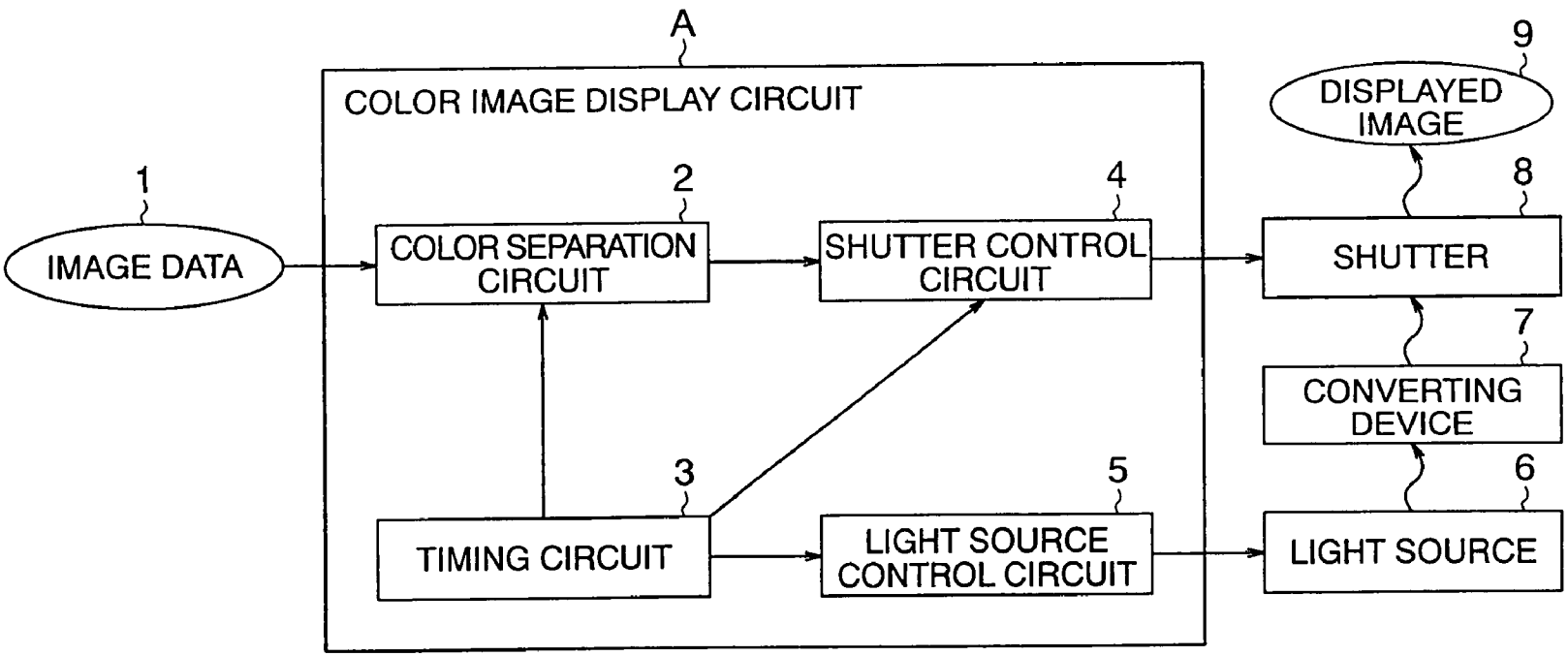
FIG. 18 is a block diagram showing a seventh embodiment of the present invention.

FIG. 18 is a block diagram showing a seventh embodiment of the present invention. In the figure, reference numeral 1 denotes digital color image data, reference numeral 2 denotes a color separation circuit for separating/accumulating the digital image data 1 on a subfield basis, reference numeral 3 denotes a timing circuit for generating various timings, reference numeral 4 denotes a shutter control circuit for controlling a shutter 8 described below, reference numeral 5 denotes a light source control circuit for controlling a light source 6 described below, reference numeral 6 denotes the light source for generating lights of plural colors, reference numeral 7 denotes a converting device for changing an optical path of the light from the light source 6, reference numeral 8 denotes the shutter for cutting off the light emitted from the light source 6 and passed through the converting device 7, and reference numeral 9 denotes a displayed display image. Hereinbefore, denoted by reference numerals 1 to 9 are the same as the respective circuits etc. described in the first to sixth embodiments. Reference symbol A denotes a color image display circuit in which the color separation circuit 2, the timing circuit 3, the shutter control circuit 4, and the light source control circuit 5 are collectively disposed.

Next, the operation will be described. Reference numerals 1 to 9 in FIG. 18 are respectively the same as in each embodiment and thus, description thereof is omitted here. To the color image display circuit A, the image data 1 as the multi-valued data is inputted. The inputted image data 1 is separated/accumulated on a subfield basis in the color separation circuit 2 by the control of the timing circuit 3 and then, converted into the binary slice data in the shutter control circuit 4.

On the other hand, the light source control circuit 5 causes the light source 6 to be turned on/off under the control of the timing circuit 3 in synchronism with the color separation circuit 2. The slice data and the light source control signal are outputted from the color image display circuit A. The slice data is sent to the shutter 8 and the light source control signal is sent to the light source 6 to turn on/off the light source 6. The emitted light is converted into the surface light source light by the converting device 7 and then passes through the shutter 8 that makes the light pass therethrough/be cut off for each pixel based on the slice data and is displayed as the display image 9.

In the seventh embodiment, the color image display circuit A in which the color separation circuit 2, the timing circuit 3, the shutter control circuit 4, and the light source control circuit 5 are collectively disposed is used. However, it is possible to adopt the three circuits, the color separation circuit 2 and the shutter control circuit 4, the timing circuit 3, and the light source control circuit 5.

Also, in the seventh embodiment, the color image display circuit A in which the color separation circuit 2, the timing circuit 3, the shutter control circuit 4, and the light source control circuit 5 are collectively disposed is used. However, the color separation circuit 2, the timing circuit 3, the shutter control circuit 4, the light source control circuit 5, and the light source 6 may be combined. At this time, the light from the light source 6 may be transmitted to the converting device 7 through an optical fiber or the like.

Also, the color image display circuit A may be composed of an integrated device such as an LSI.

Further, when the function corresponding to the color separation circuit 2 is provided on the transfer source of the image data 1, it is possible to dispense with the color separation circuit 2 and adopt the color image display circuit A in which the timing circuit 3, the shutter control circuit 4, and the light source control circuit 5 are collectively disposed.

As described above, in the seventh embodiment, the color separation circuit 2, the timing circuit 3, the shutter control circuit 4, and the light source control circuit 5 are collectively integrated into the color image display circuit A. Thus, only by receiving the multi-valued image data 1 from the computer etc., the color image can be displayed. Also, because of integration into one circuit, cost reduction is available and reliability of the color image display apparatus increases.

Eighth Embodiment

In the color image display apparatus according to an eighth embodiment of the present invention, the block structure as in the first embodiment shown in FIG. 1 is provided and each block portion operates in a like manner. Also, the color separation circuit 2 has the configuration shown in FIG. 2 as well.

In the eighth embodiment, the number of color components of the subfield is 4 or more. That is, in the eighth embodiment, the image data 1 of R, G, and B is separated into four subfields of R', G', B', and W. Assuming that the image data 1 is represented by (R, G, B), the data of the subfield is obtained by the following equation.

$$W=\min(R, G, B)$$

$$R'=R-W$$

$$G'=G-W$$

$$B'=B-W$$

The memory 21 is a memory capable of accumulating the color component data corresponding to one field and the number of prepared memories 21 conforms to that of color components to be accumulated. In the eighth embodiment, since the four color components of R', G', B', and W are provided, there are provided the four memories assuming that n=3. The selector 22 is used for selecting/outputting the color component data accumulated in the memory 21 in accordance with a processing timing of the shutter control circuit 4. The processing timing of the shutter control circuit 4 is controlled using the signal generated from the timing circuit 3.

Next, the shutter control circuit 4 will be described. The shutter control circuit 4 separates the (multi-valued) color component data corresponding to one field outputted from the color separation circuit 4 into (binary) slice data, and based on the slice data, the shutter 8 is controlled.

The shutter control circuit 4 has the configuration shown in FIG. 3 as in the first embodiment and operates in a like manner. That is, the slice circuit 40 outputs the binary slice data, with which the inputted color component data corresponding to one field is regarded as OFF slice data when the data is at a certain slice level (Level n) or lower and otherwise as ON slice data. The value of the Level n varies depending on the signal from the timing circuit 3. As a result, the color component data corresponding to one field is divided into the plural slice data and outputted.

The concept thereof is as shown in FIG. 4. A signal value inputted into the slice circuit 40 from the color separation circuit 2 supposedly falls within a range of 0 to 255. When Level n is set based on the signal from the timing circuit 3, in the case where the signal at a level of 0 to less than Level n is inputted, the OFF slice data is outputted, whereas in the case where the signal at a level of the Level n or more to 255 is inputted, the ON slice data is outputted. When based on the signal from the timing circuit 3, the above setting is changed to Level n+1, in the case where the signal at a level of 0 to less than Level n+1 is inputted, the OFF slice data is outputted, whereas in the case where the signal at a level of Level n+1 or more to 255 is inputted, the ON slice data is outputted. The driver circuit 41 performs ON/OFF control of the shutter 8 based on the ON/OFF state of the slice data. This circuit is used for voltage level conversion required for driving the shutter 8 and AC conversion.

Next, the light source control circuit 5 will be described. The light source control circuit 5 is composed of the drive voltage generating circuit 50 and the switch 51 shown in FIG. 5 similarly to the first embodiment. The power source used in the drive voltage generating circuit 50 is inputted to an input thereof. The drive voltage generating circuit 50 converts a power source voltage to a light source drive voltage as necessary. Based on the signal from the timing generating circuit 3, the switch 51 is used to turn ON/OFF the drive voltage of the corresponding light source 6. In the eighth embodiment, the digital image data 1 is separated into the four color component data of R', G', B', and W, while the three light sources of R, G, and B are used, so that the three switches 51 are provided assuming that n=2.

Also, the switch 51 operates as follows. During a period for which the R' component data is outputted from the color separation circuit 2 to drive the shutter through the shutter control circuit 4, the switch for driving the R light source is turned ON and the other switches are turned OFF. In the case of the G' component data, the switch for driving the G light source is turned ON and the other switches are turned OFF. In the case of the B' component data, the switch for driving the B light source is turned ON and the other switches are turned OFF. In the case of the W component data, the switches for driving all of the R light source, the G light source, and the B light source are turned ON.

Similarly to the first embodiment, as shown in FIG. 6, the light source 6 is composed of light sources 60 in m colors. In the eighth embodiment, the light source is composed of the light sources 60 in m colors, m differing from n that defines the number of color component data. That is, the number of color components is 4 assuming that n=3 and the light sources in three colors are used assuming that m=2. Also, the light sources 60 are assumed as point light sources. A light emission wavelength of the light source 60 in any range can be adopted as long as the wavelength falls within the wavelength region corresponding to the color component data.

Next, a description will be given of the converting device 7 with reference to FIG. 7 similarly to the first embodiment. In FIG. 7, reference numeral 60 denotes the point light source described as the light source 6. Reference numeral 70 denotes a point-surface converting device for converting the point light source to the surface light source. The point-surface converting device 70 is manufactured by using acrylic resin etc. as a material therefor and changing a reflectivity of a plate-like device within the plate or stacking thin plates stepwise.

Subsequently, a description will be given of the shutter 8 with reference to FIG. 8 similarly to the first embodiment. The shutter 8 takes a laminate structure. In the figure, the polarizing plate A layer 80, the common electrode layer 81, the liquid crystal layer 82, the segment electrode layer 83, and the polarization B layer 84 are laminated in this order from the top. Although not shown in the figure, they are laminated on a hard plate such as glass serving as a substrate. The polarizing plate A layer 80 and the polarization B layer 84 are laminated so as to be orthogonal or parallel to each other to form the polarization planes. The common electrode layer 81 and the segment electrode layer 83 are transparent electrodes orthogonal to each other and an intersecting point thereof serves as a display pixel. In the figure, twenty pixels of four rows of the common electrodes and five columns of the segment electrodes can be displayed. The segment-common voltage is turned ON/OFF with a phase transition voltage of liquid crystal interposed therebetween, so that the phase transition of the liquid crystal corresponding to the pixel occurs and the light passing through the polarizing plate A layer 80, the liquid crystal layer 82, and the polarization B layer 84 is made to pass therethrough/be cut off.

As described above, information on the image data 1 is sent to the shutter 8 through the color separation circuit 2 and the shutter control circuit 4 as well as the light from the light source 8 is converted to the surface light source light through the converting device 7 and an R light, a G light, and a B light are applied to the shutter 8. Thus, the image data 1 is displayed as the color display image 9 in a filterless manner.

Figure 19:
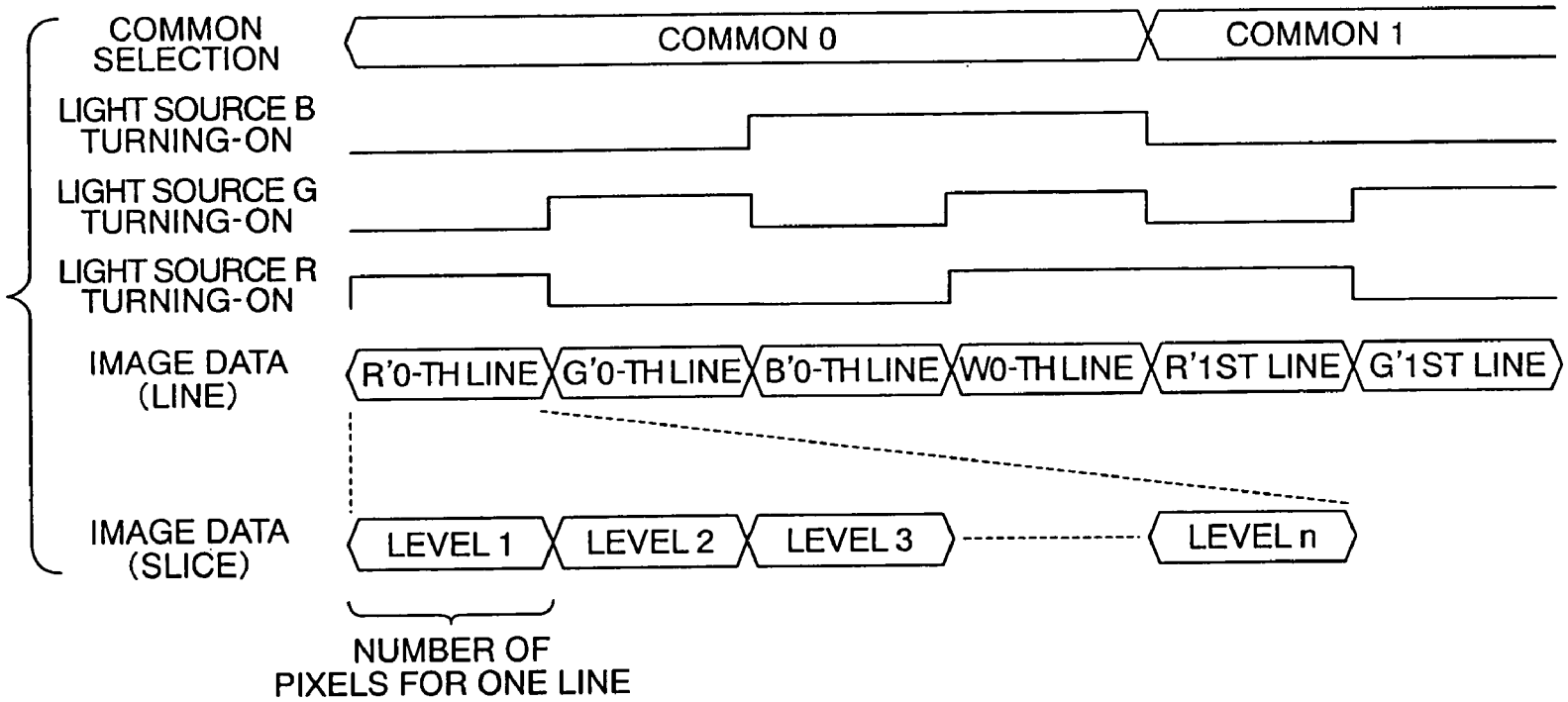
FIG. 19 is an operation timing chart of gradation control in accordance with an eighth embodiment of the present invention.

Next, gradation control will be described with reference to whole operation timings. FIG. 19 is a general timing chart of the eighth embodiment. This timing is generated by the timing circuit 3, which corresponds to a timing at which each block is operated. In response to an instruction from the timing circuit 3, while the data in 0th line is outputted from the color separation circuit 2 (in the figure, while the image data in the R'0-th line, G'0-th line, B'0-th line, and W0-th line is used), a common 0 is selected in the common electrode. To explain it using FIG. 8, a common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R'0-th line is outputted from the color separation circuit 2, the point light source R is lighted. When the data in the G'0-th line is outputted, the point light source G is lighted. When the data in the B'0-th line is outputted, the point light source B is lighted. When the data in the W0-th line is outputted, all of the point light sources R, G, and B are lighted.

The image data (line) is separated into the slice data by the shutter control circuit 4 in response to the instruction from the timing circuit 3 and sent to the segment electrode layer 83 of the shutter 8. In the figure, the data of level 1 to the data of level n are sent to the driver circuit 41 from the slice circuit 40 on a line basis. That is, the data in the R'0-th line sliced at the level 1 is set as the slice data based on the level 1 and the obtained slice data corresponding to one line is sent. Following this, the data in the R'0-th line sliced at the level 2 is set as the slice data based on the level 2 and the obtained slice data corresponding to one line is sent. Sequentially, the slice data is sent up to the level n.

Accordingly, regarding the data in the R'0-th line, the slice data corresponding to one line is sent n times. Based on the ON/OFF information of each level, only the pixel on the common electrode 810 reflects the data of the segment electrode layer 83 and the light is made to pass therethrough/be cut off. The slice data represents the ON/OFF information based on the slice level, so that when the control of the whole operation is performed based on the timings of FIG. 19, the light passes therethrough at the level lower than the image data value and is cut off at the level equal to or higher than the image data value. By utilizing this, the light is controlled which reflects the gradation of the separation color component data of the image data. Further, the time width of each level is made variable, thereby performing the gradation control for each level.

After the completion of processing of the data in the R'0-th line, the data in the G'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off.

Following this, the data in the B'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source B is made to pass therethrough/be cut off. Next, the data in the W0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from all of the point light sources R, G, and B is made to pass therethrough/be cut off.

After the completion of processing of the data in the 0th line, the data in the first line is outputted from the color separation circuit 2 in response to the instruction of the timing circuit 3. A common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

As described above, in the eighth embodiment, the emitted light intensity of each light source is fixed at the time of single color light emission and at the time of full color light emission (at the time of light emission corresponding to R' and at the time of light emission corresponding to W, and the like) but may be controlled independently for each light source. For example, the emitted light intensity of the R light source upon the R' control is represented by PR and the emitted light intensity of the R light source upon the W control is represented by PRW (PR≠PRW).

Also, in the eighth embodiment, the light emission corresponding to W is performed through full color light emission. However, the white light source may be adopted and used at the time of displaying the slice data corresponding to the W component.

Also, the display time is fixed in each level but may be variable in each level. For example, a display time for the level n may be set as a time n and a display time for the level n+1 may be set as a time n+1 (n≠n+1).

The slice data sent to the driver circuit 41 is assumed to take the same slice level for each pixel in one line. However, provided that during a time period for which the slice data is sent n times, all the slice levels are covered for each pixel, it is not required to use the same slice level in one line. For example, even pixels may change the slice level thereof from the level 1 to the level n in this order, whereas odd pixels may change the slice level thereof from the level n to the level 1.

Also, the light emission wavelength of the light source 60 is set so as to fall within the wavelength region corresponding to the color component data, but the light source in one color may be achieved by using the plural light sources. For example, the two light sources respectively having a peak wavelength of 700 nm and a peak wavelength of 750 nm may be used to achieve the light source in one color corresponding to the R component.

Also, the liquid crystal used in the liquid crystal display panel 2 may be either active type liquid crystal or passive type liquid crystal. As specific examples of the liquid crystal, TFT type liquid crystal, STN type liquid crystal, and TN type liquid crystal can be given.

Also, when the function corresponding to the color separation circuit 2 is provided on a transfer source of the image data 1, it is possible to dispense with the color separation circuit 2.

As described above, in the eighth embodiment, the image data 1 is separated into an achromatic color component (W) and chromatic color components (R', G', and B') by the color separation circuit 2, and the light source 6 corresponding to each component is lighted, so that the gradation control can be performed for each of the achromatic color component and the chromatic color component.

Also, the emitted light intensity of each light source is made variable at the time of single color light emission and at the time of full color light emission (at the time of light emission corresponding to R' and at the time of light emission corresponding to W, or the like). Thus, for example, the R' control can be separated from the W control.

Also, an operation in which the R light source, the G light source, and the B light source are simultaneously allowed to emit light to obtain a white light, i.e., spatial color mixture is performed. Thus, as compared with an operation in which the white light is obtained by utilizing the afterimage while shifting the light emission time, which features the field sequential method, i.e., temporal color mixture, the achromatic color mixture is achieved in a more complete form.

Also, the light emission corresponding to W is made through the full color light emission, so that the brightness increases over the entire field, which can make the screen bright as compared with the case of reproducing the image only through the single color light emission.

Also, the slice data according to the Level n is outputted from the shutter control circuit 4 and the shutter 8 makes the light pass therethrough/be cut off on a line basis, so that the full color image with the gradation can be reproduced. At the same time, because of the control on a line basis, the number of pixel selection drivers can be reduced and a field sequential color image display apparatus can be provided at low cost.

Further, the slice data display time is made variable according to the slice level, so that the gradation control for each level is possible.

Also, since the light source 6 is converted from the point light source to the surface light source by the converting device 7, the number of light sources to be used can be made small and the display pixel size can be increased irrespective of the number of light sources as well as the field sequential color image display apparatus can be provided at low cost.

Ninth Embodiment

In the above-mentioned eighth embodiment, as shown in FIG. 19, the image data 1 is separated into R', G', B', and W and the corresponding light source 6 is lighted. Then, based on the ON/OFF state of the shutter 8, the image is displayed. Next, however, an embodiment will be described in which the number of separations is made larger, thereby achieving the mixture of the respective colors in a more complete form.

The color separation circuit 2 of a ninth embodiment performs separation into the seven color components assuming that n=6 as for the memory 21 shown in FIG. 2. In the ninth embodiment, the image data 1 of R, G, and B is separated into the seven subfields of R", G", B", C', M', Y', and W. Assuming that the image data 1 is represented by (R, G, B), the data of the subfield is obtained by the following equation.

$$W=\min(R, G, B)$$

$$R'=R-W$$

$$G'=G-W$$

$$B'=B-W$$

$$C'=\min(G', B')$$

$$M'=\min(B', R')$$

$$Y'=\min(R', G')$$

$$R''=R'-\max(Y', M')$$

$$G''=G'-\max(M', C')$$

$$B'=B'-\max(C', Y')$$

Figure 20:
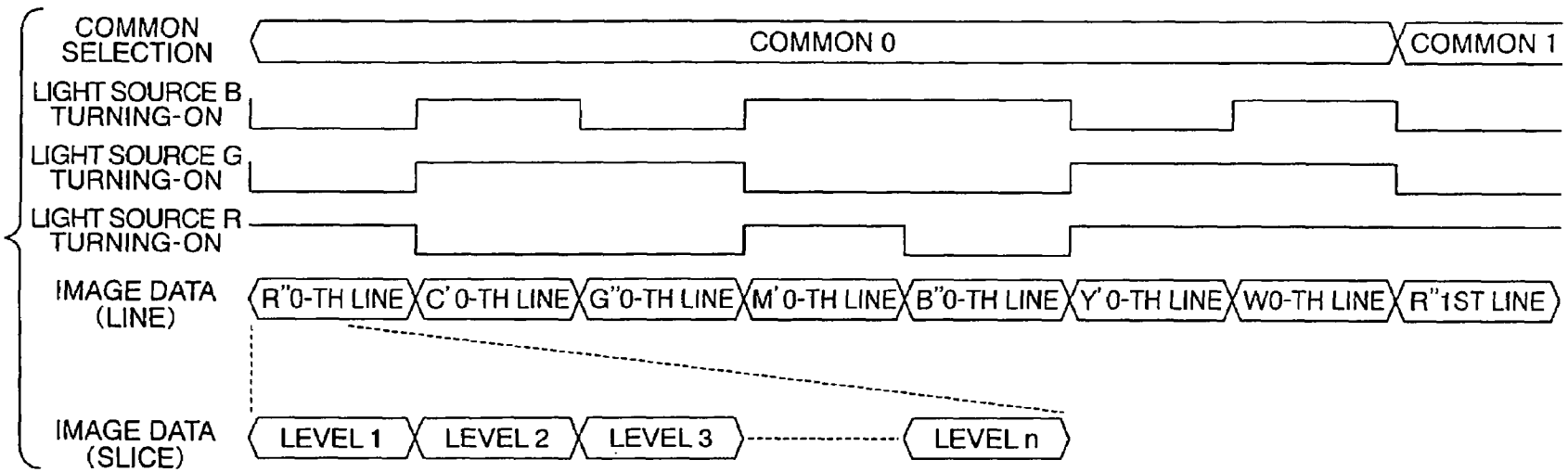
FIG. 20 is an operation timing chart of gradation control in accordance with a ninth embodiment of the present invention.

FIG. 20 is a general timing chart of the ninth embodiment. This timing is generated by the timing circuit 3, which corresponds to a timing at which each block is operated. In response to an instruction from the timing circuit 3, while the data in 0th line is outputted from the color separation circuit 2 (in the figure, while the image data in the R"0-th line, C'0-th line, G"0-th line, M'0-th line, B"0-th line, Y'0-th line, and W0-th line is used), a common 0 is selected in the common electrode. To explain it using FIG. 8, a common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R"0-th line is outputted from the color separation circuit 2, the point light source R is lighted. When the data in the C'0-th line is outputted, the point light sources G and B are lighted. When the data in the G"0-th line is outputted, the point light source G is lighted. When the data in the M'0-th line is outputted, the point light sources B and R are lighted. When the data in the B"0-th line is outputted, the point light source B is lighted. When the data in the Y'0-th line is outputted, the point light sources R and G are lighted. When the data in the W0-th line is lighted, the point light sources R, G, and B are all lighted.

The image data (line) is separated into the slice data by the shutter control circuit 4 in response to the instruction from the timing circuit 3 and sent to the segment electrode layer 83 of the shutter 8. In the figure, the data of level 1 to the data of level n are sent to the driver circuit 41 from the slice circuit 40 on a line basis. Following this, based on the ON/OFF information of each level, only the pixel on the common electrode 810 reflects the data of the segment electrode layer 83 and the light is made to pass therethrough/be cut off. The slice data represents the ON/OFF information based on the Level n. Thus, when the control of the whole operation is performed based on the timings of FIG. 20, the light passes therethrough at the level lower than the image data value and is cut off at the level equal to or higher than the image data value, which is utilized to perform the gradation control.

After the completion of processing of the data in the R"0-th line, the data in the C'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light sources G and B is made to pass therethrough/be cut off. Next, the data in the G"0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Sequentially, the data in the M'0-th line, the data in the B"0-th line, and the data in the Y'0-th line are sent thereto in this order. Next, the data in the W0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from all of the point light sources R, G, and B is made to pass therethrough/be cut off.

After the completion of processing of the data in the 0th line, the data in the first line as the subsequent line is outputted from the color separation circuit 2 in response to the instruction of the timing circuit 3. A common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

As described above, in the ninth embodiment, the emitted light intensity of each light source is fixed at the time of single color light emission and at the time of full color light emission (at the time of light emission corresponding to R' and at the time of light emission corresponding to W, or the like) but may be controlled independently for each light source. For example, the emitted light intensity of the R light source upon the R' control is represented by PR and the emitted light intensity of the R light source upon the W control is represented by PRW (PR≠PRW).

As described above, in the ninth embodiment, the image data 1 is separated into an achromatic color component (W), primary color components (R", G", and B"), and complementary color components (C', M', and Y') by the color separation circuit 2, and the light source 6 corresponding to each component is lighted, so that the gradation control can be performed for each of the achromatic color component, the primary color component, and the complementary color component.

Also, the emitted light intensity of each light source is made variable at the time of single color light emission and at the time of full color light emission (at the time of light emission corresponding to R' and at the time of light emission corresponding to W, or the like). Thus, for example, the R' control and the W control can be treated as separate controls and controllability thereof increases.

Also, an operation in which the plural light sources are simultaneously allowed to emit light to obtain a white light and a complementary color light, i.e., spatial color mixture is performed. Thus, as compared with an operation in which the white light and the complementary color light are obtained by utilizing the afterimage while shifting the light emission time, which features the field sequential method, i.e., temporal color mixture, the color mixture of the white light and complementary color light is achieved in a more complete form.

Tenth Embodiment

In the above-mentioned eighth and ninth embodiments, the image data 1 is subjected to the color separation, but next, an embodiment in which an image is reproduced by extracting the specific color will be described.

The color separation circuit 2 of a tenth embodiment performs separation into the four color components assuming that n=3 as for the memory 21 shown in FIG. 2. In the tenth embodiment, the image data 1 of R, G, and B is separated into the four subfields of R, G, B, and Color. Assuming that the image data 1 is represented by (R, G, B), the data of the subfield is obtained by the following equations.

In the case of $R0 \leqq R < R1$, $G0 \leqq G < G1$, and $B0 \leqq B < B1$:

$$\text{Color} = \max(R, G, B)$$

In the other cases, R=R, G=G, and B=B (where R0, G0, B0, R1, G1, and B1 are predetermined numerical values).

Next, as the light source of the tenth embodiment, the light sources in four colors in the case of n=m=3 are used. In particular, the light source corresponding to Color is a specific point light source emitting light in which R0≦R<R1, G0≦G<G1, and B0≦B<B1. In the case where the light source 60 is made of an LED, an energy band can be changed by changing an impurity implantation amount at the time of manufacturing a semiconductor, so that the LED with a wavelength according to the purpose can be formed.

Figure 21:
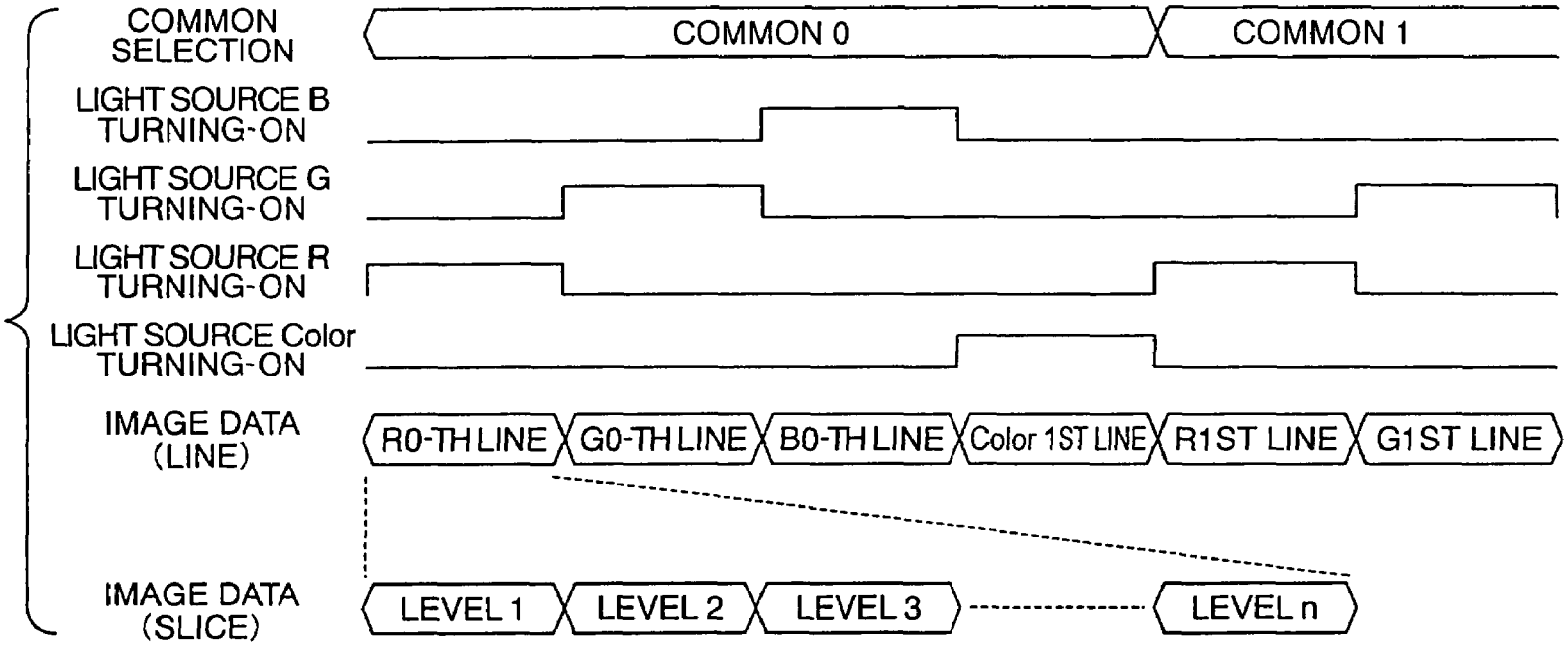
FIG. 21 is an operation timing chart of gradation control in accordance with a tenth embodiment of the present invention.

FIG. 21 is a general timing chart of the tenth embodiment. The timing is generated by the timing circuit 3, which corresponds to a timing at which each block is operated. In response to an instruction from the timing circuit 3, while the data in the 0th line is outputted from the color separation circuit 2 (in the figure, while the image data in the R0-th line, G0-th line, B0-th line, and Color0-th line is used), the common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R0-th line is outputted from the color separation circuit 2, the point light sources R is lighted. When the data in the G0-th line is outputted, the point light source G is lighted. When the data in the B0-th line is outputted, the point light source B is lighted. When the data in the Color0-th line is outputted, the point light source Color is lighted.

The image data (line) is separated into the slice data by the shutter control circuit 4 in response to the instruction from the timing circuit 3 and sent to the segment electrode layer 83 of the shutter 8. In the figure, the data of level 1 to the data of level n are sent to the driver circuit 41 from the slice circuit 40 on a line basis. Following this, based on the ON/OFF information of each level, only the pixel on the common electrode 810 reflects the data of the segment electrode layer 83 and the light is made to pass therethrough/be cut off. The slice data represents the ON/OFF information based on the Level n, so that when the control of the whole operation is performed based on the timings of FIG. 21, the light passes therethrough at the level lower than the image data value and is cut off at the level equal to or higher than the image data value. By utilizing this, the gradation control is performed.

After the completion of processing of the data in the R0-th line, the data in the G0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Next, the data in the B0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source B is made to pass therethrough/be cut off. Next, the data in the Color0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source Color is made to pass therethrough/be cut off.

After the completion of processing of the data in the 0th line, the data in the first line as the subsequent line is outputted from the color separation circuit 2 in response to the instruction from the timing circuit 3. A common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

Note that in the tenth embodiment, as a specific color, only one color is used, but the plural colors may be used. For example, as the specific color, a rachel color A and a rachel color B are used and the light source corresponding to each color is used to display the color image.

As described above, in the tenth embodiment, the point light source Color emitting the light within the specific wavelength range and the primary color light source are used and color separation into the data within the specific wavelength range and the remaining data is performed. Then, the image reproduction is conducted using the point light surface Color on the data within the specific wavelength range, so that the field sequential color image display apparatus showing the satisfactory gradation of the specific color can be provided.

Eleventh Embodiment

In the above-mentioned eighth, ninth, and tenth embodiments, the color separation of the image data 1 is also performed regarding the color components other than the primary colors (R, G, and B) to increase the gradation of display color. However, an embodiment will be described in which the high-speed display required with increasing the number of color separations is performed.

In the eighth, ninth, and tenth embodiments, for the display of the image data of one line, the slice data corresponding to one line is sent n times per color component. Accordingly, when the number of color separations of the image data 1 increases or the display area enlarges, the former involves an increase in the number of color components to be separated and the latter involves an increase in the number of pixels in one line and a longer time period required for transferring the slice data. In an eleventh embodiment, an embodiment will be described in which even if the number of color components increases or the display area enlarges, the time period required for transferring the slice data is made uniform.

Figure 22:
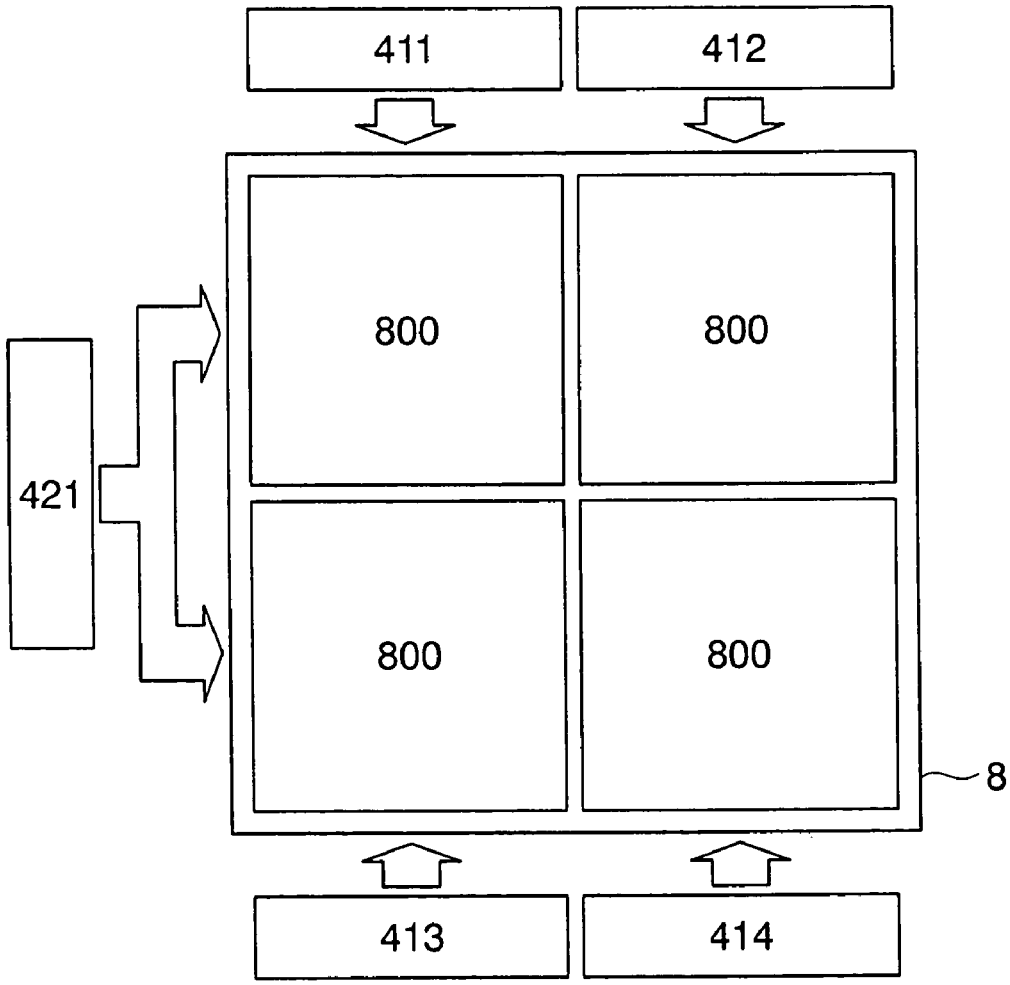
FIG. 22 is a block diagram showing a relationship between a shutter 8 and a shutter driver circuit 4 in accordance with an eleventh embodiment of the present invention.

FIG. 22 shows a relationship between the shutter 8 and the shutter driver circuit 4 in the eleventh embodiment of the present invention. In the eleventh embodiment, the shutter 8 is divided into four sub-shutters 800. Supposing that a main scanning direction of the shutter 8 extends over 2W pixels (W is a natural number) and an auxiliary scanning direction extends along 2L line (L is a natural number), the shutter is evenly divided into four sub-shutters as the sub-shutters 81. Reference numerals 411 to 414 denote segment shutter driver circuits connected to the segment electrode layer 83 of each sub-shutter 800. Reference numeral 421 denotes a common shutter driver circuit connected to the common electrode layer 81 of each sub-shutter 800. The outputs of the common shutter driver circuit 421 are evenly connected to all the sub-shutters 800.

Figure 23:
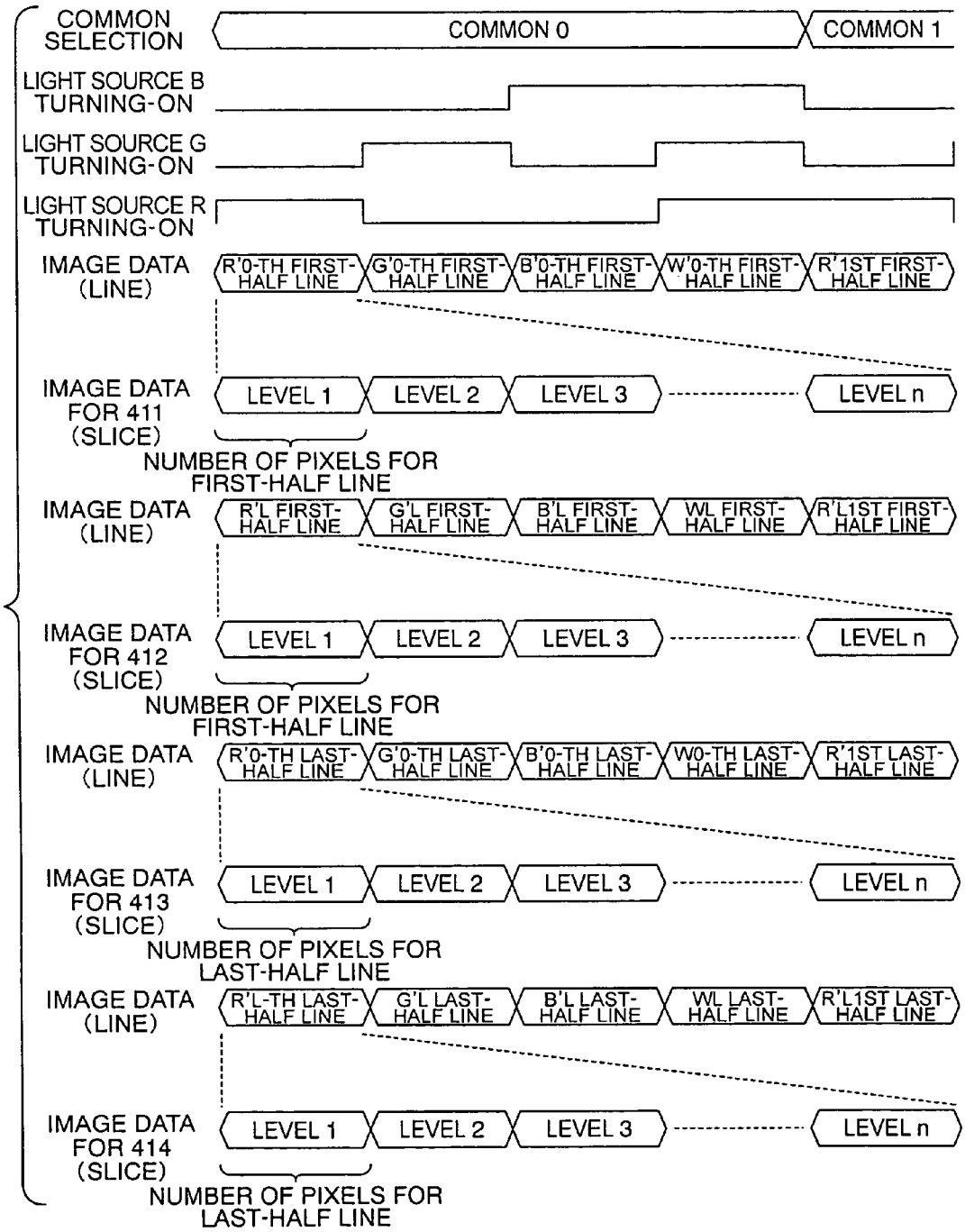
FIG. 23 is an operation timing chart of each portion in accordance with the eleventh embodiment of the present invention.

Next, an operation will be described with reference to FIG. 23. The timing shown in FIG. 23 is generated by the timing circuit 3, which corresponds to a timing at which each block is operated. In response to an instruction from the timing circuit 3, former parts and latter parts of the data in 0th line and the data in the L-th line are outputted from the color separation circuit 2 to the segment shutter driver circuits 411 to 414.

During this operation, that is, in the figure, during a period for which the image data is of [R'0-th former line, G'0-th former line, B'0-th former line, and W0-th former line], [R'0-th latter line, G'0-th latter line, B'0-th latter line, and W0-th latter line], [R'L-th former line, G'L-th former line, B'L-th former line, and WL-th former line], and [R'L-th latter line, G'L-th latter line, B'L-th latter line, and WL-th latter line]), the common 0 is selected in the common electrode.

To explain it using FIG. 8, a common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83. The first line and the L-th line are selected in the shutter 8.

In response to the instruction from the timing circuit 3, when the data in the R-related line is outputted from the color separation circuit 2, the point light source R is lighted. When the data in the G'-related line is outputted, the point light source G is lighted. When the data in the B'-related line is outputted, the point light source B is lighted. When the data in the W-related line is outputted, all of the point light sources R, G, and B are lighted.

The image data (line) is separated into the slice data by the shutter control circuit 4 in response to the instruction from the timing circuit 3 and sent to the segment electrode layer 83 of the shutter 8. An explanation will be made taking the image data 411 (slice) in the figure as an example. The image data (line) in the R'0-th former line is first sent to the segment shutter control circuit 411. Regarding the data in the former line, the data of level 1 to the data of level n are sent to the driver circuit 41 from the slice circuit 40 on a former-line basis. That is, the data in the R'0-th former line sliced at the level 1 is set as the slice data based on the level 1 and the obtained slice data corresponding to former line is sent. Following this, the data in the R'0-th former line sliced at the level 2 is set as the slice data based on the level 2 are the obtained slice data corresponding to former line is sent. Sequentially, the slice data is sent up to the level n.

Accordingly, regarding the data in the R'0-th former line, the slice data corresponding to former line is sent n times. That is, the amount of the sent slice data is half the amount before division into the sub-shutters. Based on ON/OFF information of each level, only the pixel on the common electrode 810 reflects the data of the segment electrode layer 83 and the light is made to pass therethrough/be cut off.

The slice data represents the ON/OFF information based on the slice level, so that when the control of the whole operation is performed based on the timings of FIG. 23, the light passes therethrough at the level lower than the image data value and is cut off at the level equal to or higher than the image data value. By utilizing this, the light control is performed which reflects the separation color component data gradation of the image data. Similarly, the segment shutter control circuit 412 processes the image data (line) in the R'0-th latter line, the segment shutter control circuit 413 processes that in the R'L-th former line, and the segment shutter control circuit 414 processes that in the R'L-th latter line.

After the completion of processing of the data in the R'0-th former line, the R'0-th latter line, the R'L-th former line, and the R'L-th latter line, the data in the G'0-th former line, that in the G'0-th latter line, that in the G'L-th former line, and that in the G'L-th latter line are separated into the slice data by the segment shutter control circuits 411 to 414 in response to the instruction from the timing circuit 3 and sent to the segment electrode layer 83 of the sub-shutter 800. Only the pixel on the common electrode 810 reflects the data of the segment electrode layer 83, so that the light from the point light source G is made to pass therethrough/be cut off.

Next, the data in the B'0-th former line, that in the B'0-th latter line, that in the B'L-th former line, and that in the B'L-th latter line are separated into the slice data by the segment shutter control circuits 411 to 414 in response to the instruction from the timing circuit 3 and sent to the segment electrode layer 83 of the sub-shutter 800. Only the pixel on the common electrode 810 reflects the data of the segment electrode layer 83, so that the light from the point light source B is made to pass therethrough/be cut off.

Next, the data in the W0-th former line, that in the W0-th latter line, that in the WL-th former line, and that in the WL-th latter line are separated into the slice data by the segment shutter control circuits 411 to 414 in response to the instruction from the timing circuit 3 and sent to the segment electrode layer 83 of the sub-shutter 800. Only the pixel on the common electrode 810 reflects the data of the segment electrode layer 83, so that the light from all of the point light sources R, G, and B is made to pass therethrough/be cut off.

After the completion of processing of the data in the 0th line and the L-th line, the data in the (L+1)th line (denoted by L1 in the figure) as next one line is outputted from the color separation circuit 2 in response to the instruction of the timing circuit 3. A common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. By dividing the shutter 8 into the four sub-shutters 800, the time period required for transferring the slice data in one frame becomes ¼ of that required when no division is made. Accordingly, the display time of one frame becomes ¼ thereof. This operation is performed within a time period where an afterimage of human eyes is available to reproduce the full color image with the gradation. After the completion of the display of one frame, the subsequent frame is displayed and this operation is repeatedly performed to display an animation.

Note that, in the eleventh embodiment, the shutter 8 is divided evenly into the four sub-shutters 800, but may be neither divided into four sub-shutters nor divided evenly. For example, it is divided into two sub-shutters, and the former-segment shutter control circuit 411 may process 128 pixels and the latter-segment shutter control circuit 412 may process 64 pixels. In this case, as for the slice data display time, the highest speed is achieved with the transfer time taken by the former-segment shutter control circuit 411 which is longer.

Also, in the above-mentioned eleventh embodiment, the outputs of the common shutter driver circuit 421 are uniformly connected to all the sub-shutters 800, but the plural common shutter driver circuits 421 may be used to connect each common shutter driver circuit 421 to each sub-shutter 800.

Also, in the above-mentioned eleventh embodiment, the outputs of the common shutter driver circuit 421 are uniformly connected to all the sub-shutters 800 and the common 0 of the common shutter driver circuit 421 is connected to the common electrodes of the first line and the L-th line of the shutter 8. However, as long as there is achieved correspondence with the image data (line) to be transferred, any connection between the common output of the common shutter driver circuit 421 and the common electrode of the shutter 8 is possible.

For example, assuming that four common outputs of the common shutter driver circuit 421 exist with the numbers ranging from 0 to 3, and eight common electrodes of the shutter 8 exist with the number ranging from 0 to 7, the common outputs of the common shutter driver circuit 421 and the common electrodes of the shutter 8 may be connected with each other as follows;

common output 0←→common electrodes 0,7
common output 1←→common electrodes 2,5
common output 2←→common electrodes 1,6
common output 3←→common electrodes 3,4.

In this case, the image data (line) is sent from the color separation circuit 2 in the order of the lines of 0, 2, 1, and 3 and the order of the lines of 7, 5, 6, and 4.

Further, in the eleventh embodiment, the sub-shutters 800 are made to exist continuously both in the segment direction and in the common direction. However, any arrangement may be adopted as long as all the segment electrodes and common electrodes are covered.

For example, assuming that there exist four common outputs of the common shutter driver circuit 421 with the number ranging from 0 to 3, eight common electrodes of the shutter 8 with the number ranging from 0 to 7, four segment outputs of each of the segment shutter driver circuits 411, 412 with the number ranging from 0 to 3, and eight segment electrodes of the shutter 8 with the number ranging from 0 to 7 (it is assumed that the electrodes physically and continuously exist in a numerical order regarding both the common electrodes and the segment electrodes. The order in which 1 is adjacent to 0, and 2 follows next.), the common outputs of the common shutter driver circuit 421 and the common electrodes of the shutter 8, and the segment outputs of the segment shutter driver circuits 411 and 412 and the segment electrodes of the shutter 8 may be connected with each other, respectively, as follows;

common output 0 ←→ common electrode 0, 1
common output 1 ←→ common electrode 2, 3
common output 2 ←→ common electrode 4, 5
common output 3 ←→ common electrode 6, 7,
segment shutter driver circuit 411 output 0 ←→ segment electrode 0
segment shutter driver circuit 411 output 1 ←→ segment electrode 2
segment shutter driver circuit 411 output 2 ←→ segment electrode 4
segment shutter driver circuit 411 output 3 ←→ segment electrode 6
segment shutter driver circuit 412 output 0 ←→ segment electrode 1
segment shutter driver circuit 412 output 1 ←→ segment electrode 3
segment shutter driver circuit 412 output 2 ←→ segment electrode 5
segment shutter driver circuit 412 output 3 ←→ segment electrode 7.

That is, arrangement is made such that two sub-shutters are overlapped with each other. In this case, the image data (line) is sent from the color separation circuit 2 with the scanning order that conforms with the above connection.

As described above, in the eleventh embodiment, the shutter 8 is divided into the sub-shutters 800 to shorten the time required for the transfer of the slice data. Thus, the field sequential color image display apparatus capable of performing high-speed display can be provided.

Further, the sub-shutters 800 are divided with equality or inequality. Thus, in addition to the segment shutter control circuit 411, the common shutter control circuit 421 can be used in a general-purpose manner, which leas to reduction in cost.

Further, the sub-shutters 800 are divided in a physically discontinuous manner, or the scanning order of the common electrodes of the shutter 8 is made variable for each sub-shutter 800. Thus, image display is performed in an irregular order. Therefore, image display with an inconspicuous scanning order of display can be performed.

Twelfth Embodiment

A color image display apparatus in accordance with a twelfth embodiment of the present invention has a block structure shown in FIG. 1 similarly to the first embodiment.

Each block portion is operated as follows. First, regarding the digital color image data 1, three cases are conceivable, which includes a case of inputting the color image data corresponding to RGB in a dot sequential manner, e.g., in the order of RGBRGB, a case of inputting it in a line sequential manner, e.g., in the order of R1st line, G1st line, B1st line, R2nd line, G2nd line, and B2nd line, and a case of inputting it in a field sequential manner, e.g., in the order of R1st field, G1st field, and B1st field. The input order of the digital color image data 1 has a close relationship with a configuration of the color separation circuit 2 described next.

Figure 24:
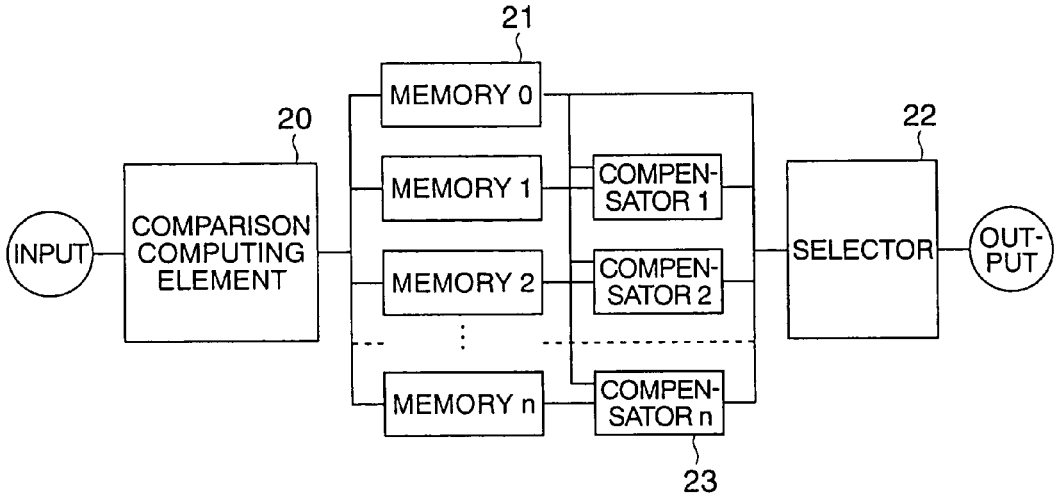
FIG. 24 is a block diagram showing a structure of a color separation circuit 2 in accordance with a twelfth embodiment of the present invention.

Next, the color separation circuit 2 will be described. The color separation circuit 2 in accordance with the twelfth embodiment of the present invention is further provided with a compensator 23 as shown in FIG. 24 compared with the color separation circuit in the first embodiment shown in FIG. 2. The color separation circuit 2 in accordance with the twelfth embodiment is a circuit for separating/accumulating the image data 1 on a subfield basis. Thus, the configuration thereof changes depending on the input order of the digital color image data 1. In FIG. 24, reference numeral 20 denotes a comparison computing element for accumulating the data calculated based on a signal specifying which color component of the subfield corresponds to the digital image data 1 at the present time generated from the timing circuit 3 in the corresponding memory 21.

The number of subfields in the twelfth embodiment is four or more. In the twelfth embodiment, the image data 1 comprised of R, G, and B is separated into four subfields of R', G', B', W. The image data 1 is represented by (R, G, B), and the subfield data is obtained by the following expressions;

$$W=\min(R, G, B)$$

$$R'=R-W$$

$$G'=G-W$$

$$B'=B-W.$$

The memory 21 is a memory capable of accumulating the color component data corresponding to one filed, and the number of prepared memories 21 conforms with that of color components to be accumulated. In the twelfth embodiment, since the four color components of R', G', B', and W are provided, there are provided the four memories 21 assuming that n=3. Here, it is assumed that W data is accumulated into a memory 0. The compensator 23 performs color reproduction compensation based on the memory 0, namely, the W data. A detailed operation thereof will be described with whole operation timings. The selector 22 selects/outputs the color component data accumulated in the memory 21 or the output data from the compensator 23 in accordance with a processing timing of the shutter control circuit 4. The processing timing of the shutter control circuit 4 can be defined using the signal generated from the timing circuit 3.

Next, the shutter control circuit 4 will be described. The shutter control circuit 4 separates the (multivalued) color component data corresponding to one field outputted from the color separation circuit 4 into (binary) slice data, and based on the slice data, the shutter 8 is controlled. The shutter control circuit 4 in the twelfth embodiment has a structure of the block diagram shown in FIG. 3 similarly to the first embodiment. In FIG. 3, the slice circuit 40 outputs the binary slice data, with which the inputted color component data corresponding to one field is regarded as OFF slice data when the data is at a certain slice level (Level n) or lower and otherwise as ON slice data. The value of the Level n varies depending on the signal from the timing circuit 3. As a result, the color component data corresponding to one field is divided into the plural slice data and outputted.

A concept thereof is shown in FIG. 4 as in the first embodiment. A signal value inputted into the slice circuit 40 from the color separation circuit 2 supposedly takes a value ranging from 0 to 255. When the slice level Level n is set based on the signal from the timing circuit 3, in the case where the signal at a level of 0 to less than Level n is inputted, the OFF slice data is outputted, whereas in the case where the signal at a level of the Level n or more to 255 is inputted, the ON slice data is outputted. When based on the signal from the timing circuit 3, the above setting is changed to Level n+1, in the case where the signal at a level of 0 to less than Level n+1 is inputted, the OFF slice data is outputted, whereas in the case where the signal at a level of Level n+1 or more to 255 is inputted, the ON slice data is outputted.

Also, similarly to the first embodiment, the driver circuit 41 shown in FIG. 3 performs ON/OFF control of the shutter 8 based on the ON/OFF state of the slice data. Performed in this circuit are voltage level conversion required for driving the shutter 8 and AC conversion.

Next, the light source control circuit 5 will be described. The light source control circuit 5 is composed of the drive voltage generating circuit 50 and the switch 51 shown in FIG. 5, similarly to the first embodiment. The power source used in the drive voltage generating circuit 50 is inputted to an input thereof. The drive voltage generating circuit 50 converts a power source voltage to a light source drive voltage as necessary. Based on the signal from the timing generating circuit 3, the switch 51 is used to turn ON/OFF the drive voltage of the corresponding light source 6. In the twelfth embodiment, the digital image data 1 is separated into the four color component data of R', G', B', and W while the three light sources of R, G, and B are used. Thus, the three switches 51 are provided assuming that n=2.

Also, the switch 51 operates as follows. During a section for which the R' component data is outputted from the color separation circuit 2 to drive the shutter through the shutter control circuit 4, the switch for driving the R light source is turned ON and the other switches are turned OFF. In the case of the G' component data, the switch for driving the G light source is turned ON and the other switches are turned OFF. In the case of the B' component data, the switch for driving the B light source is turned ON and the other switches are turned OFF. In the case of the W component data, the switches for driving all the light sources of R, G, and B are turned ON.

As shown in FIG. 6, the light source 6 is composed of the light sources 60 in m colors as in the first embodiment. In the twelfth embodiment, the light source is composed of the light sources 60 in m colors, m being different from n that defines the number of color component data. That is, the four color-components are used assuming that n=3, and the light sources in three colors are used assuming that m=2. Also, the light sources 60 are assumed as point light sources. A light emission wavelength of the light source 60 in any range may be adopted as long as the wavelength falls within the wavelength region corresponding to the color component data.

Next, a description will be given of the converting device 7 with reference to FIG. 7 similarly to the first embodiment. In FIG. 7, the point-surface converting device 70 for converting the point light source 60 to a surface light source is manufactured by using acrylic resin or the like as a material therefor and changing a reflectivity of a plate-like device within the plate or stacking thin plates stepwise.

Subsequently, a description will be given of the shutter 8 with reference to FIG. 8 as in the first embodiment. The shutter 8 takes a laminate structure. In the figure, the polarizing plate A layer 80, the common electrode layer 81, the liquid crystal layer 82, the segment electrode layer 83, and the polarization B layer 84 are laminated in this order from the top. Although not shown in the figure, they are laminated on a hard plate such as glass serving as a substrate. The polarizing plate A layer 80 and the polarization B layer 84 are laminated so as to be orthogonal or parallel to each other to form the polarization plane. The common electrode layer 81 and the segment electrode layer 83 are transparent electrodes orthogonal to each other and an intersecting point thereof serves as a display pixel. In the figure, twenty pixels of four rows of the common electrodes and five columns of the segment electrodes can be displayed. The segment-common voltage is turned ON/OFF with a phase transition voltage of liquid crystal interposed therebetween, so that the phase transition of the liquid crystal corresponding to the pixel occurs and the light passed through the polarizing plate A layer 80, the liquid crystal layer 82, and the polarization B layer 84 is made to pass therethrough/be cut off.

As described above, information on the image data 1 is sent to the shutter 8 through the color separation circuit 2 and the shutter control circuit 4. Also, the light from the light source 8 is converted to the surface light source light using the converting device 7 and an R light, a G light, and a B light are irradiated to the shutter 8. Thus, the image data 1 is displayed as the color displayed image 9 in a filterless manner.

Next, gradation control will be described with reference to whole operation timings.

Figure 25:
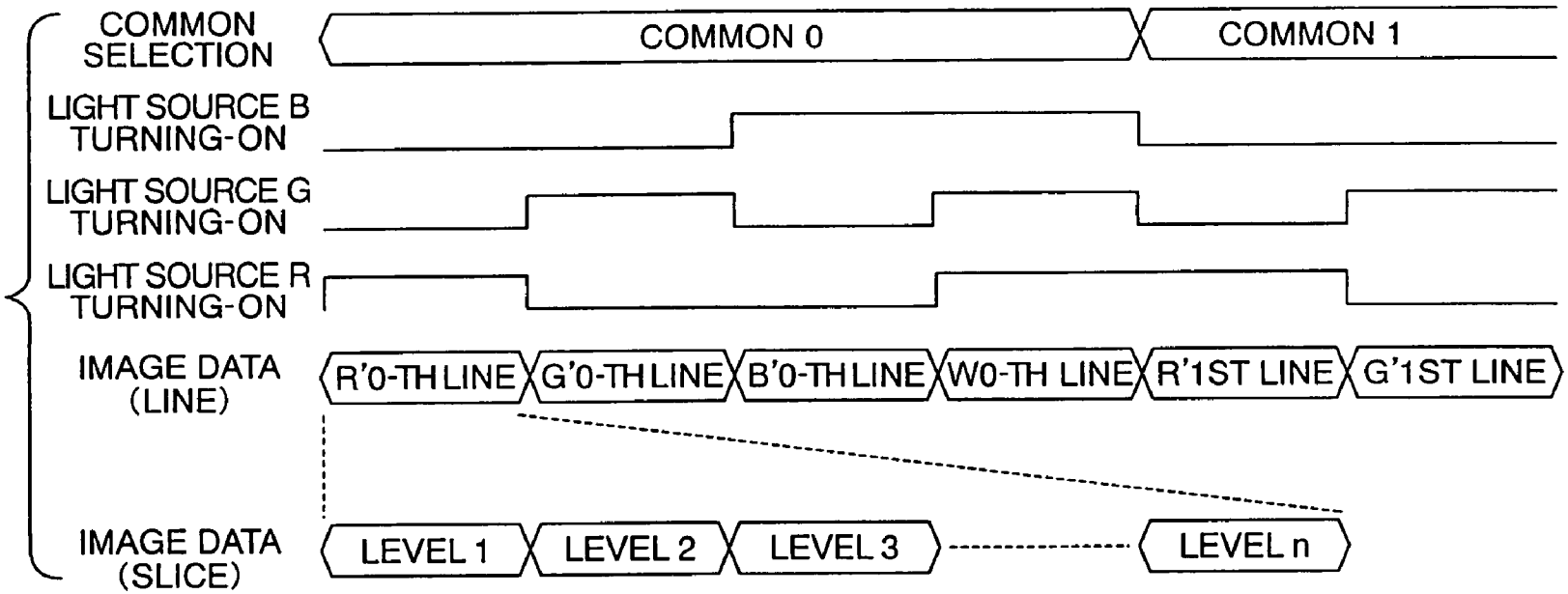
FIG. 25 is an operation timing chart of gradation control in accordance with the twelfth embodiment of the present invention.

FIG. 25 is a general timing chart of the twelfth embodiment. This timing is generated by the timing circuit 3, which corresponds to a timing at which each block is operated. In response to an instruction from the timing circuit 3, while the data in 0th line is outputted from the color separation circuit 2 (in the figure, while the image data in the R'0-th line, G'0-th line, B'0-th line, and W0-th line is used), a common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R'0-th line, the data in the G'0-th line, the data in the B'0-th line, and the data in the W0-th line are being outputted from the color separation circuit 2, the point light source R, the point light source G, the point light source B, and all the point light sources R, G, and B are turned on, respectively.

The image data (line) is separated into the slice data by the shutter control circuit 4 in response to the instruction from the timing circuit 3 and sent to the segment electrode layer 83 of the shutter 8. In the figure, the data of Level 1 to the data of Level n are sent to the driver circuit 41 from the slice circuit 40 on a line basis. That is, the data in the R'0-th line sliced at the Level 1 is set as the slice data based on the Level 1 and the obtained slice data corresponding to one line is sent. Following this, the data in the R'0-th line sliced at the Level 2 is set as the slice data based on the Level 2 and the obtained slice data corresponding to one line is sent. Sequentially, the slice data is sent up to the Level n.

Accordingly, regarding the data in the R'0-th line, the slice data corresponding to one line is sent n times. Based on ON/OFF information of each level, only the pixel on the common electrode 810 reflects the data of the segment electrode layer 83 and the light is made to pass therethrough/be cut off. The slice data represents the ON/OFF information based on the Level n, so that when the control of the whole operation is performed based on the timings of FIG. 25, the light passes therethrough at the level lower than the image data value and is cut off at the level equal to or higher than the image data value. The light is controlled which reflects the gradation of the separation color component data of the image data. Further, the time width of each level is made variable, thereby performing the gradation control for each level.

After the completion of processing of the data in the R'0-th line, the data in the G'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Next, the data in the B'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source B is made to pass therethrough/be cut off.

Next, the data in the W0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from all the point light sources R, G, and B is made to pass therethrough/be cut off After the completion of processing of the data in the 0th line, the data in the first line is outputted from the color separation circuit 2 in response to the instruction from the timing circuit 3. A common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

Figure 26:
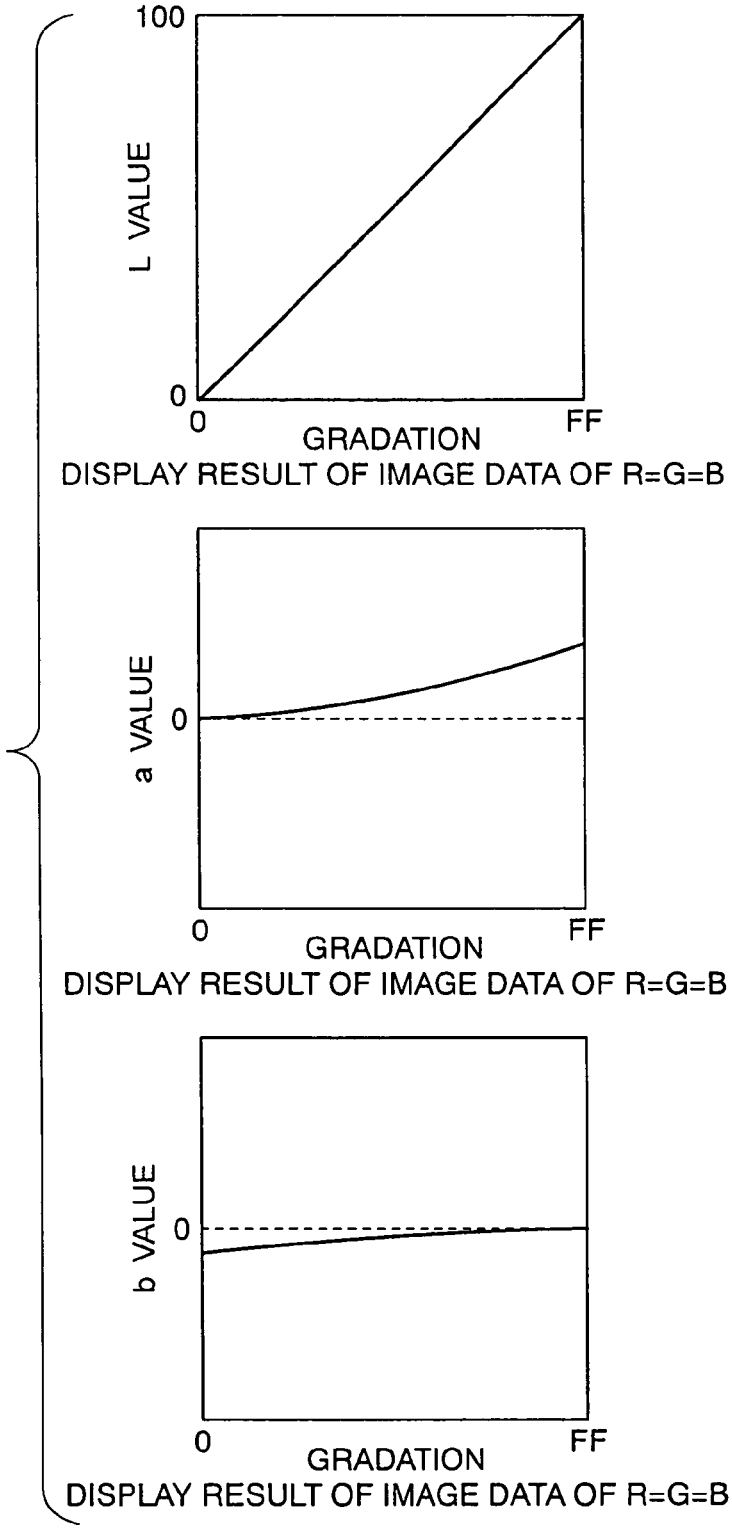
FIG. 26 is an explanatory diagram showing color reproduction characteristics of a color image apparatus, the diagram showing display results of a gray scale that gradually changes from black to white.

The twelfth embodiment has its characteristic in the compensator 23 of the color separation circuit 2. The characteristic will be described in more detail. FIG. 26 represents color reproduction characteristics of a general color image apparatus, and shows display results of a gray scale that gradually changes from black to white. L, a*, and b* each represent a color coordinate system, where the correspondence between a coordinate value and a color is clearly defined. An achromatic color is a color represented by a*=b*=0. However, as seen from FIG. 26, a*=b*=0 is difficult to be realized with respect to all the image data of R=G=B.

This is because physical properties of the RGB light sources, the liquid crystal, and the like are complicatedly involved with each other. In the twelfth embodiment, the achromatic color is satisfactorily realized by using the compensator 23 of the color separation circuit 2. The color reproduction characteristics of the color image apparatus are measured in advance, and the R', G', and B' values indicating the a*b* values symmetrical, with respect to a*=b*=0, to the a*b* values of the measured gray scale are stored in the compensator 23 for each gradation value (equal to the gradation value of W) of the gray scale.

Figure 27:
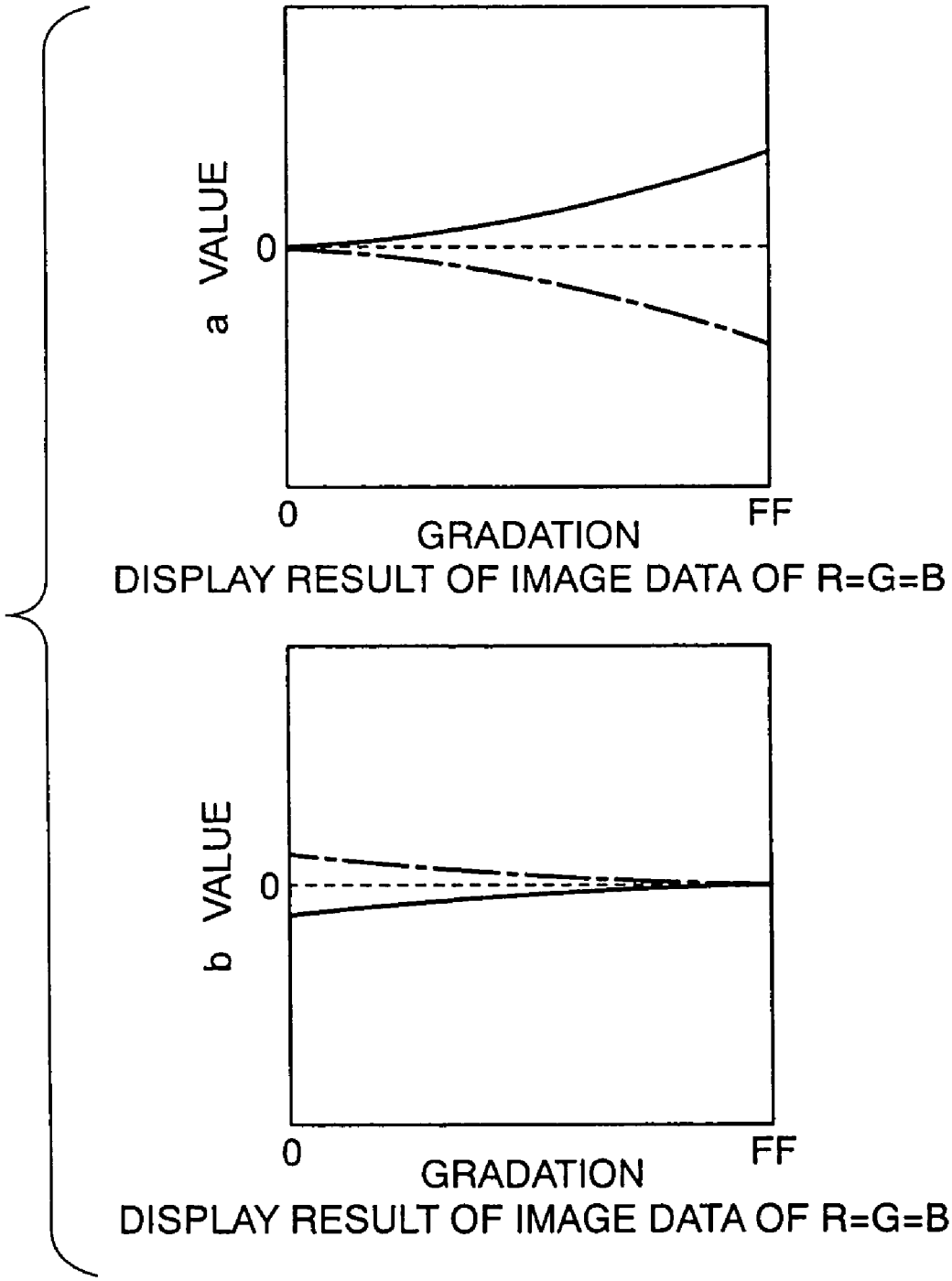
FIG. 27 is an explanatory diagram showing a* and b* values symmetrical with respect to a*=b*=0 as to the results of FIG. 26.

FIG. 27 shows a* and b* values symmetrical with respect to a*=b*=0 regarding the results of FIG. 26. A solid line indicates a measured value, and a dash-dotted line indicates the a* or b* value symmetrical with respect to a*=b*=0. The R', G', and B' values indicating each of the a* and b* values are stored in the compensator 23 for each gradation value of the gray scale.

At the time of color reproduction, the color component of the image data 1 of R=G=B is only the W component, and the R', G', and B' components do not develop in the comparison computing element 20. On the other hand, upon the reception of the value of the W component in the compensator 23, R' (compensation value), G' (compensation value), and B' (compensation value) stored in the compnesator 23 with respect to the gradation of W are called up. Thus, image reproduction with the four component values of W, R' (compensation value), G' (compensation value), and B' (compensation value) is performed with respect to the image data 1 of R=G=B. The a* and b* values of the color reproduced with R' (compensation value), G' (compensation value), and B' (compensation value) are symmetrical to the a* and b* values of the color reproduced with W with respect to a*=b*=0.

Thus, a*=b*=0 is obtained by performing vector addition (time color-mixture), thereby reproducing a satisfactory achromatic color. Since the same operation is performed to the image data other than the image data of R=G=B, an image with a balanced gray scale including half tones can be reproduced for the whole of a reproduction color space.

As described above, in the twelfth embodiment, the emitted light intensity of each light source is fixed at the time of single color light emission and at the time of full color light emission (at the time of light emission corresponding to R' and at the time of light emission corresponding to W, and the like) but may be controlled independently for each light source. For example, the emitted light intensity of the R light source upon the R' control is represented by PR and the emitted light intensity of the R light source upon the W control is represented by PRW (PR≠PRW).

Also, in the twelfth embodiment, the light emission corresponding to W is performed through full color light emission. However, the white light source may be adopted and used at the time of displaying the slice data corresponding to the W component.

Also, the light emission wavelength of the light source 60 is set so as to fall within the wavelength region corresponding to the color component data, but the light source in one color may be achieved by using the plural light sources. For example, the two light sources with peak wavelengths of 700 nm and 750 nm may be used to achieve the light source in one color corresponding to the R component.

Also, the liquid crystal used in the liquid crystal display panel 2 may be either active type liquid crystal or passive type liquid crystal. As specific examples of the liquid crystal, TFT type liquid crystal, STN type liquid crystal, and TN type liquid crystal can be given.

Also, when the function corresponding to the color separation circuit 2 is provided on a transfer source of the image data 1, it is possible to dispense with the color separation circuit 2.

As described above, in the twelfth embodiment, the image data 1 is separated into the achromatic color component (W) and the chromatic color components (R', G', and B') in the color separation circuit 2, and the light sources 6 corresponding to the components are turned on. Thus, the gradation control can be performed separately for the achromatic color components and the chromatic color components.

Further, the color reproduction characteristics of the color image apparatus are measured in advance, and the R', G', and B' values indicating the a*b* values symmetrical, with respect to a*=b*=0, to the a*b* values of the measured gray scale are stored in the compensator 23 for each gradation value (equal to the gradation value of W) of the gray scale. The compensation data is added to the image data 1 at the time of reproduction. Thus, an image with a balanced gray scale including half tones can be reproduced.

Also, an operation in which the R light source, the G light source, and the B light source are simultaneously allowed to emit light to obtain a white light, i.e., spatial color mixture is performed. Thus, as compared with an operation in which the white light is made from an afterimage obtained by shifting the light emission time that features the field sequential method, i.e, temporal color mixture, the chromatic color mixture is achieved in a complete form.

Also, the light emission corresponding to W is made through the full color light emission, so that the brightness increases over the entire field, which can make the screen bright as compared with the case of reproducing the image only through the single color light emission.

Further, the slice data according to the Level n is outputted from the shutter control circuit 4 and the shutter 8 makes the light pass therethrough/be cut off on a line basis, so that the full color image with the gradation can be reproduced. Also, because of the control on a line basis, the number of pixel selection drivers can be reduced and a field sequential color image display apparatus can be provided at low cost.

Further, the slice data display time is made variable according to the slice level, so that the gradation control for each level is possible.

Moreover, since the light source 6 is converted from the point light source to the surface light source by the converting device 7, the number of light sources to be used can be made small. Further, the display pixel size can be increased irrespective of the number of light sources as well as the field sequential color image display apparatus can be provided at low cost.

Thirteenth Embodiment

In the above-described twelfth embodiment, as shown in FIG. 24, the R', G', and B' values indicating the a*b* values symmetrical, with respect to a*=b*=0, to the a*b* values of the gray scale which are measured in advance are stored in the compensator 23 for each gradation value (equal to the gradation value of W) of the gray scale, and the compensation data is added to the image data 1 at the time of reproduction. However, there is shown here an embodiment in which a reproduction color itself is compensated.

In the thirteenth embodiment, the timing of the timing circuit 4 is changed without using the compensator 23 of the color separation circuit 2 shown in FIG. 24. The lighting time of the light source 6 is made to match with the target color reproduction characteristics.

Figure 28:
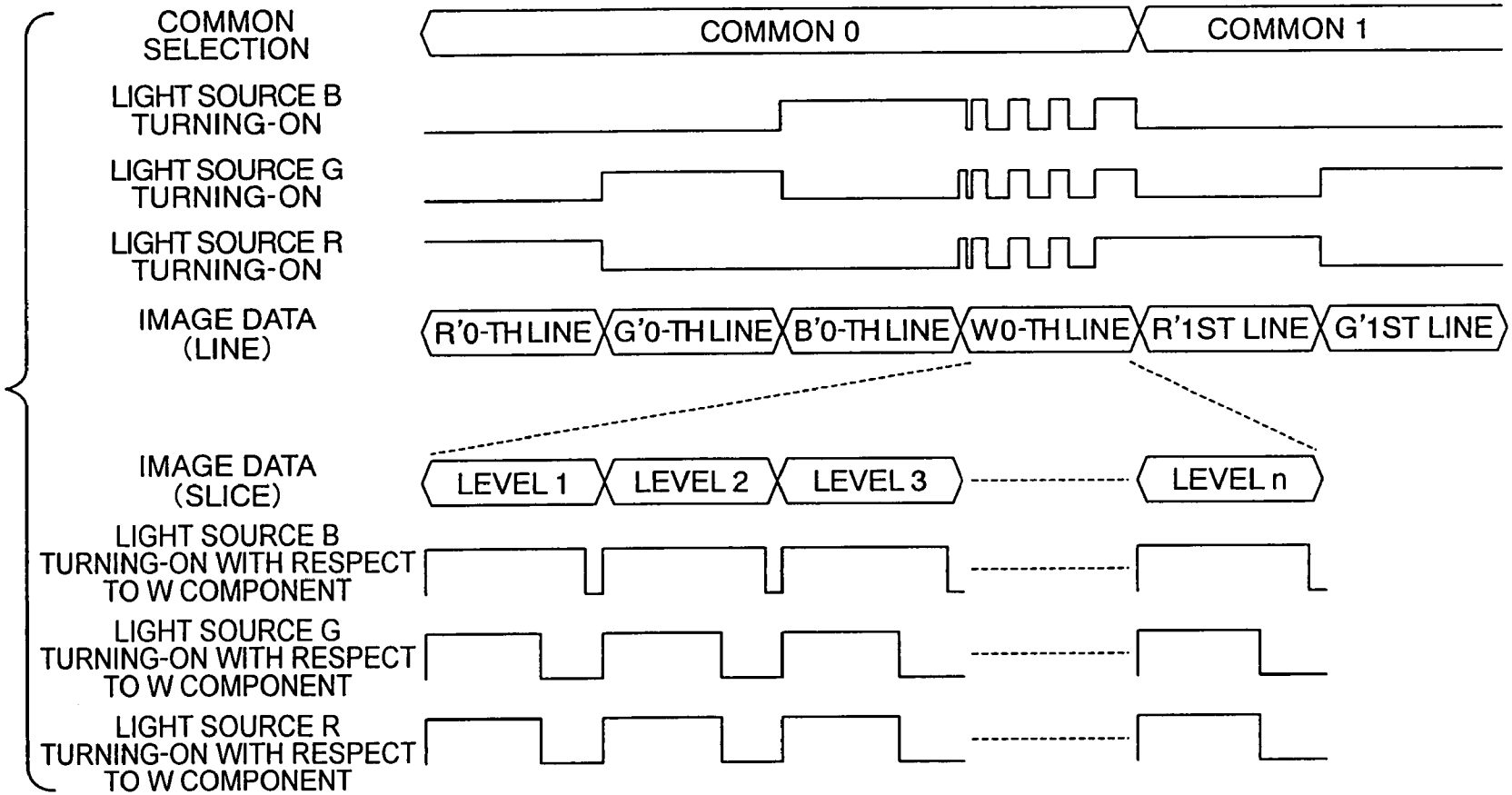
FIG. 28 is an operation timing chart of gradation control in accordance with a thirteenth embodiment of the present invention.

FIG. 28 is a general timing chart of the thirteenth embodiment. This timing is generated by the timing circuit 3, which corresponds to a timing at which each block is operated. In response to an instruction from the timing circuit 3, while the data in 0th line is outputted from the color separation circuit 2 (in the figure, while the image data in the R'0-th line, G'0-th line, B'0-th line, and W0-th line is used), a common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R'0-th line, the data in the G'0-th line, the data in the B'0-th line, and the data in the W0-th line are being outputted from the color separation circuit 2, the point light source R, the point light source G, the point light source B, and all the point light sources R, G, and B are repeatedly turned on and off, respectively. Description thereof is further made using FIG. 28. The timing is one at which the lighting time of the light source for each slice level with respect to the W component is changed separately for the R, G, and B light sources and at which the reproduced color meets a*=b*=0. Thus, the reproduction color of the W component is a color that satisfies a*=b*=0. In the figure, turning-off times are provided for all the light sources. However, no turning-off time may be provided as long as the condition that attains a*=b*=0 is satisfied.

The image data (line) is separated into the slice data by the shutter control circuit 4 in response to the instruction from the timing circuit 3 and sent to the segment electrode layer 83 of the shutter 8. In the figure, the data of Level 1 to the data of Level n are sent to the driver circuit 41 from the slice circuit 40 on a line basis. Then, based on ON/OFF information of each level, only the pixel on the common electrode 810 reflects the data of the segment electrode layer 83 and the light is made to pass therethrough/be cut off. The slice data represents the ON/OFF information based on the Level n, so that when the control of the whole operation is performed based on the timings of FIG. 28, the gradation control is performed by utilizing the fact that the light passes at the level lower than the image data value and is cut off at the level equal to or higher than the image data value. The light passes only in the period during which the light source is turned on regarding W.

After the completion of processing of the data in the R'0-th line, the data in the G'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Next, the data in the B'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source B is made to pass therethrough/be cut off. Next, the data in the W0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from all the point light sources R, G, and B in the lighting time is made to pass therethrough/be cut off.

After the completion of processing of the data in the 0th line, the data in the first line is outputted from the color separation circuit 2 in response to the instruction of the timing circuit 3. The common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available, thereby being capable of reproducing the full color image with the gradation. After the completion of the display of one frame, the subsequent frame is displayed and this operation is repeatedly performed to display an animation.

As described above, in the thirteenth embodiment, the lighting times for the R, G, and B light sources of the light source 6 are determined by the timing circuit 3 such that the reproduction color of each slice level to the W component satisfies a*=b*=0. Thus, an image with a balanced gray scale including half tones can be reproduced.

Fourteenth Embodiment

In the above-described twelfth and thirteenth embodiments, reproducibility of an achromatic color is improved by using the compensator 23 and the timing circuit 4; on the contrary, there is shown here an embodiment in which target gamma characteristics are designed.

In the fourteenth embodiment, the timing of the timing circuit 4 is changed without using the compensator 23 of the color separation circuit 2 shown in FIG. 24. The lighting time of the light source 6 is made to match with the target color reproduction characteristics, and also, the display time of each slice level is made to match with the gamma characteristics.

Figure 29:
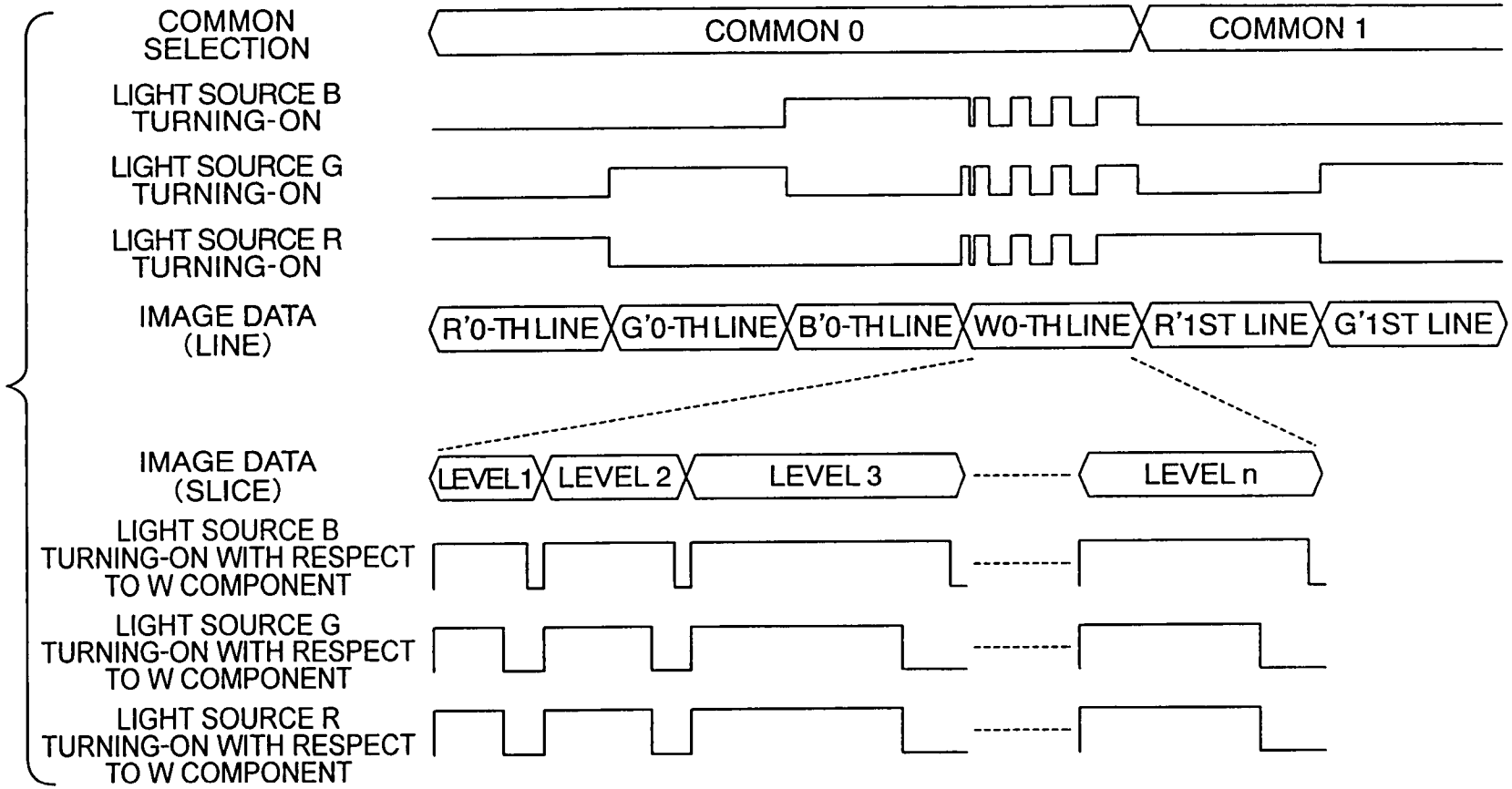
FIG. 29 is an operation timing chart of gradation control in accordance with a fourteenth embodiment of the present invention.

FIG. 29 is a general timing chart of the fourteenth embodiment. This timing is generated by the timing circuit 3, which corresponds to a timing at which each block is operated. In response to an instruction from the timing circuit 3, while the data in 0th line is outputted from the color separation circuit 2 (in the figure, while the image data in the R'0-th line, G'0-th line, B'0-th line, and W0-th line is used), a common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R'0-th line, the data in the G'0-th line, the data in the B'0-th line, and the data in the W0-th line are being outputted from the color separation circuit 2, the point light source R, the point light source G, the point light source B, and all the point light sources R, G, and B are repeatedly turned on and off, respectively. Description thereof is further made using FIG. 29. The timing is one at which the lighting time of the light source of each slice level to the W component is changed separately for the R, G, and B light sources and at which the reproduced color meets a*=b*=0. Thus, the reproduction color of the W component is a color that satisfies a*=b*=0. In the figure, turning-off times are provided for all the light sources. However, no turning-off time may be provided as long as the condition that attains a*=b*=0 is satisfied.

The image data (line) is separated into the slice data by the shutter control circuit 4 in response to the instruction from the timing circuit 3 and sent to the segment electrode layer 83 of the shutter 8. In the figure, the data of Level 1 to the data of Level n are sent to the driver circuit 41 from the slice circuit 40 on a line basis. Then, based on ON/OFF information of each level, only the pixel on the common electrode 810 reflects the data of the segment electrode layer 83 and the light is made to pass therethrough/be cut off. The display time of the slice level is made the same for R', G', and B', but regarding W, the display time of the slice level is made variable as shown in FIG. 29.

Figure 30:
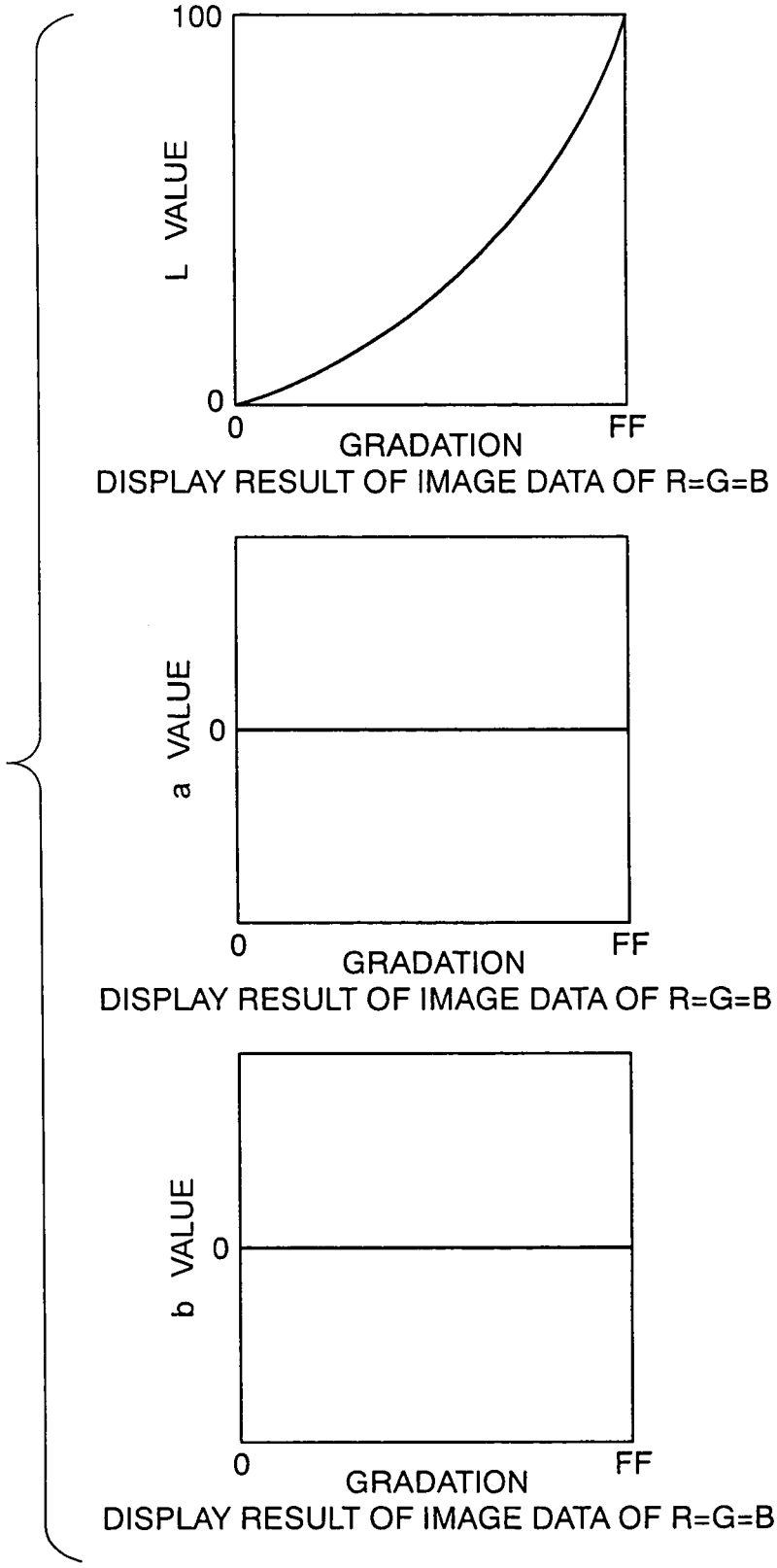
FIG. 30 is an explanatory diagram of color reproduction with respect to image data 1 of R=G=B.

The slice data represents the ON/OFF information based on the Level n, so that when the control of the whole operation is performed based on the timings of FIG. 29, the gradation control is performed by utilizing the fact that the light passes at the level lower than the image data value and is cut off at the level equal to or higher than the image data value. Regarding W, the color is reproduced which has characteristics shown in FIG. 30 with respect to the image data 1 of R=G=B since the display time of the slice level differs and since the reproduction color at each slice level satisfies a*=b*=0. The display time of each slice level is changed in various ways, thereby obtaining characteristics that fit the purposes, such as characteristics in which a gamma of the L* value is set to 1 or more, S-characteristics or inverted S-characteristics.

After the completion of processing of the data in the R'0-th line, the data in the G'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Next, the data in the B'0-th line is separated into the slice data by the shutter control circuit 4 in response to the instruction from the timing circuit 3 and sent to the segment electrode layer 83 of the shutter 8. Only the pixel on the common electrode

810 reflects the data of the segment electrode layer 83, so that the light from the point light source B is made to pass therethrough/be cut off.

Next, the data in the W0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from all the point light sources R, G, and B in the lighting time is made to pass therethrough/be cut off.

After the completion of processing of the data in the 0th line, the data in the first line is outputted from the color separation circuit 2 in response to the instruction of the timing circuit 3. The common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

As described above, in the fourteenth embodiment, the lighting times for the R, G, and B light sources of the light source 6 are determined by the timing circuit 4 such that the reproduction color of each slice level to the W component satisfies a*=b*=0. Further, the display time of each slice level is determined to match with the target gamma characteristics. Thus, an image can be reproduced which has a balanced gray scale including half tones and in which the characteristics of the L* value are controlled.

Fifteenth Embodiment

In the above-described twelfth, thirteenth, and fourteenth embodiments, the reproducibility and the gamma characteristics of the achromatic color are improved by using the compensator 23 and the timing circuit 4; on the contrary, there is shown here an embodiment in which target gamma characteristics of the chromatic color are designed.

In the fifteenth embodiment, the timing of the timing circuit 4 is changed, and the display time of each slice level with respect to the chromatic color component of the light source 6 is made to match with desired gamma characteristics.

Figure 31:
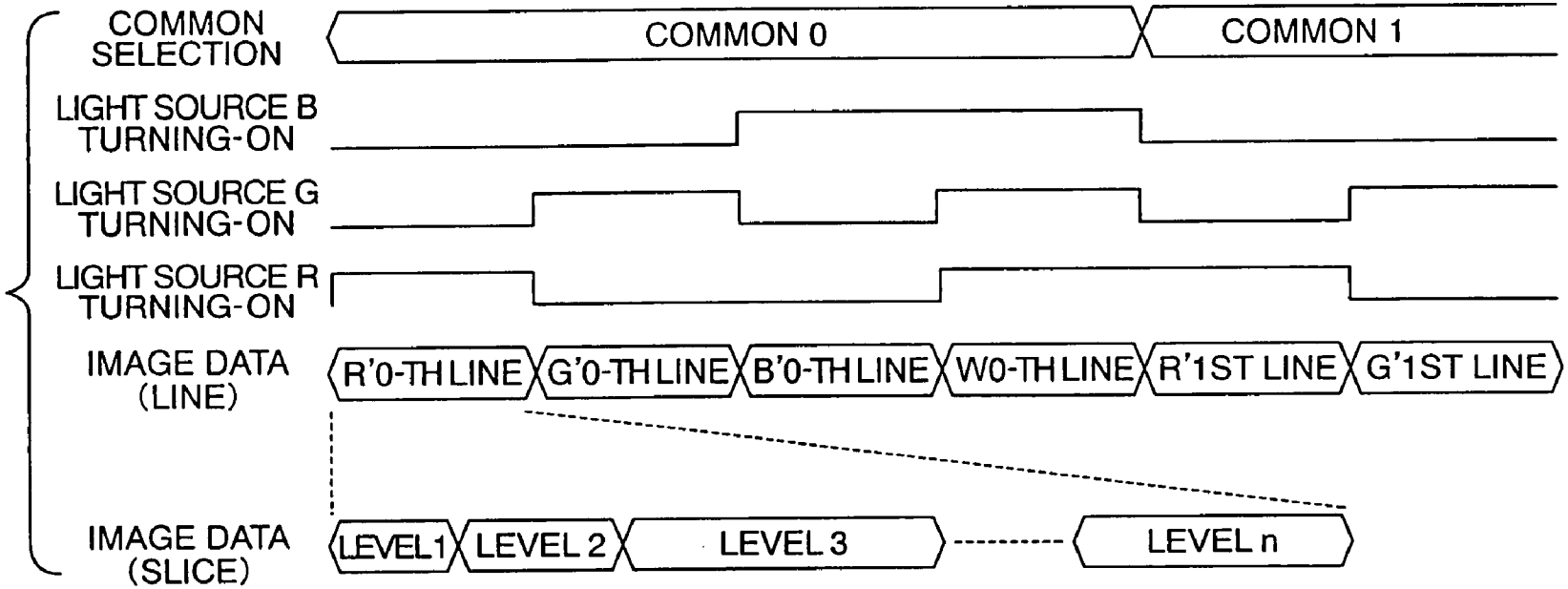
FIG. 31 is an operation timing chart of gradation control in accordance with a fifteenth embodiment of the present invention.
Figure 32:
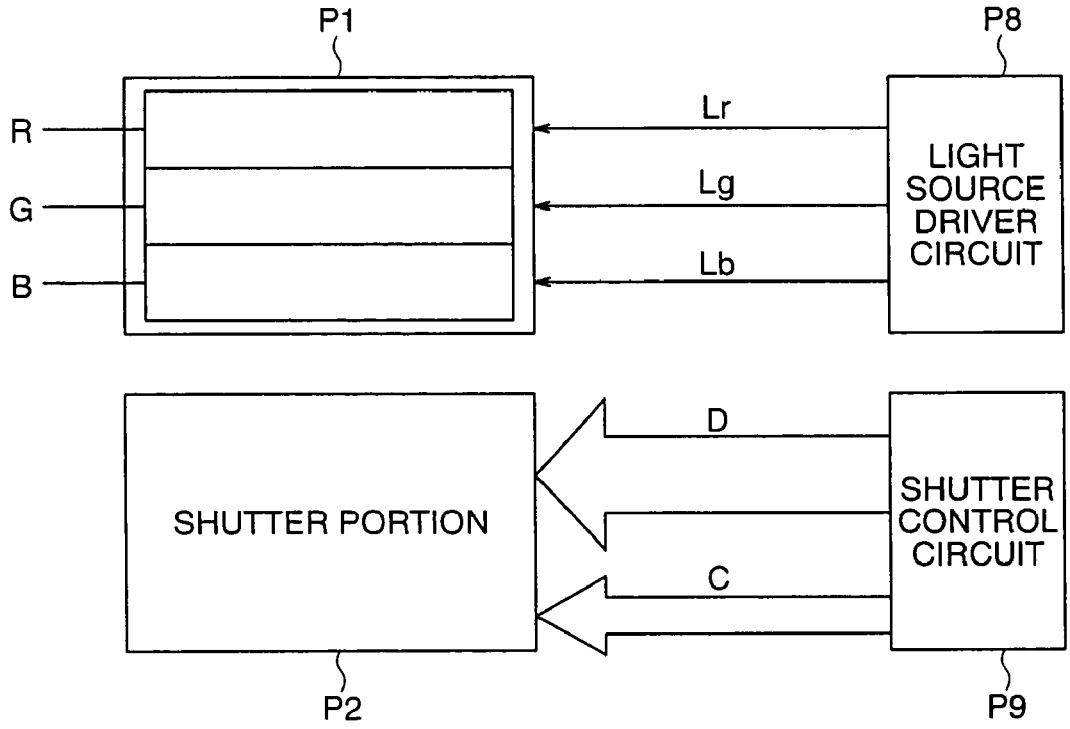
FIG. 32 is a block diagram of a conventional field sequential color display apparatus disclosed in JP 09-274471 A.
Figure 33:
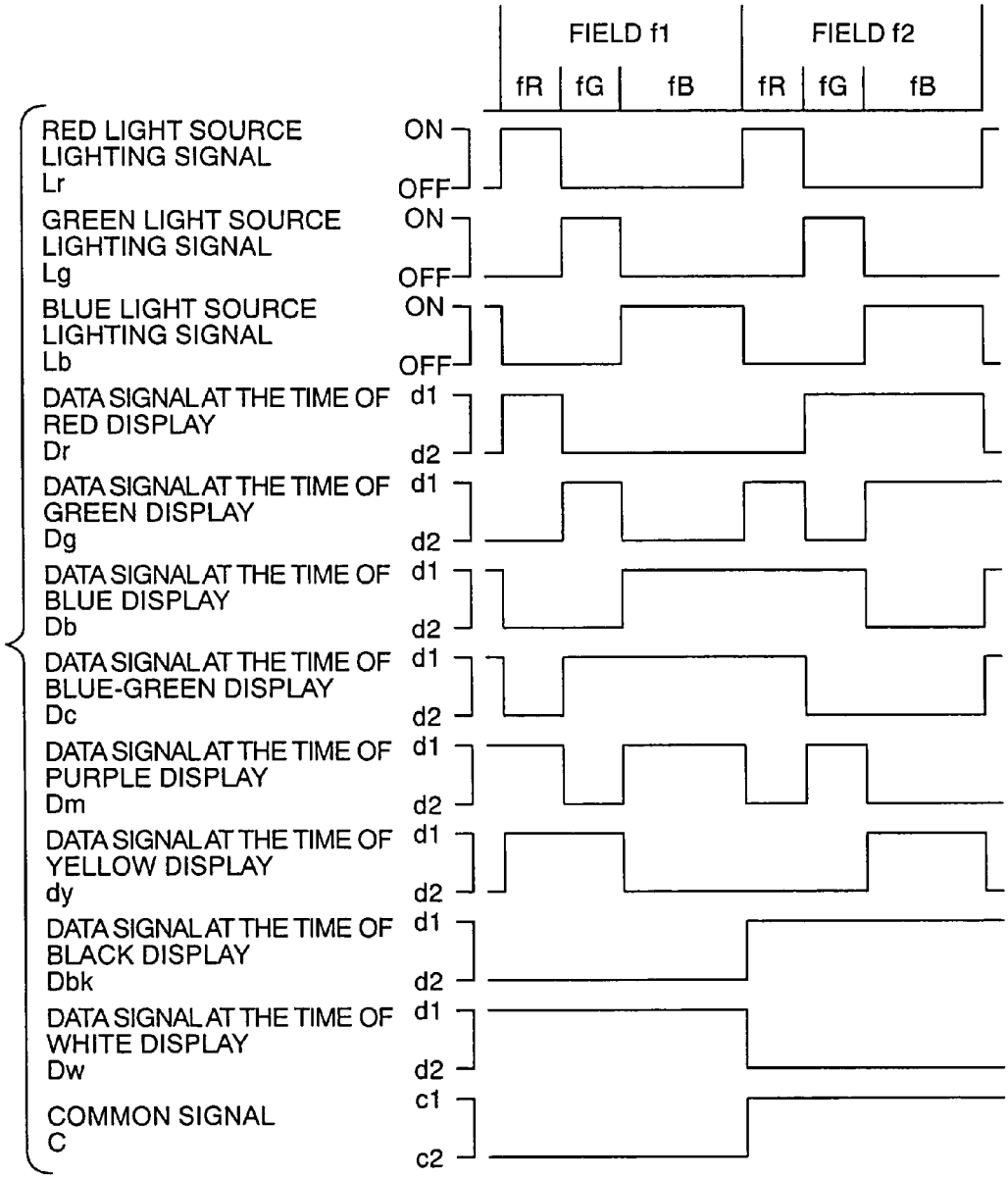
FIG. 33 is a diagram showing a waveform of each signal in a conventional field sequential color display apparatus.
Figure 34:
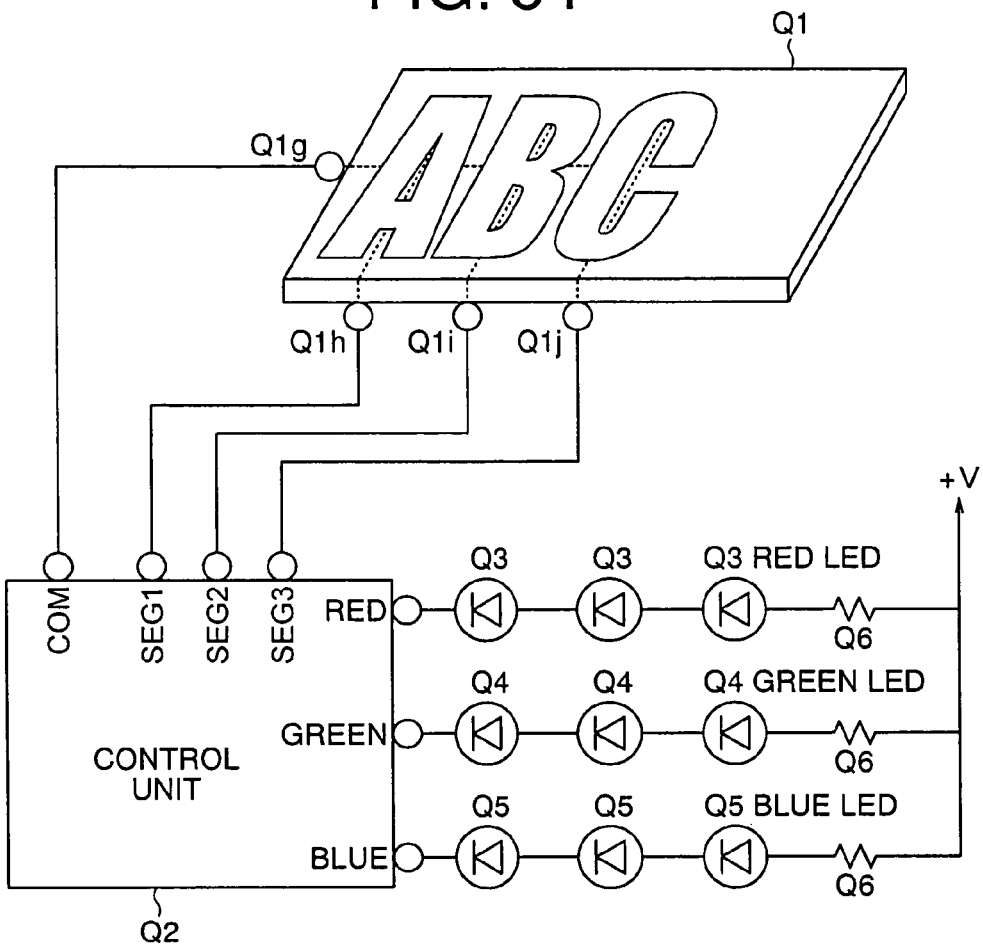
FIG. 34 is a block diagram showing a structure of a conventional liquid crystal multi-color display apparatus disclosed in JP 08-234159 A.
Figure 35:
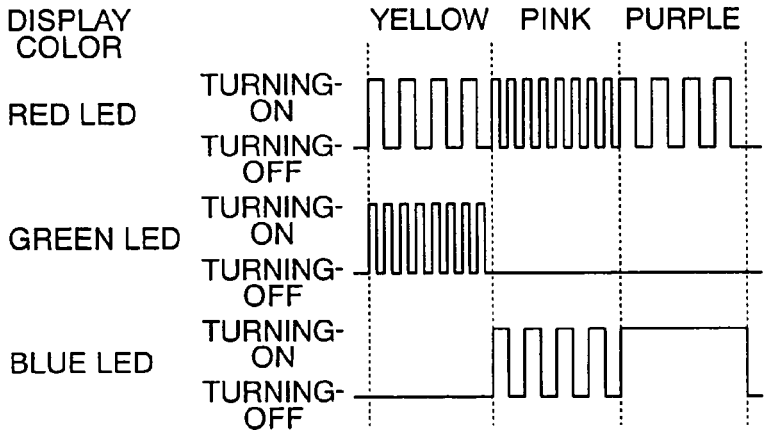
FIG. 35 is a chart showing a lighting timing of an LED at the time of multi-color display of the liquid crystal multi-color display apparatus shown in FIG. 34.
Figure 36:
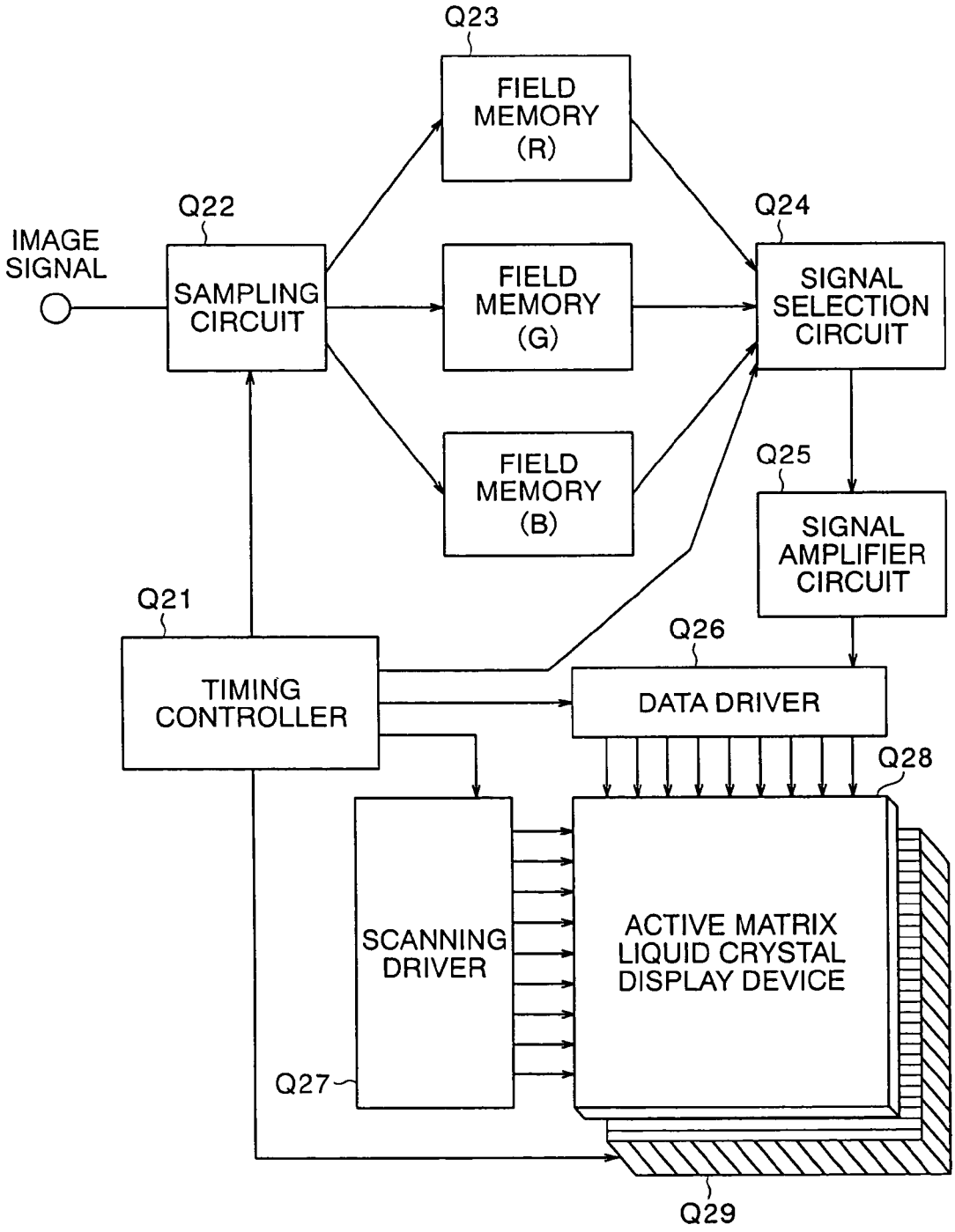
FIG. 36 is a circuit block diagram of a conventional time-division color liquid crystal display apparatus and driving method thereof disclosed in JP 07-121138 A.
Figure 37:
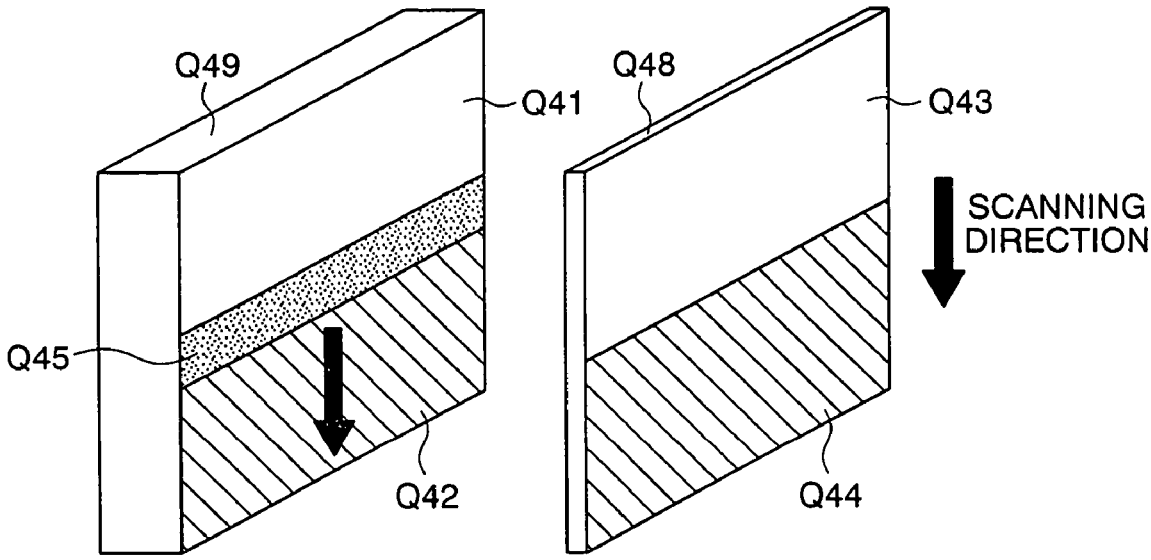
FIG. 37 is an explanatory diagram in which a non-light emitting region Q45 is provided between a green light emitting region Q41 and a red light emitting region Q42 of a time-division three primary colors light emitting device Q49.

FIG. 31 is a general timing chart of the fifteenth embodiment. This timing is generated by the timing circuit 3, which corresponds to a timing at which each block is operated. In response to the instruction from the timing circuit 3, while the data in the 0th line is outputted from the color separation circuit 2 (in the figure, while the image data in the R'0-th line, G'0-th line, B'0-th line, and W0-th line is used), a common 0 is selected in the common electrode. To explain it using FIG. 8, the common electrode 810 is selected and the other common electrodes are put in a non-selection state. That is, only the pixel on the common electrode 810 reflects the data of the segment electrode layer 83 and the pixels on the other common electrodes are brought into a light shielded state irrespective of the data of the segment electrode layer 83.

In response to the instruction from the timing circuit 3, when the data in the R'0-th line, the data in the G'0-th line, the data in the B'0-th line, and the data in the W0-th line are being outputted from the color separation circuit 2, the point light source R, the point light source G, the point light source B, and all the point light sources R, G, and B are turned on, respectively.

The image data (line) is separated into the slice data by the shutter control circuit 4 in response to the instruction from the timing circuit 3 and sent to the segment electrode layer 83 of the shutter 8. In the figure, the data of Level 1 to the data of Level n are sent to the driver circuit 41 from the slice circuit 40 on a line basis. Then, based on ON/OFF information of each level, only the pixel on the common electrode 810 reflects the data of the segment electrode layer 83 and the light is made to pass therethrough/be cut off. The display time of each slice level is made the same for W, but regarding R', G', and B', the display time of each slice level is made variable as shown in FIG. 31.

The slice data represents the ON/OFF information based on the Level n, so that when the control of the whole operation is performed based on the timings of FIG. 31, the gradation control is performed by utilizing the fact that the light passes at the level lower than the image data value and is cut off at the level equal to or higher than the image data value. Regarding R', G', and B', the color is reproduced which has variation characteristics of various L* values since the display time of the slice level differs. The display time of each slice level is changed in various ways, thereby obtaining characteristics that fit the purposes, such as characteristics in which a gamma of the L* value is set to 1 or less, 1, or 1 or more, S-characteristics or inverted S-characteristics.

After the completion of processing of the data in the R'0-th line, the data in the G'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source G is made to pass therethrough/be cut off. Next, the data in the B'0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from the point light source B is made to pass therethrough/be cut off. Next, the data in the W0-th line is separated into the slice data by the shutter control circuit 4 in response to the instruction from the timing circuit 3 and sent to the segment electrode layer 83 of the shutter 8. Only the pixel on the common electrode 810 reflects the data of the segment electrode layer 83, so that the light from all the point light sources R, G, and B is made to pass therethrough/be cut off.

After the completion of processing of the data in the 0th line, the data in the first line is outputted from the color separation circuit 2 in response to the instruction of the timing circuit 3. The common electrode 811 is selected and the other common electrodes are put in a non-selection state. Hereinafter, in a like manner, the light source 6 and the shutter circuit 4 are controlled. Only the pixel on the common electrode 811 reflects the data of the segment electrode layer 83 and the light from the corresponding light source is made to pass therethrough/be cut off.

This operation is sequentially repeated up to the final common electrode where display of one frame is completed. This operation is performed within a time period where an afterimage of human eyes is available to reproduce the full color image with the gradation. After the completion of the display of one frame, the subsequent frame is displayed and this operation is repeatedly performed to display an animation.

Note that, although the display time of the slice level is made variable for all R', G', and B' in the fifteenth embodiment, the display time may be partially made variable depending on purposes.

As described above, in the fifteenth embodiment, the display time of each slice level with respect to the R', G', and B' components is determined to match with the target gamma characteristics in the timing circuit 4. Thus, an image can be reproduced in which the characteristics of the L* value are controlled separately for an achromatic color and a chromatic color.

INDUSTRIAL APPLICABLITY

As described above, according to the present invention, even in the case where a small number of light sources are used, a full-color animation of VGA class can be easily displayed, and reduction in size of a liquid crystal driver circuit and a light source driver circuit can be attained for achievement of a low price. Further, full-color gradation control can be facilitated.

Further, a full-color animation of VGA class can be easily displayed, and full-color gradation control can be facilitated.

Furthermore, a field sequential color image display apparatus can be provided which can realize desired color characteristics independently of light-source characteristics.

The invention claimed is:

1. A color image display apparatus, comprising:

a color separation circuit that separates image data for each color component to accumulate the image data;

a shutter control circuit that slices the color component data, which has been subjected to color separation with said color separation circuit, in accordance with a slice level;

a light source control circuit that controls a light source corresponding to the color component data in synchronization with said shutter control circuit;

one or more light sources that is turned on or off in accordance with an instruction from said light source control circuit;

a converting device that converts an optical path of light from said light source;

a shutter which makes light from a corresponding pixel pass there through and cuts off the light based on an instruction from said shutter control circuit and which is made of liquid crystal as a main material; and a timing circuit that generates operation timings for said color separation circuit, said shutter control circuit, and said light source control circuit, in which:

said shutter control circuit transfers one line of slice data to the shutter sequentially on a slice level basis;

said light source control circuit turns on said light source corresponding to the slice data; and said shutter makes the light from said light source, which corresponds to the slice data representing gradation of the corresponding pixel, pass there through and cuts off the light to display an image.

2. The color image display apparatus according to claim 1, wherein:

said light source is comprised of plural point light sources corresponding to the color component data; and said converting device converts the point light sources to a surface light source.

3. The color image display apparatus according to claim 1, wherein:

said shutter control circuit generates slice data based on a magnitude relationship between the color component data and the slice level; and said timing circuit varies a display time corresponding to each slice data for each slice data.

4. The color image display apparatus according to claim 1, wherein:

said shutter control circuit generates slice data based on a magnitude relationship between the color component data and the slice level; and said timing circuit sequentially switches the color component data for each slice level, and generates a timing in performing color mixture on a slice level basis.

5. The color image display apparatus according to claim 1, wherein:

said shutter control circuit varies a change order in one line period of the slice level which judges gradation of each pixel of said shutter; and generates the slice data based on a magnitude relationship between the color component data and the slice level.

6. The color image display apparatus according to claim 1, wherein:

said light source control circuit varies a lighting voltage of said light source corresponding to the slice data in accordance with the slice data to turn said light source on.

7. The color image display apparatus according to claim 6, wherein:

said shutter control circuit generates the slice data based on a magnitude relationship between the color component data and the slice level;

said timing circuit varies a display time corresponding to each slice data for each slice data; and said light source control circuit performs gradation control in accordance with said light source lighting voltage and the display time corresponding to each slice data.

8. The color image display apparatus according to claim 1, wherein:

said shutter control circuit determines the slice data based on whether or not the color component data exists in a section sandwiched by two slice levels; generates a shutter drive voltage in accordance with the slice level; transfers one line of slice data to said shutter sequentially on a slice level basis; and drives said shutter with said shutter drive voltage.

9. The color image display apparatus according to claim 8, wherein:

said timing circuit varies a display time corresponding to each slice data for each slice data; and said light source control circuit performs gradation control in accordance with said shutter drive voltage and the display time corresponding to each slice data.

10. The color image display apparatus according to claim 1, wherein:

said shutter control circuit transfers one line of slice data on a color component basis to said shutter sequentially on a slice level basis;

said light source control circuit turns said light source corresponding to the slice data on; and said shutter makes the light from said light source, which corresponds to the slice data representing gradation of the corresponding pixel, pass therethrough and cuts off the light to display an image.

11. The color image display apparatus according to claim 10, wherein:

said timing circuit varies a display time corresponding to each slice data for each slice data.

12. The color image display apparatus according to claim 1, wherein:

said shutter control circuit outputs slice data for plural dummy lines other than the line that can be displayed with said shutter; and a common output of said shutter control circuit which corresponds to the dummy line is not connected with a common electrode of said shutter.

13. The color image display apparatus according to claim 12, wherein:

said dummy lines appear at a timing of the switch of the line of the image data.

14. The color image display apparatus according to claim 12, wherein:

said dummy lines appear at a timing of the change of the color component of the image data.

15. A color image display apparatus, comprising:

a color separation circuit that separates image data for each color component to accumulate the image data;

a shutter control circuit that slices the color component data, which has been subjected to color separation with said color separation circuit, in accordance with a slice level;

a light source control circuit that controls a light source corresponding to the color component data in synchronization with said shutter control circuit;

one or more light sources that are turned on or off in accordance with an instruction from said light source control circuit;

a converting device that converts an optical path of light from said light source;

a shutter which makes light of a corresponding pixel pass therethrough and cuts off the light based on an instruction from said shutter control circuit and which is made of liquid crystal as a main material; and a timing circuit that generates operation timings for said color separation circuit, said shutter control circuit, and said light source control circuit, in which:

said color separation circuit separates the image data into four color components including achromatic color components and chromatic color components;

said light sources are light sources for light emitting colors corresponding to the chromatic color components;

said shutter control circuit transfers one line of slice data to said shutter sequentially on a slice level basis;

said light source control circuit uses mixed color light that is obtained by lighting said light sources for all the light emitting colors corresponding to the chromatic color components with respect to the slice data corresponding to the achromatic color components, and uses monochromatic lights corresponding to the respective chromatic color components with respect to the slice data corresponding to the chromatic color components; and said shutter makes the light from said light source, which corresponds to the slice data representing gradation of the corresponding pixel, pass therethrough and cuts off the light to display an image.

16. The color image display apparatus according to claim 15, wherein:

said light source control circuit varies a light source voltage corresponding to each of the chromatic color components and a light source voltage corresponding to each of the achromatic color components.

17. The color image display apparatus according to claim 15, wherein:

said light source corresponding to the achromatic color components is a white light source.

18. A color image display apparatus, comprising:

a color separation circuit that separates image data for each color component to accumulate the image data;

a shutter control circuit that slices the color component data, which has been subjected to color separation with said color separation circuit, in accordance with a slice level;

a light source control circuit that controls a light source corresponding to the color component data in synchronization with said shutter control circuit;

one or more light sources that are turned on or off in accordance with an instruction from said light source control circuit;

a converting device that converts an optical path of light from said light source;

a shutter which makes light of a corresponding pixel pass therethrough and cuts off the light based on an instruction from said shutter control circuit and which is made of liquid crystal as a main material; and a timing circuit that generates operation timings for said color separation circuit, said shutter control circuit, and said light source control circuit, in which:

said color separation circuit separates the image data into seven color components including achromatic color components, primary color components, and complementary color components;

said light sources are light sources for light emitting colors corresponding to the primary color components;

said shutter control circuit transfers one line of slice data to said shutter sequentially on a slice level basis;

said light source control circuit uses mixed color light that is obtained by lighting said light sources for all the light emitting colors corresponding to the primary color components with respect to the slice data corresponding to the achromatic color components, uses mixed color lights of two primary color lights corresponding to the respective complementary color components with respect to the slice data corresponding to the complementary color components, and uses primary color lights corresponding to the respective primary color components with respect to the slice data corresponding to the primary color components; and said shutter makes the light from said light source, which corresponds to the slice data representing gradation of the corresponding pixel, pass therethrough and cuts off the light to display an image.

19. The color image display apparatus according to claim 18, wherein:

said light source control circuit varies a light source voltage corresponding to each of the primary color components, a light source voltage corresponding to each of the complementary color components, and a light source voltage corresponding to each of the achromatic color components.

20. A color image display apparatus, comprising:

a color separation circuit that separates image data for each color component to accumulate the image data;

a shutter control circuit that slices the color component data, which has been subjected to color separation with said color separation circuit, in accordance with a slice level;

a light source control circuit that controls a light source corresponding to the color component data in synchronization with said shutter control circuit;

one or more light sources that are turned on or off in accordance with an instruction from said light source control circuit;

a converting device that converts an optical path of light from said light source;

a shutter which makes light of a corresponding pixel pass therethrough and cuts off the light based on an instruction from said shutter control circuit and which is made of liquid crystal as a main material; and a timing circuit that generates operation timings for said color separation circuit, said shutter control circuit, and said light source control circuit, in which:

said color separation circuit separates the image data into four color components including specific color components and primary color components not containing the specific color components;

said light sources are light sources for light emitting colors corresponding to the primary color components and for light emitting colors corresponding to the specific color components;

said shutter control circuit transfers one line of slice data to said shutter sequentially on a slice level basis;

said light source control circuit uses lights obtained by lighting said light sources corresponding to the specific color components with respect to the slice data corresponding to the specific color components, and uses primary color lights corresponding to the respective primary color components with respect to the slice data corresponding to the primary color components except the specific color components; and said shutter makes the light from said light source, which corresponds to the slice data representing gradation of the corresponding pixel, pass therethrough and cuts off the light to display an image.

21. The color image display apparatus according to claim 20, wherein:

plural specific color components and corresponding plural specific color light sources are used for said light sources.

22. A color image display apparatus, comprising:

a color separation circuit that separates image data for each color component to accumulate the image data;

a shutter control circuit that slices the color component data, which has been subjected to color separation with said color separation circuit, in accordance with a slice level;

a light source control circuit that controls a light source corresponding to the color component data in synchronization with said shutter control circuit;

one or more light sources that are turned on or off in accordance with an instruction from said light source control circuit;

a converting device that converts an optical path of light from said light source;

a shutter which makes light of a corresponding pixel pass therethrough and cuts off the light based on an instruction from said shutter control circuit and which is made of liquid crystal as a main material; and a timing circuit that generates operation timings for said color separation circuit, said shutter control circuit, and said light source control circuit, in which:

said shutter is divided into at least one sub-shutter;

said shutter control circuit transfers slice data corresponding to a sub-shutter region among pixels for one line to the sub-shutter sequentially on a slice level basis; and a sub-shutter makes the light from said light source, which corresponds to the slice data representing gradation of the corresponding pixel, pass therethrough and cuts off the light to display an image.

23. The color image display apparatus according to claim 22, wherein:

said sub-shutter is structured in a physically continuous space.

24. The color image display apparatus according to claim 22, wherein:

said sub-shutter is structured in a physically discontinuous space.

25. The color image display apparatus according to claim 22, wherein said shutter control circuit varies an order of scanning an electrode in the sub-shutter for each sub-shutter.

26. A color image display apparatus, comprising:

a color separation circuit that separates image data for each color component to accumulate the image data;

a shutter control circuit that slices the color component data, which has been subjected to color separation with said color separation circuit, in accordance with a slice level;

a light source control circuit that controls a light source corresponding to the color component data in synchronization with said shutter control circuit;

one or more light sources that are turned on or off in accordance with an instruction from said light source control circuit;

a converting device that converts an optical path of light from said light source;

a shutter which makes light of a corresponding pixel pass therethrough and cuts off the light based on an instruction from said shutter control circuit and which is made of liquid crystal as a main material; and a timing circuit that generates operation timings for said color separation circuit, said shutter control circuit, and said light source control circuit, in which:

said color separation circuit separates the image data into plural color components; and said shutter control circuit performs gradation control for each color component on a slice level basis in a color engineering manner.

27. The color image display apparatus according to claim 26, wherein: said color separation circuit separates the image data into image data for achromatic color components and image data for chromatic color components; and the apparatus further comprises a compensator, which accumulates inverse-characteristics data that compensates for color characteristics with respect to image data of R=G=B measured in advance, and reflects the inverse-characteristics data corresponding to a value of the achromatic color components in the chromatic color components to thereby perform color mixture of the characteristics of the achromatic color components and the inverse characteristics corresponding to the value of the achromatic color components.

28. The color image display apparatus according to claim 27, wherein:

the color mixture of the color characteristics with respect to image data of R=G=B measured in advance and the inverse characteristics produces an achromatic color in a color engineering manner.

29. The color image display apparatus according to claim 26, wherein: said color separation circuit separates the image data into image data for achromatic color components and image data for chromatic color components; and said timing circuit always lights said light sources corresponding to the chromatic color components in a slice data period corresponding to the chromatic color components, and varies a lighting period of said light sources such that a reproduction color at each slice level becomes an achromatic color in a color engineering manner in a slice data period corresponding to the achromatic color components.

30. The color image display apparatus according to claim 26, wherein:

said color separation circuit separates the image data into image data for achromatic color components and image data for chromatic color components; and said timing circuit equalizes a display time for each slice level in a slice data period corresponding to the chromatic color components, and varies the display time for each slice level such that a reproduction color shows desired characteristics in a slice data period corresponding to the achromatic color components.

31. The color image display apparatus according to claim 26, wherein:

said color separation circuit separates the image data into image data for achromatic color components and image data for chromatic color components; and said timing circuit always lights said light sources corresponding to the chromatic color components and equalizes a display time for each slice level in a slice data period corresponding to the chromatic color components, and varies a lighting period of said light sources such that a reproduction color at each slice level becomes an achromatic color in a color engineering manner and varies the display time for each slice level such that the reproduction color shows desired characteristics in a slice data period corresponding to the achromatic color components.

32. The color image display apparatus according to claim 26, wherein:

said color separation circuit separates the image data into image data for achromatic color components and image data for chromatic color components; and said timing circuit varies a display time for each slice level such that a reproduction color shows desired characteristics in a slice data period corresponding to the chromatic color components, and equalizes the display time for each slice level in a slice data period corresponding to the achromatic color components.

33. The color image display apparatus according to claim 26, wherein:

said color separation circuit separates the image data into image data for achromatic color components and image data for chromatic color components; and said timing circuit always lights said light sources corresponding to the chromatic color components and varies a display time for each slice level such that a reproduction color shows desired characteristics in a slice data period corresponding to the chromatic color components, and varies a lighting period of said light sources such that the reproduction color at each slice level becomes an achromatic color in a color engineering manner and varies the display time for each slice level such that the reproduction color shows desired characteristics in a slice data period corresponding to the achromatic color components.

* * * * *